US008895216B2

(12) United States Patent
Haruyama

(10) Patent No.: US 8,895,216 B2
(45) Date of Patent: Nov. 25, 2014

(54) IMAGE FORMING APPARATUS

(75) Inventor: Daisuke Haruyama, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 16 days.

(21) Appl. No.: 13/461,359

(22) Filed: May 1, 2012

(65) Prior Publication Data

US 2013/0122408 A1 May 16, 2013

(30) Foreign Application Priority Data

Nov. 14, 2011 (JP) ..... 2011-249078

(51) Int. Cl.
*G03G 5/147* (2006.01)
*G03G 15/00* (2006.01)

(52) U.S. Cl.
CPC ..... *G03G 5/14704* (2013.01); *G03G 15/75* (2013.01); *G03G 5/14726* (2013.01); *G03G 5/14786* (2013.01)
USPC ..... 430/66; 430/108.4; 399/159

(58) Field of Classification Search
USPC ..... 399/159; 430/66, 108.4
See application file for complete search history.

(56) References Cited

U.S. PATENT DOCUMENTS

| | | | | |
|---|---|---|---|---|
| 4,792,507 | A | 12/1988 | Yoshihara et al. | |
| 5,399,452 | A * | 3/1995 | Takegawa et al. | 430/59.6 |
| 6,319,647 | B1 * | 11/2001 | Gutman et al. | 430/111.41 |
| 2002/0119382 | A1 | 8/2002 | Nakata et al. | |
| 2003/0152854 | A1 * | 8/2003 | Kojima et al. | 430/58.05 |
| 2008/0199795 | A1 * | 8/2008 | Ogaki et al. | 430/66 |
| 2009/0004583 | A1 * | 1/2009 | Nukada et al. | 430/58.5 |

FOREIGN PATENT DOCUMENTS

| | | |
|---|---|---|
| JP | A-56-011461 | 2/1981 |
| JP | A-56-051749 | 5/1981 |
| JP | A-62-039879 | 2/1987 |
| JP | A-63-221355 | 9/1988 |
| JP | A-08-278645 | 10/1996 |
| JP | A-11-338307 | 12/1999 |
| JP | A-2002-082469 | 3/2002 |
| JP | A-2003-186234 | 7/2003 |
| JP | A-2004-189873 | 7/2004 |
| JP | A-2004-198662 | 7/2004 |
| JP | A-2005-043823 | 2/2005 |
| JP | A-2005-091500 | 4/2005 |
| JP | A-2005-098181 | 4/2005 |
| JP | A-2005-099737 | 4/2005 |
| JP | A-2005-140472 | 6/2005 |
| JP | A-2005-140473 | 6/2005 |
| JP | A-2005-263007 | 9/2005 |

(Continued)

*Primary Examiner* — Peter Vajda
*Assistant Examiner* — Olatunji Godo
(74) *Attorney, Agent, or Firm* — Oliff PLC

(57) ABSTRACT

An image forming apparatus includes an electrophotographic photoreceptor having a photosensitive layer, and a surface protective layer that contains fluororesin particles and a fluorinated alkyl group-containing copolymer; a charging unit that charges the surface of the electrophotographic photoreceptor; an electrostatic latent image forming unit that forms an electrostatic latent image; a developing unit that accommodates a developer, and develops the electrostatic latent image with the developer to form a toner image; a transfer unit that transfers the toner image to a recording medium; and a cleaning unit that removes the remained developer, wherein when the electrophotographic photoreceptor is rotated 50,000 times by repeating the formation of an image having image sections and non-image sections and having an image density of 7%, and then the surface of the electrophotographic photoreceptor is analyzed by X-ray photoelectron spectroscopy, the zinc coating ratio is in the range of from 50% to 100%.

10 Claims, 7 Drawing Sheets

(56) References Cited

FOREIGN PATENT DOCUMENTS

| | | |
|---|---|---|
| JP | A-2005-279591 | 10/2005 |
| JP | A-2008-139804 | 6/2008 |
| JP | A-2008-176293 | 7/2008 |
| JP | A-2008-208820 | 9/2008 |
| JP | A-2010-151967 | 7/2010 |

* cited by examiner

IMAGE FORMING APPARATUS

CROSS-REFERENCE TO RELATED APPLICATIONS

This application is based on and claims priority under 35 USC 119 from Japanese Patent Application No. 2011-249078 filed Nov. 14, 2011

BACKGROUND

1. Technical Field

The present invention relates to an image forming apparatus.

2. Related Art

In recent years, image forming apparatuses of a so-called xerographic system, which includes a charging unit, an exposure unit, a development unit, a transfer unit, a fixing unit and the like, have been improved in view of a further increase of the printing speed and a further increase in the service life, along with the progress in the technical development of various members and systems.

For example, in an electrophotographic photoreceptor (appropriately referred to as "photoreceptor") used in image writing, when a resin having high mechanical strength is used as the material constituting the surface layer in order to suppress damage or abrasion caused by the electrical or mechanical external forces exerted by a charging unit, a developing unit, a transfer unit, a cleaning unit and the like, an increase in the service life may be achieved.

Furthermore, investigations are being conducted to improve the characteristics of the surface layer, in order to improve the cleaning properties to remove toner and the like that remain on the surface of the photoreceptor.

SUMMARY

According to an aspect of the present invention, there is provided an image forming apparatus which includes: an electrophotographic photoreceptor having a conductive substrate, a photosensitive layer disposed on the conductive substrate, and a surface protective layer disposed on the photosensitive layer and containing fluororesin particles and a fluorinated alkyl group-containing copolymer; a charging unit that charges the surface of the electrophotographic photoreceptor; an electrostatic latent image forming unit that forms an electrostatic latent image on the surface of the charged electrophotographic photoreceptor; a developing unit that accommodates a developer containing toner particles and zinc stearate, and develops the electrostatic latent image formed on the surface of the electrophotographic photoreceptor with the developer to form a toner image; a transfer unit that transfers the toner image formed on the surface of the electrophotographic photoreceptor to a recording medium; and a cleaning unit that removes the developer remaining on the surface of the electrophotographic photoreceptor, wherein when the electrophotographic photoreceptor is rotated 50,000 times by repeating the formation of an image having image sections and non-image sections and having an image density of 7%, and then the surface of the electrophotographic photoreceptor is analyzed by an X-ray photoelectron spectroscopy (XPS) method, a zinc coating ratio is in range of from about 50% to about 100%.

BRIEF DESCRIPTION OF THE DRAWINGS

Exemplary embodiments of the present invention will be described in detail based on the following figures, wherein.

DETAILED DESCRIPTION

Figure 1:
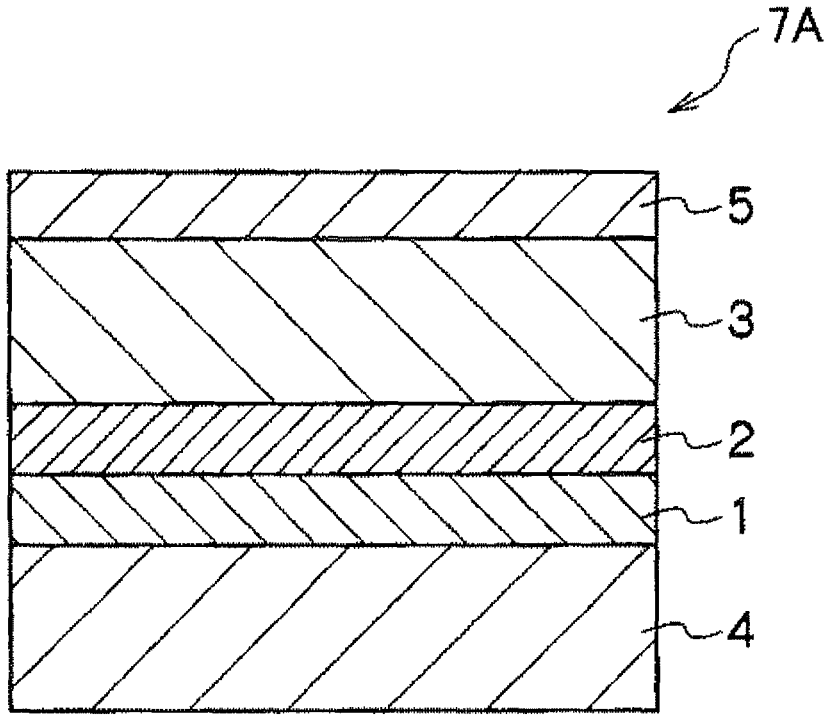
FIG. 1 is a schematic cross-sectional diagram showing an example of the electrophotographic photoreceptor used in the exemplary embodiment of the present invention.

Hereinafter, exemplary embodiments of the present invention will be described in detail with reference to the attached drawings. Meanwhile, in the drawings, the same reference symbol will be assigned to identical or corresponding members, and further explanation will not be repeated.

The image forming apparatus according to the exemplary embodiment of the present invention includes an electrophotographic photoreceptor having a conductive substrate, a photosensitive layer disposed on the conductive substrate, and a surface protective layer disposed on the photosensitive layer and containing fluororesin particles and a fluorinated alkyl group-containing copolymer; a charging unit that charges the surface of the electrophotographic photoreceptor; an electrostatic latent image forming unit that forms an electrostatic latent image on the surface of the charged electrophotographic photoreceptor; a developing unit that accommodates a developer containing toner particles and zinc stearate and develops the electrostatic latent image formed on the surface of the electrophotographic photoreceptor with the developer to form a toner image; a transfer unit that transfers the toner image formed on the surface of the electrophotographic photoreceptor to a recording medium; and a cleaning unit that removes the developer remaining on the surface of the electrophotographic photoreceptor, wherein when the electrophotographic photoreceptor is rotated 50,000 times by repeating the formation of an image having image sections and non-image sections and having an image density of 7%, and then the surface of the electrophotographic photoreceptor is analyzed by an X-ray photoelectron spectroscopy (XPS) method, the zinc coating ratio satisfies the following relationship (1):

$$50\% \leq \text{zinc coating ratio} \leq 100\% \quad (1)$$

The inventors of the present invention find that when toner particles and zinc stearate are supplied together as a developer to an electrophotographic photoreceptor containing fluororesin fine particles and a fluorinated alkyl group-containing copolymer in the outermost surface layer, and the zinc coating ratio of the photoreceptor surface after 50,000 rotations is controlled, the abrasion resistance of the photoreceptor is maintained against the repeated use of the photoreceptor for a long time, without installing a new member such as a lubricant applicator and irrespective of the service life of the lubricant applicator, and also, the occurrence of image deletion is suppressed. Furthermore, in the image forming apparatus according to the exemplary embodiment of the present invention, as described above, when the formation of an image having image sections and non-image sections and having an image density of 7% is repeatedly carried out, and the zinc coating ratio of the surface of the photoreceptor after 50,000 rotations satisfies the relationship (1), the abrasion resistance of the photoreceptor is maintained, and the occurrence of image deletion is suppressed.

Here, the "image having image sections and non-image sections and having an image density of 7%" is not particularly limited in terms of the image pattern as long as the overall image density is 7%. For example, the image patterns shown in FIG. 7A, FIG. 7B and FIG. 7C may be employed.

Figure 7A:
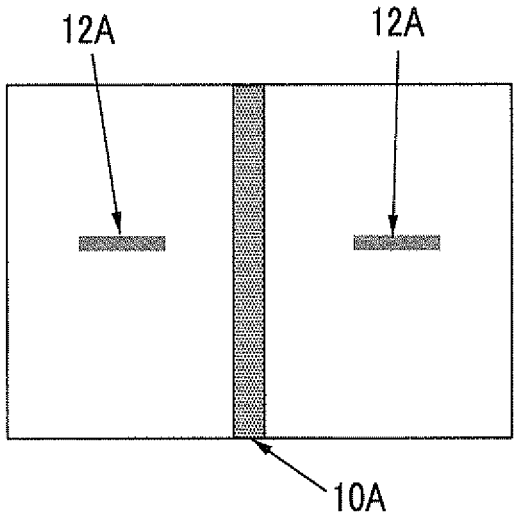
FIGS. 7A, 7B and 7C are diagrams showing examples of the image pattern having image sections and non-image sections and having an image density of 7%.

The image pattern shown in FIG. 7A has a band-shaped image section 10A having an image density of 100% in the middle, and two band-shaped image sections 12A having an image density of 30% that are located on both sides of the band-shaped image section 10A, and thus the overall image density is 7%. Meanwhile, the term "image density" is a value measured based on the proportion of printed paper covered by toner (=area covered by toner/area of the paper).

Figure 7B:
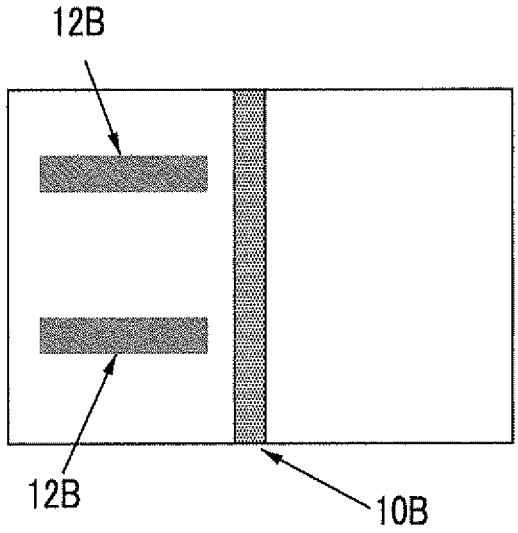

In the image pattern shown in FIG. 7B, the band-shaped image section 10B having an image density of 100% is narrower than the image section 10A in FIG. 7A, while the band-shaped image section 12B having an image density of 30% is broader than the image section 12A in FIG. 7A, and thus the overall image density is 7%.

Figure 7C:
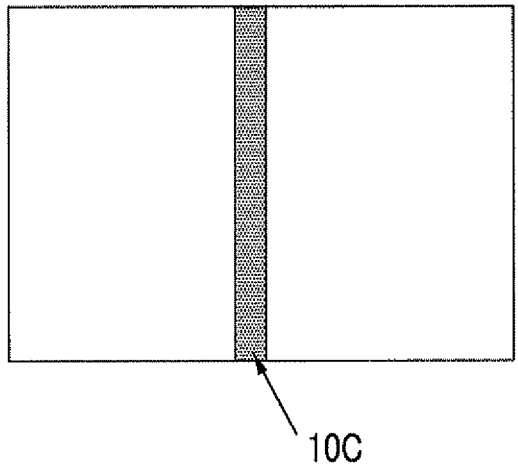

The image pattern shown in FIG. 7C does not have an image section having an image density of 30%, but the band-shaped image section 10C having an image density of 100% is broader than the band-shaped image section 10A in FIG. 7A, and the overall image density is 7%.

The reason why the abrasion resistance is maintained while the occurrence of image deletion is suppressed in the image forming apparatus according to the exemplary embodiment of the invention is not clearly known, but the reason is speculated to be as follows.

It is speculated that the fluororesin particles and the fluorinated alkyl group-containing copolymer have properties of being likely to be negatively charged, and that since zinc stearate has properties of being likely to be positively charged, when fluororesin particles and a fluorinated alkyl group-containing copolymer are contained in the outermost surface layer, the coating efficiency of zinc stearate is higher than the case where the particles and the copolymer are not contained. On the other hand, it can also be contemplated that since zinc stearate has high cleavability, discharge products that cause image deletion are accumulated on the coated zinc stearate, and the discharge product may be removed together with zinc stearate.

Here, in regard to the definition of the zinc coating ratio on the photoreceptor surface, quantification by an XPS analysis is carried out in the exemplary embodiment of the invention. The XPS analysis is effective in an analysis of an extremely small amount of elements on the surface, but since the coating ratio is measured in the form of the elemental ratio of zinc relative to the total amount of elements, if the amount of coating increases, the value of the ratio becomes saturated. The coating ratio is defined by designating the ratio of zinc relative to all elements at the point of saturation as a coating ratio of 100%, and the analysis value (the value of the ratio of zinc relative to all elements) of the photoreceptor surface where no zinc stearate has been applied, as a coating ratio of 0%. When the zinc coating ratio of the photoreceptor surface is defined, the effective amount of coating of zinc stearate as a lubricant is controlled. Furthermore, when the amount of zinc on the photoreceptor surface is defined by its coating ratio, as discussed above, the intensity of the peak related to zinc in the XPS analysis increases as the amount of coating of zinc stearate is increased, and the intensity becomes saturated at a certain constant amount of coating. However, this state is defined as the reference of 100% coating of the photoreceptor surface by zinc stearate, and thereby the amount of coating is handled as an absolute quantitative value that is not affected by the ground state.

When the zinc coating ratio at the surface of the photoreceptor is defined, deterioration of the photoreceptor is suppressed, and when a cleaning unit that cleans the photoreceptor surface is available, deterioration of the cleaning unit is suppressed. As a result, satisfactory image quality is achieved over a long time.

Hereinafter, the method for measuring the coating ratio of zinc (Zn) by an XPS analysis will be described.

According to the exemplary embodiment of the present invention, the coating ratio of zinc based on an XPS analysis is determined based on the value of the ratio of zinc relative to all elements measured by a JPS 9010 (manufactured by JEOL, Ltd.). Since the XPS analysis is an analysis of the outermost surface of the photoreceptor, the value of the ratio of zinc relative to all elements becomes saturated with respect to an increase in the amount of coating of zinc stearate. The value of the ratio of zinc relative to all elements at the saturation is designated as a coating ratio of 100%, and thereby the coating ratio of zinc at the photoreceptor surface is determined. The values described in the present specification are values measured according to the relevant method.

Furthermore, the minimum amount of coating in the amount of coating of zinc stearate that gives a zinc coating ratio of 100% by an XPS analysis is determined in the following manner.

When the analysis value of the photoreceptor surface in the case where no zinc stearate is applied is designated as 0%, and the values of the ratio of zinc relative to all elements in an XPS analysis are plotted against the amount of coating of zinc stearate at the photoreceptor surface, the value of the ratio of zinc relative to all elements increases along with an increase in the amount of coating. However, when a certain constant amount of coating is reached, the value of the ratio of zinc relative to all elements becomes saturated, and retains a constant value. The amount of coating at the inflection point as revealed from the plot is the minimum amount of coating of zinc stearate at the 100% coating ratio.

In the image forming apparatus according to the exemplary embodiment of the invention, it is constituted such that the formation of an image having image sections and non-image sections and having an image density of 7% is repeatedly carried out, and the zinc coating ratio of the surface of the photoreceptor after 50,000 rotations is from 50% to 100% (or from about 50% to about 100%). The zinc coating ratio is desirably from 50% to 90% (or from about 50% to about 90%), and more desirably from 55% to 70% (or from about 55% to about 70%).

Furthermore, it is desirable that in the surface of the photoreceptor, the difference between the zinc coating ratio in a region corresponding to the image section and the zinc coating ratio in a region corresponding to the non-image section be 10% or less (or about 10% or less).

In the case of supplying zinc stearate using a lubricant supply apparatus, zinc stearate is supplied evenly, irrespective of the image section and the non-image section. However, when a cleaning blade is used as a cleaning unit, zinc stearate is also scraped off together with toner, and therefore, the zinc coating ratio at the image section tends to be low. On one hand, for example, when the image formation of the image pattern shown in FIG. 7A is repeated, since zinc stearate is supplied together with toner particles in a region corresponding to the image section, which corresponds to an area having an image density of 100%, on the photoreceptor surface, even if the amount scraped off with the toner is larger than the amount at the non-image section, a high zinc coating ratio may be maintained. On the other hand, even if the amount of zinc stearate supplied is small in a region corresponding to the non-image section, there is no toner that is scraped off together. Also, when a cleaning unit is provided such that a cleaning blade or a cleaning brush is brought into contact across the entire width direction (the direction perpendicular to the direction of rotation) of the photoreceptor, zinc stearate is supplied over the entire width direction of the photoreceptor, and an imbalance of the zinc coating ratio is suppressed. When the difference between the zinc coating ratio in a region corresponding to the image section and the zinc coating ratio in a region corresponding to the non-image section at the surface of the electrophotographic photoreceptor is adjusted to 10% or less, abrasion and the occurrence of image deletion over the entire surface of the photoreceptor are more effectively suppressed, irrespective of the image section or the non-image section.

[Electrophotographic Photoreceptor]

First, the electrophotographic photoreceptor according to the exemplary embodiment of the present invention will be described in detail with reference to the attached drawings.

Figure 2:
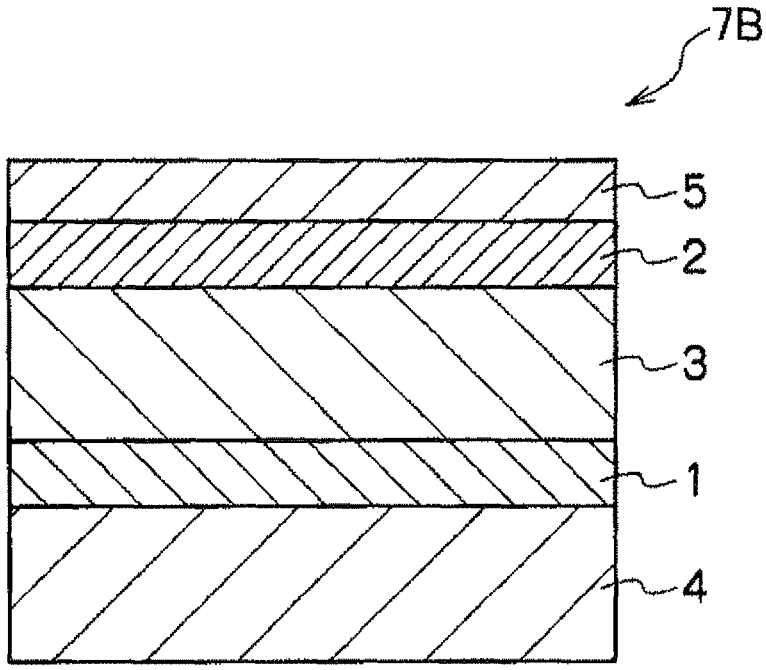
FIG. 2 is a schematic cross-sectional diagram showing another example of the electrophotographic photoreceptor used in the exemplary embodiment of the present invention.
Figure 3:
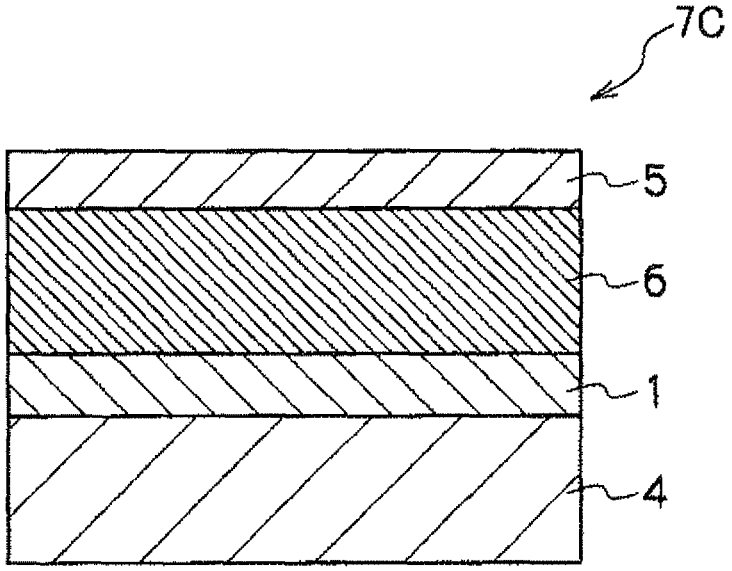
FIG. 3 is a schematic cross-sectional diagram showing another example of the electrophotographic photoreceptor used in the exemplary embodiment of the present invention.

FIG. 1 schematically shows an example of the configuration of the electrophotographic photoreceptor according to the exemplary embodiment of the invention, and FIG. 2 and FIG. 3 respectively show other configurations of the electrophotographic photoreceptor schematically.

The electrophotographic photoreceptor 7A shown in FIG. 1 is a so-called functionally separated photoreceptor (or a laminate type photoreceptor), and has a structure in which an undercoat layer 1 is provided on a conductive substrate 4, a photosensitive layer constructed by sequentially forming a charge generating layer 2 and a charge transport layer 3 is provided thereon, and a surface protective layer 5 is provided thereon as the outermost surface layer.

The electrophotographic photoreceptor 7B shown in FIG. 2 is a functionally separated photoreceptor which is functionally separated into a charge generating layer 2 and a charge transport layer 3, similarly to the electrophotographic photoreceptor 7B shown in FIG. 1, and has a structure in which an undercoat layer 1 is provided on a conductive substrate 4, a photosensitive layer constructed by sequentially forming a charge transport layer 3 and a charge generating layer 2 is provided thereon, and a surface protective layer 5 is provided thereon.

The electrophotographic photoreceptor 7C shown in FIG. 3 is an integrated function type photoreceptor having a charge generating material and a charge transporting material in the same layer (charge generating/charge transport layer 6), and has a structure in which an undercoat layer 1 is provided on a conductive substrate 4, and a charge generating/charge transport layer 6 and a surface protective layer 5 are sequentially formed thereon. In the electrophotographic photoreceptor 7C, a single-layer type photosensitive layer composed of a charge generating/charge transport layer 6 is provided.

The electrophotographic photoreceptors shown in FIG. 1 to FIG. 3 may or may not be provided with the undercoat layer 1. Furthermore, an intermediate layer may also be provided between the undercoat layer 1 and the photosensitive layer.

Hereinafter, the various elements will be explained based on the electrophotographic photoreceptor 7A shown in FIG. 1.

<Surface Protective Layer>

The surface protective layer 5 is an outermost surface layer in the electrophotographic photoreceptor 7A, and is a layer provided to protect the photosensitive layer composed of a charge generating layer 2 and a charge transport layer 3. The surface protective layer 5 according to the exemplary embodiment is constituted to include at least fluororesin particles and a fluorinated alkyl group-containing copolymer. when the electrophotographic photoreceptor has such a surface protective layer 5, resistance to abrasion, damage and the like is imparted to the surface of the photoreceptor 7A, and an enhancement of the toner transfer efficiency may be promoted.

In the image forming apparatus of the exemplary embodiment, it can be realized that the zinc coating ratio of the photoreceptor surface after 50,000 rotations carried out by repeating the formation of an image having image sections and non-image sections and having an image density of 7% satisfies the above relationship (1) by mainly regulating the contents of the fluororesin particles and the fluorinated alkyl group-containing copolymer contained in the surface protective layer of the photoreceptor, and the content of the zinc stearate contained in the developer.

—Fluororesin Particles—

When the surface protective layer 5 contains fluororesin particles, the frictional force with the contact member such as a cleaning blade for removing the toner remaining on the surface of the photoreceptor after the toner image is transferred is reduced, and the abrasion of the surface of the electrophotographic photoreceptor is effectively suppressed. On the other hand, it is speculated that the frictional force between the remaining toner and the cleaning blade is maintained, so that foreign substances such as residual toner may be easily removed.

There are no particular limitations on the fluororesin particles contained in the surface protective layer 5, but it is desirable to select one kind or two or more kinds of a tetrafluoroethylene resin (PTFE), a trifluorochloroethylene resin, a hexafluoropropylene resin, a vinyl fluoride resin, a vinylidene fluoride resin, a difluorodichloroethylene resin, and copolymers thereof, and particularly, it is more desirable to incorporate at least one selected from polymers of ethylene fluoride and copolymers of tetrafluoroethylene and perfluoroalkoxyethylene.

The primary average particle diameter of the fluororesin particles is desirably from 0.05 μm to 1 μm and more desirably from 0.1 μm to 0.5 μm.

Meanwhile, the primary average particle diameter of the fluororesin particles is a value obtained by measuring a measurement liquid prepared by diluting a dispersion of the fluororesin particles in the same solvent as the dispersion, at a refractive index of 1.35 using a laser diffraction type particle diameter distribution analyzer LA-920 (manufactured by Horiba, Ltd.).

The content of the fluororesin particles relative to the total solids content of the surface protective layer 5 is desirably from 1% by weight to 40% by weight (or from about 1% by weight to about 40% by weight), and more desirably from 3% by weight to 20% by weight (or from about 3% by weight to about 20% by weight).

—Fluorinated Alkyl Group-Containing Copolymer—

When the surface protective layer 5 contains a fluorinated alkyl group-containing copolymer, the dispersion stability of the fluororesin fine particles is maintained.

The fluorinated alkyl group-containing copolymer contained in the surface protective layer 5 is not particular limited, but the fluorinated alkyl group-containing copolymer is desirably a fluorinated alkyl group-containing copolymer containing repeating units represented by the following structural formula A and structural formula B, and more desirably a resin synthesized by, for example, graft polymerization using a macromonomer such as an acrylic acid ester compound or a methacrylic acid ester compound, and a perfluoroalkylethyl (meth)acrylate or a perfluoroalkyl (meth)acrylate. Here, the term (meth)acrylate indicates acrylate or methacrylate.

Structural Formula (A)

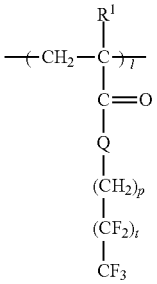

Structural Formula (B)

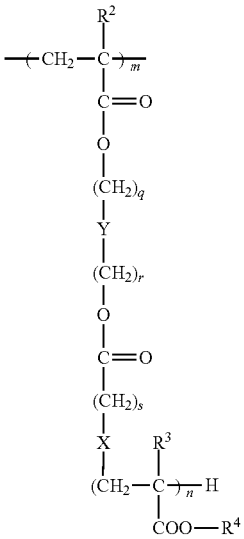

In the structural formula A and structural formula B, l, m and n each represent an integer of 1 or greater; p, q, r and s each represent 0 or an integer of 1 or greater; t represents an integer from 1 to 7; $R^1$, $R^2$, $R^3$ and $R^4$ each represent a hydrogen atom or an alkyl group; X represents an alkylene chain, a halogen-substituted alkylene chain, —S—, —O—, —NH— or a single bond; Y represents an alkylene chain, a halogen-substituted alkylene chain, —($C_zH_{2z-1}$ (OH))— or a single bond; z represents an integer of 1 or greater; and Q represents —O— or —NH—.

The weight average molecular weight of the fluorinated alkyl group-containing copolymer is desirably from 10,000 to 100,000, and more desirably from 30,000 to 100,000.

In the fluorinated alkyl group-containing copolymer, the content ratio of the structural formula A and the structural formula B, that is, 1:m, is desirably 1:9 to 9:1, and more desirably 3:7 to 7:3.

In the structural formula A and structural formula B, examples of the alkyl group represented by $R^1$, $R^2$, $R^3$ and $R^4$ include a methyl group, an ethyl group, and a propyl group. $R^1$, $R^2$, $R^3$ and $R^4$ are each desirably a hydrogen atom or a methyl group, and among these, a methyl group is more desirable.

The fluorinated alkyl group-containing copolymer may further include a repeating unit represented by structural formula (C). The content of the structural formula (C) indicated in terms of the ratio to the total content of the structural formula A and the formula B, that is, the ratio to l+m, is desirably 10:0 to 7:3, and more desirably 9:1 to 7:3, as the ratio of l+m:z.

Structural Formula (C)

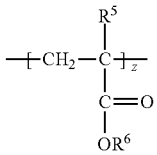

In the structural formula (C), $R^5$ and $R^6$ each represent a hydrogen atom or an alkyl group, and z represents an integer of 1 or greater.

Furthermore, $R^5$ and $R^6$ are each desirably a hydrogen atom, a methyl group, or an ethyl group, and among these, a methyl group is more desirable.

The content of the fluorinated alkyl group-containing copolymer in the surface protective layer 5 is desirably from 1% by weight to 10% by weight relative to the weight of the fluororesin particles.

Furthermore, the total content of the fluororesin particles and the fluorinated alkyl group-containing copolymer in the surface protective layer 5 is desirably 40% by weight or less, and more desirably 20% by weight or less. When the total content is 40% by weight or less, abrasion resistance may be enhanced while a decrease in the resolution is suppressed to the minimum. However, the total content of the fluororesin particles and the fluorinated alkyl group-containing copolymer is desirably 1% by weight or more, and more desirably 3% by weight or more, from the viewpoint of securely expressing the effect of enhancing abrasion resistance.

It is desirable that the surface protective layer 5 be constituted to contain, in addition to the fluororesin particles and the fluorinated alkyl group-containing copolymer, at least one selected from compounds having a guanamine structure (hereinafter, appropriately referred to as "guanamine compound") and compounds having a melamine structure (hereinafter, appropriately referred to as "melamine compound"), a charge transporting substance having an alkoxy group and a charge transporting substance having a hydroxyl group as the charge transporting materials.

The total content of the guanamine compound and the melamine compound is from 0.1% by weight to 20% by weight, relative to the total solids content of the outermost surface layer excluding the fluororesin particles and the fluorinated alkyl group-containing copolymer, and it is desirable that the content of the structure derived from the charge transporting substance having an alkoxy group relative to the total solids content of the outermost surface layer excluding the fluororesin particles and the fluorinated alkyl group-containing copolymer be from 10% by weight to 40% by weight.

When the surface protective layer 5 has a constitution such as described above, the abrasion resistance and electrical stability of the electrophotographic photoreceptor are further enhanced, the occurrence of image deletion is also suppressed, and the formation of images with satisfactory quality may be repeatedly obtained, so that the reliability and the service life of the image forming apparatus may be further increased.

—Guanamine Compound—

Here, the guanamine compound will be described. The guanamine compound used in the exemplary embodiment is a compound having a guanamine skeleton (structure), and examples include acetoguanamine, benzoguanamine, formoguanamine, steroguanamine, spiroguanamine, and cyclohexylguanamine.

The guanamine compound is particularly desirably at least one of a compound represented by the following formula (A) and oligomers thereof. Here, the oligomer is an oligomer produced by polymerizing a compound represented by the formula (A) as a structural unit, and the degree of polymerization is, for example, from 2 to 200 (desirably from 2 to 100). Meanwhile, the compound represented by the formula (A) may be used individually, or two or more kinds may be used in combination. Particularly, when a mixture of two or more kinds of compounds represented by the formula (A) is used, or an oligomer having a compound represented by the formula (A) as a structural unit is used, the solubility in solvents is enhanced.

(A)

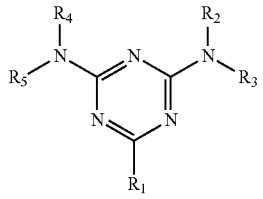

In the formula (A), $R_1$ represents a linear or branched alkyl group having from 1 to 10 carbon atoms, a substituted or unsubstituted phenyl group having from 6 to 10 carbon atoms, or a substituted or unsubstituted alicyclic hydrocarbon group having from 4 to 10 carbon atoms; $R_2$ to $R_5$ each independently represent a hydrogen atom, —$CH_2$—OH, or —$CH_2$—O—$R_6$; and $R_6$ represents a linear or branched alkyl group having from 1 to 10 carbon atoms.

In the formula (A), the alkyl group represented by $R_1$ has from 1 to 10 carbon atoms, and desirably from 1 to 8 carbon atoms, and more desirably from 1 to 5 carbon atoms. Furthermore, the alkyl group may be linear or may be branched.

In the formula (A), the phenyl group represented by $R_1$ has from 6 to 10 carbon atoms, and desirably from 6 to 8 carbon atoms. Examples of the substituent substituted on the phenyl group include a methyl group, an ethyl group, and a propyl group.

In the formula (A), the alicyclic hydrocarbon group represented by $R_1$ has from 4 to 10 carbon atoms, and desirably from 5 to 8 carbon atoms. Examples of the substituent substituted on the alicyclic hydrocarbon group include a methyl group, an ethyl group and a propyl group.

In the formula (A), in regard to the group "—$CH_2$—O—$R_6$" represented by $R_2$ to $R_5$, the alkyl group represented by $R_6$ has from 1 to 10 carbon atoms, desirably from 1 to 8 carbon atoms, and more desirably from 1 to 6 carbon atoms. Furthermore, the alkyl group may be linear or may be branched. Desirable examples include a methyl group, an ethyl group, and a butyl group.

The compound represented by the formula (A) is particularly desirably a compound in which $R_1$ represents a substituted or unsubstituted phenyl group having from 6 to 10 carbon atoms, and $R_2$ to $R_5$ each independently represent —$CH_2$—O—$R_6$. Furthermore, $R_6$ is desirably selected from a methyl group and an n-butyl group.

The compound represented by the formula (A) is synthesized by, for example, a known method using guanamine and formaldehyde (for example, Lectures on Experimental Chemistry, 4th Edition, vol. 28, p. 430).

Specific examples of the compound represented by the formula (A) are shown below, but the compound of formula (A) is not intended to be limited to these. Furthermore, the specific examples given below show monomers, but oligomers having these monomers as structural units may also be used.

(A)-1

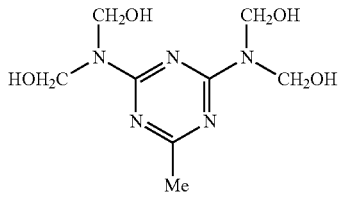

(A)-2

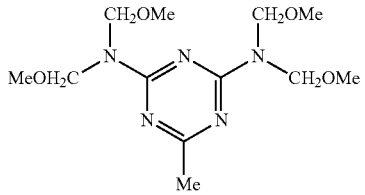

(A)-3

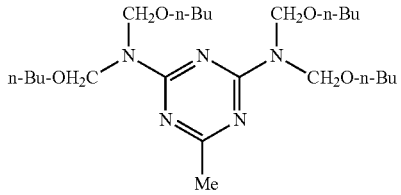

(A)-4

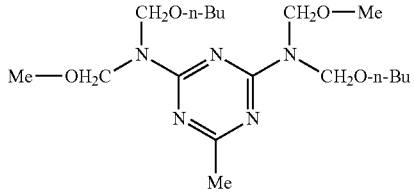

(A)-5

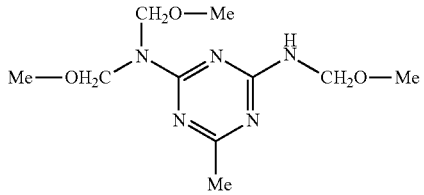

(A)-6

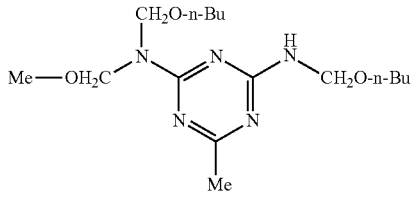

-continued
(A)-7
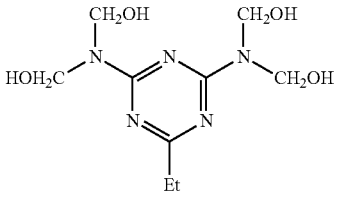
(A)-8
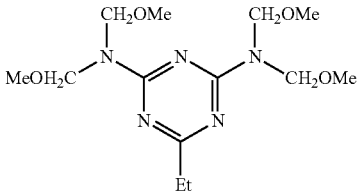
(A)-9
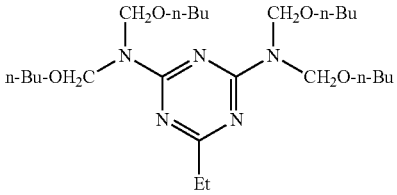
(A)-10
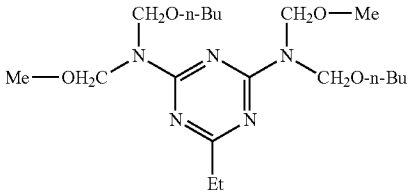
(A)-11
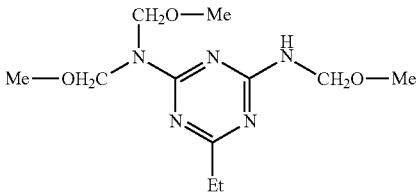
(A)-12
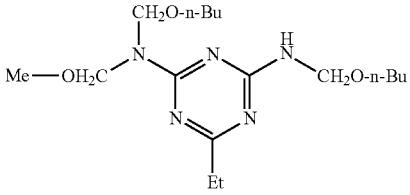
(A)-13
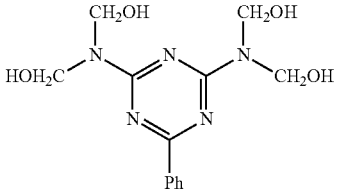
(A)-14
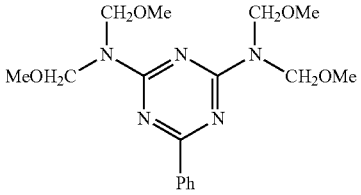
-continued
(A)-15
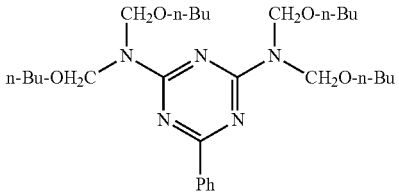
(A)-16
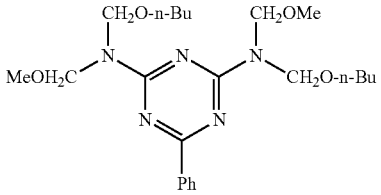
(A)-17
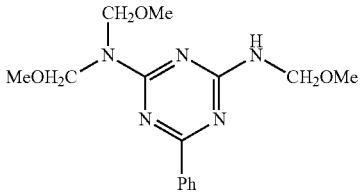
(A)-18
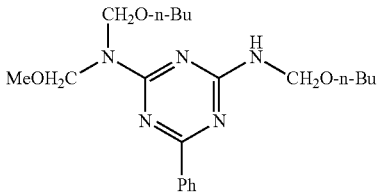
(A)-19
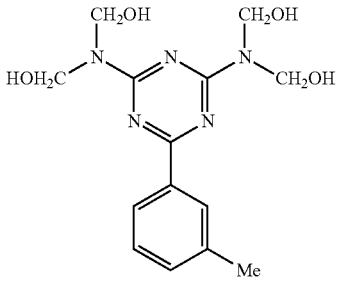
(A)-20
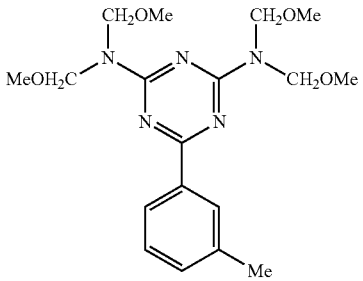

-continued
(A)-21
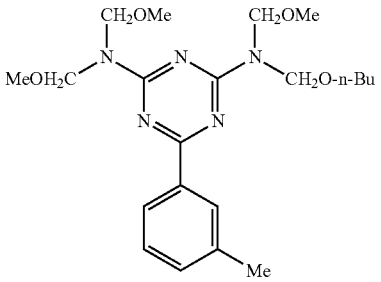
(A)-22
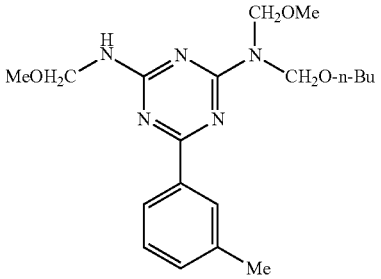
(A)-23
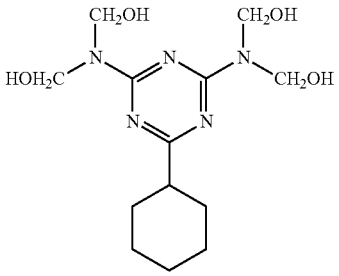
(A)-24
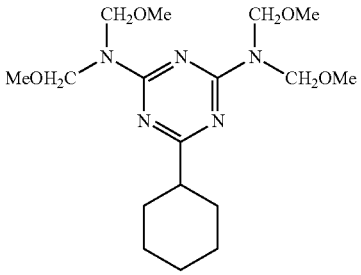
(A)-25
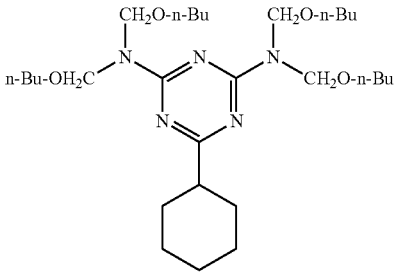
-continued
(A)-26
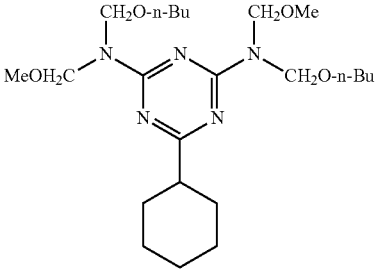
(A)-27
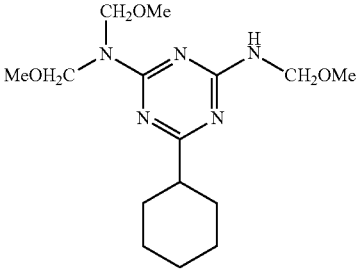
(A)-28
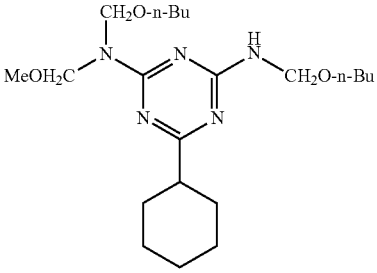
(A)-29
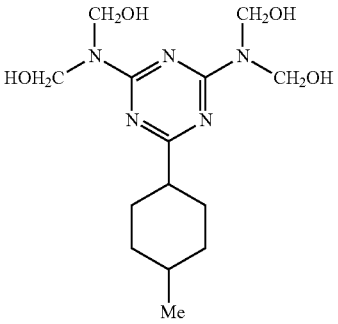
(A)-30
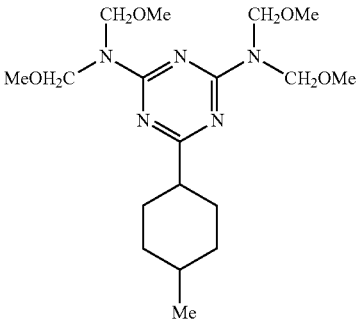

-continued
(A)-31
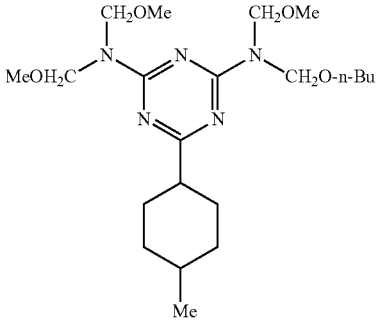
(A)-32
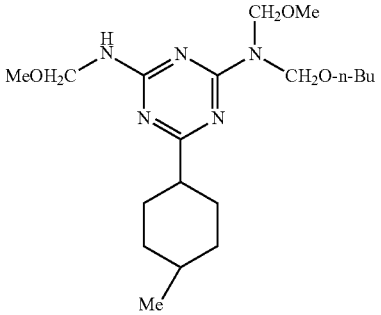
(A)-33
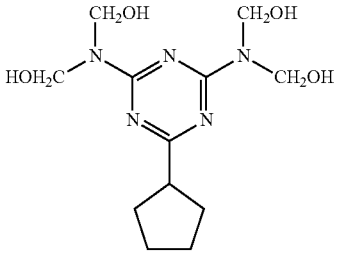
(A)-34
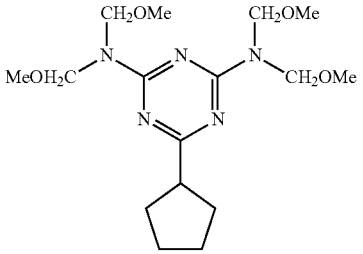
(A)-35
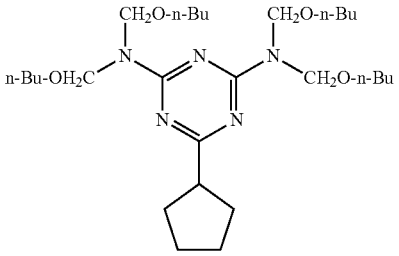
-continued
(A)-36
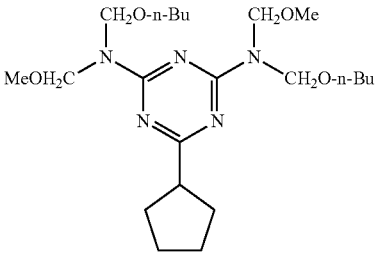
(A)-37
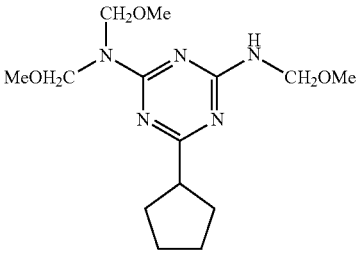
(A)-38
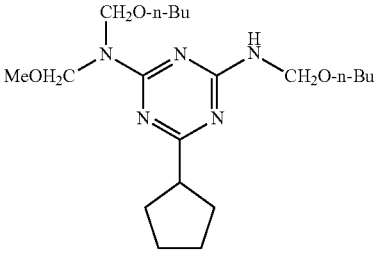
(A)-39
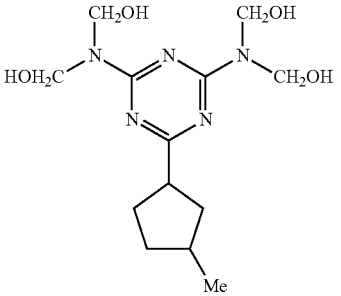
(A)-40
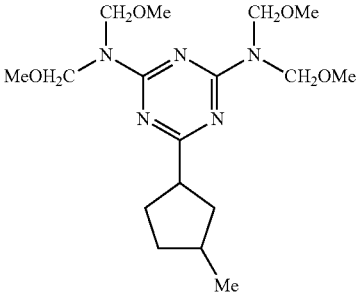

-continued (A)-41

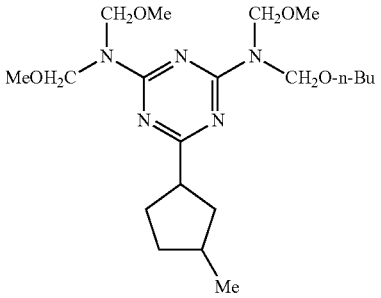

(A)-42

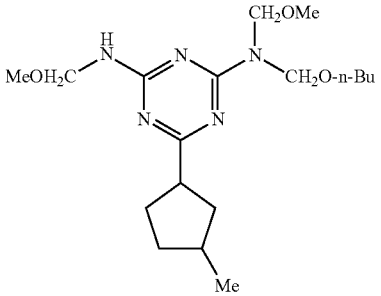

Examples of commercially available products of the compound represented by the formula (A) include "SUPER BECKAMINE L-148-55, SUPER BECKAMINE 13-535, SUPER BECKAMINE L-145-60, and SUPER BECKAMINE TD-126," all manufactured by DIC Corporation; and "NIKALAC BL-60, and NIKALAC BX-4000" manufactured by Nippon Carbide Industries Co., Inc.

Furthermore, after the synthesis or the purchase of commercially available products, the compound represented by the formula (A) (including oligomers) may be dissolved in an appropriate solvent such as toluene, xylene or ethyl acetate, in order to eliminate the effect of residual catalyst, and washed with distilled water, ion exchanged water or the like, or the residual catalyst may be eliminated by treating the compound with an ion exchange resin.

—Melamine Compound—

Next, a melamine compound will be explained. The melamine compound used in the exemplary embodiment of the present invention is a compound having a melamine skeleton (structure), and particularly at least one of a compound represented by the following formula (B) and oligomers thereof is desirable. Here, the oligomer is an oligomer obtained by polymerizing the compound represented by formula (B) as a structural unit, and the degree of polymerization is, for example, from 2 to 200 (desirably from 2 to 100). Meanwhile, the compound represented by the formula (B) or an oligomer thereof may be used individually, or two or more kinds may be used in combination. The compound represented by the formula (B) or an oligomer may also be used in combination with the compound represented by the formula (A) or an oligomer thereof. Particularly, when a mixture of two or more kinds of the compound represented by the formula (B) is used, or an oligomer having the compound as a structural unit is used, the solubility in solvents is enhanced.

(B)

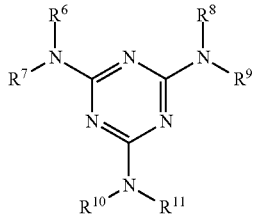

In the formula (B), $R^6$ to $R^{11}$ each independently represent a hydrogen atom, —$CH_2$—OH, or —$CH_2$—O—$R^{12}$; and $R^{12}$ represents an alkyl group having from 1 to 5 carbon atoms which may be branched. Examples of the alkyl group include a methyl group, an ethyl group and a butyl group.

The compound represented by the formula (B) is synthesized by, for example, a known method using melamine and formaldehyde (for example, in the same manner as the case of melamine resins described in Lectures on Experimental Chemistry, $4^{th}$ Edition, vol. 28, p. 430).

Specific examples of the compound represented by the formula (B) are shown below, but the compound of formula (B) is not intended to be limited to these. Furthermore, the specific examples given below show monomers, but oligomers having these monomers as structural units may also be used.

(B)-1

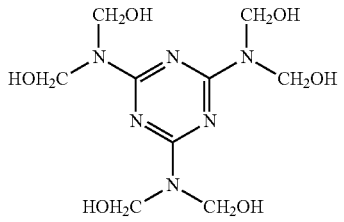

(B)-2

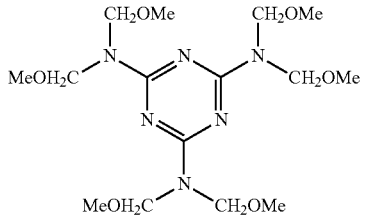

(B)-3

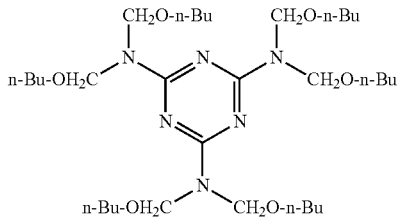

(B)-4

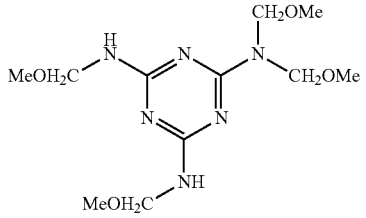

-continued (B)-5

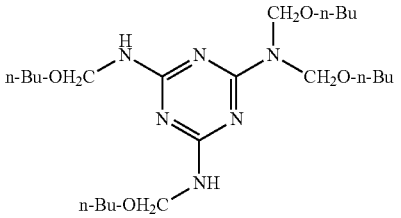

(B)-6

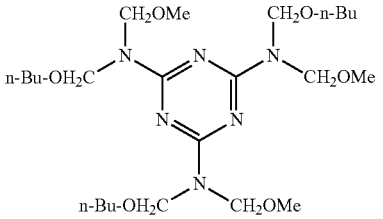

(B)-7

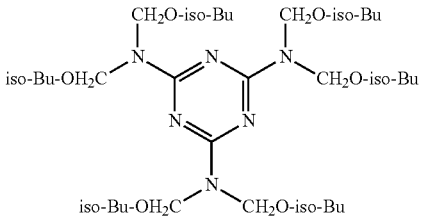

Examples of commercially available products of the compound represented by the formula (B) include SUPER MELAMI (R) No. 90 (manufactured by NOF Corp.), SUPER BECKAMINE(R) TD-139-60 manufactured by DIC Corporation; U-VAN 2020 (manufactured by Mitsui Chemicals, Inc.); SUMITEX RESIN M-3 (manufactured by Sumitomo Chemical Co., Ltd.); and NIKALAC MW-30 manufactured by Nippon Carbide Industries Co., Inc.

Furthermore, after the synthesis or the purchase of commercially available products, the compound represented by the formula (B) (including oligomers) may be dissolved in an appropriate solvent such as toluene, xylene or ethyl acetate, in order to eliminate the effect of residual catalyst, and washed with distilled water, ion exchanged water or the like, or the residual catalyst may be eliminated by treating the compound with an ion exchange resin.

—Charge Transporting Material—

Next, the charge transporting material will be explained. Examples of the charge transporting material contained in the surface protective layer include charge transporting materials having at least one substituent selected from —OH, —$OCH_3$, —$NH_2$, —SH and —COOH. Particularly, examples of the charge transporting material include those having at least two (or three) substituents selected from —OH, —$OCH_3$, —$NH_2$, —SH and —COOH. As such, when the number of reactive functional groups (relevant substituents) increases in the charge transporting material, the crosslinking density increases, a crosslinked film having higher strength is obtained, and thus abrasion of the electrophotographic photoreceptor is suppressed.

The charge transporting material is desirably a compound represented by the following formula (I):

$$F—((—R_1—X)_{n1}(R_2)_{n2}-T)_{n3} \quad (I)$$

In the formula (I), F represents an organic group derived from a compound having a hole transport ability; $R_1$ and $R_2$ each independently represent a linear or branched alkylene group having from 1 to 5 carbon atoms; n1 represents 0 or 1; n2 represents 0 or 1; n3 represents an integer from 1 to 4; X represents an oxygen atom, NH, or a sulfur atom; and Y represents —OH, —$OCH_3$, —$NH_2$, —SH, or —COOH.

In the formula (I), the compound having a hole transport ability in the organic group derived from a compound having a hole transport ability represented by F, may be an arylamine derivative. Examples of the arylamine derivative include a triphenylamine derivative and a tetraphenylbenzidine derivative.

The compound represented by the formula (I) is desirably a compound represented by the following formula (II). The compound represented by the formula (II) has particularly excellent charge mobility and excellent stability to (II)

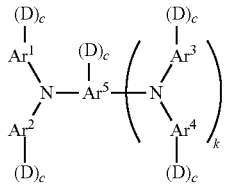

oxidation.

In the formula (II), $Ar^1$ to $Ar^4$, which may be identical or different, each independently represent a substituted or unsubstituted aryl group; $Ar^5$ represents a substituted or unsubstituted aryl group or a substituted or unsubstituted arylene group; D represents —(—$R_1$—X)$_{n1}$ ($R_2$)$_{n2}$—Y; c's each independently represent 0 or 1; k represents 0 or 1; the total number of D's is from 1 to 4; $R_1$ and $R_2$ each independently represent a linear or branched alkylene group having from 1 to 5 carbon atoms; n1 represents 0 or 1; n2 represents 0 or 1; X represents an oxygen atom, NH or a sulfur atom; and Y represents —OH, —$OCH_3$, —$NH_2$, —SH, or —COOH.

In the formula (II), the group "—(—$R_1$—X)$_{n1}$($R_2$)$_{n2}$—Y" represented by D is the same as the group "—(—$R_1$—X)$_{n1}$ ($R_2$)$_{n2}$—Y" in formula (I); and $R_1$ and $R_2$ each independently represent a linear or branched alkylene group from 1 to 5 carbon atoms. Furthermore, n1 is desirably 1. Also, n2 is desirably 1. X is desirably an oxygen atom, and Y is desirably a hydroxyl group.

Meanwhile, the total number of D's in the formula (II) corresponds to n3 in the formula (I), and is desirably from 2 to 4, and more desirably from 3 to 4. That is, in the formula (I) or formula (II), when the total number of D's is adjusted to desirably from 2 to 4 in one molecule, and more desirably from 3 to 4, the crosslinking density increases, and a crosslinked film having higher strength may be obtained. Particularly, the running torque of the electrophotographic photoreceptor occurring when a cleaning blade is used is decreased, so that the damage to the blade or abrasion of the electrophotographic photoreceptor is suppressed. The details are not clearly known, but it is speculated that when the number of reactive functional groups increases, a cured film having a higher crosslinking density is obtained, and the molecular movement at the outermost surface of the electrophotographic photoreceptor is suppressed, so that the interaction between the molecules of the outermost surface and the molecules of the blade member surface is weakened.

In the formula (II), it is desirable that $Ar^1$ to $Ar^4$ each be any one of groups represented by the following formulas (1) to (7). Meanwhile, in the following formulas (1) to (7), the groups "$-(D)_{C1}$" to "$-(D)_{C4}$" that may be respectively linked to $Ar^1$ to $Ar^4$ will be collectively indicated as "$-(D)_C$".

(1)

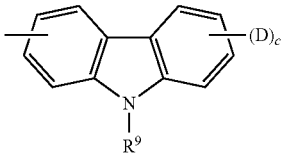

(2)

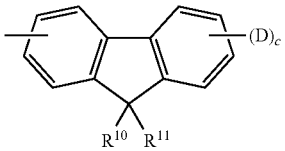

(3)

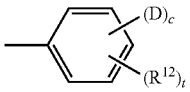

(4)

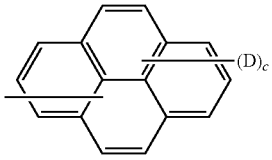

(5)

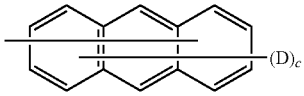

(6)

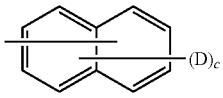

(7)

In the formulas (1) to (7), $R^9$ represents any one selected from the group including a hydrogen atom, an alkyl group having from 1 to 4 carbon atoms, a phenyl group substituted with an alkyl group having from 1 to 4 carbon atoms or an alkoxy group having from 1 to 4 carbon atoms, an unsubstituted phenyl group, and an aralkyl group having from 7 to 10 carbon atoms; $R^{10}$ to $R^{12}$ each represent any one selected from the group including a hydrogen atom, an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, and a halogen atom; Ar represents a substituted or unsubstituted arylene group; D and c have the same meanings as defined for "D" and "c" in the formula (II); represents 0 or 1; and t represents an integer from 1 to 3.

Ar in the formula (7) is desirably a group represented by the following formula (8) or (9).

(8)

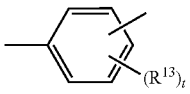

-continued (9)

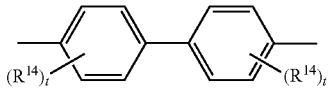

In the formulas (8) and (9), $R^{13}$ and $R'^4$ each represent any one selected from the group including a hydrogen atom, an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, and a halogen atom; and t represents an integer from 1 to 3.

Furthermore, Z' in the formula (7) is desirably a group represented by any one of the following formulas (10) to (17).

(10)

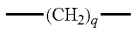

(11)

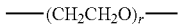

(12)

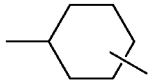

(13)

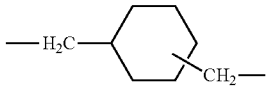

(14)

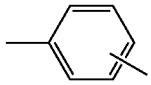

(15)

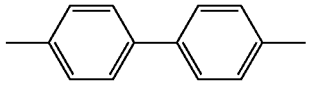

(16)

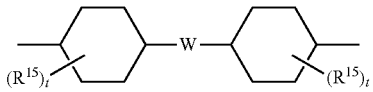

(17)

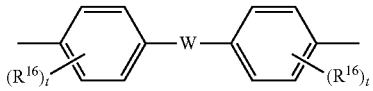

In the formulas (10) to (17), $R^{15}$ and $R^{16}$ each represent any one selected from the group including a hydrogen atom, an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, and a halogen atom; W represents a divalent group; q and r each represent an integer from 1 to 10; and t represents an integer from 1 to 3.

W in the formulas (16) to (17) is desirably any one of the divalent groups represented by the following formulas (18) to (26). However, in the formula (25), u represents an integer from 0 to 3.

(18) $-CH_2-$

(19) $-C(CH_3)_2-$

(20) $-O-$

(21) $-S-$

(22) $-C(CF_3)_2-$

(23) $-Si(CH_3)_2-$ (24)

(25)

(26)

Furthermore, in the formula (II), when k is 0, $Ar^5$ represents an aryl group of the formulas (1) to (7) mentioned in relation to $Ar^1$ to $Ar^4$, and when k is 1, $Ar^5$ is an arylene group obtained by excluding a predetermined hydrogen atom from the aryl group of the formulas (1) to (7).

Specific examples of the compound represented by the formula (I) include compounds of the following formulas (1-1) to (1-34). However, the compound represented by the formula (I) is not intended to be limited to these.

I-1

I-2

-continued

I-3

I-4

I-5

I-6

I-7

-continued
I-8
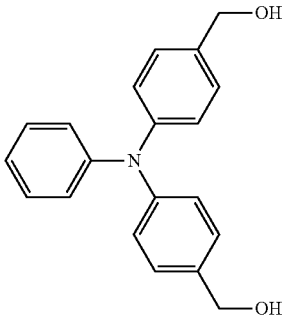
I-9
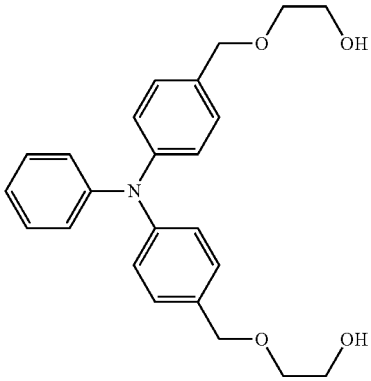
I-10
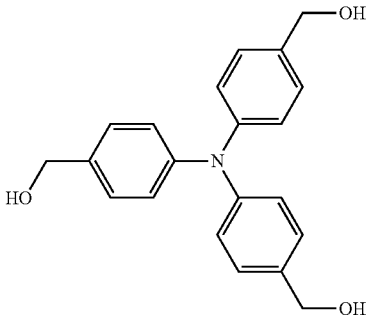
I-11
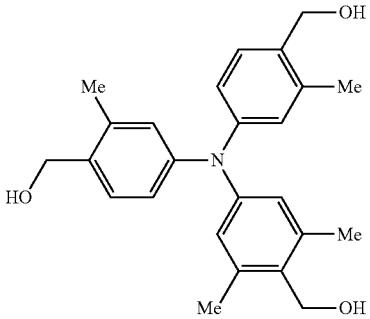
-continued
I-12
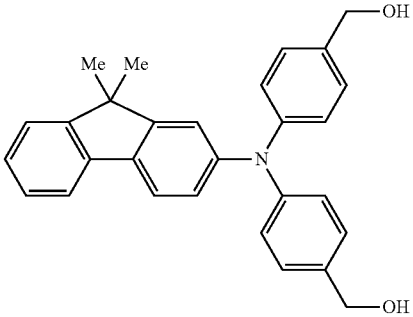
I-13
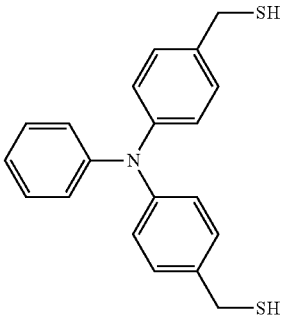
I-14
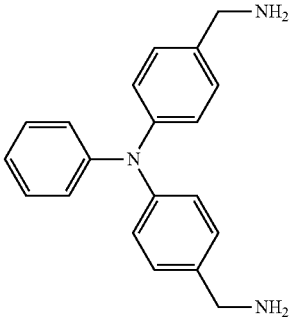
I-15
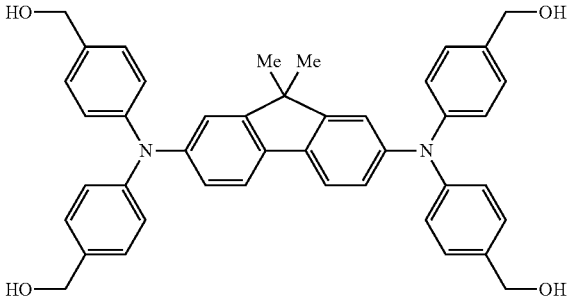
I-16
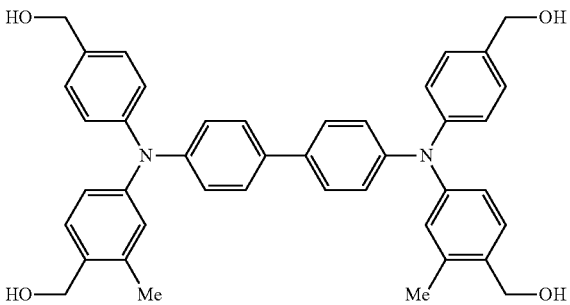

-continued
I-17
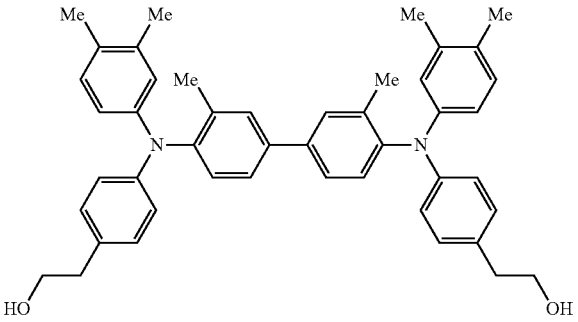
I-18
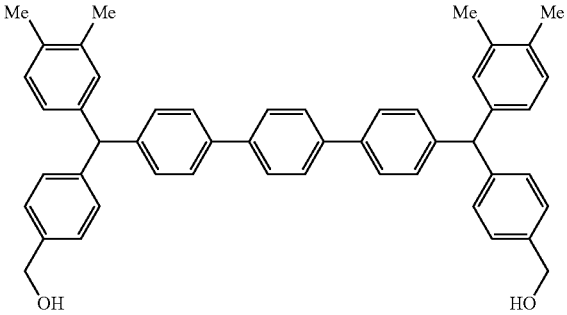
I-19
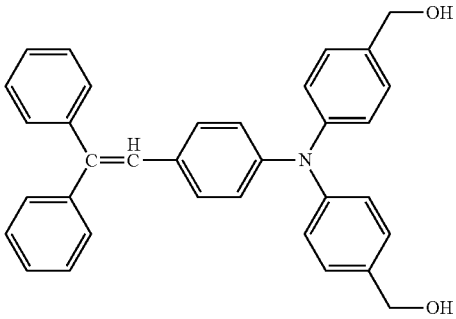
I-20
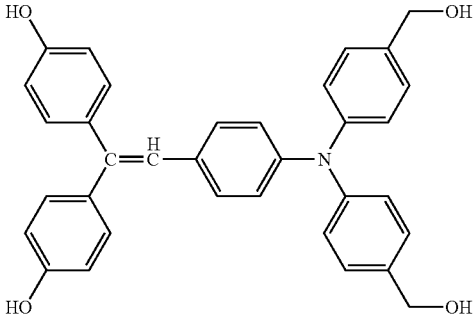
-continued
I-21
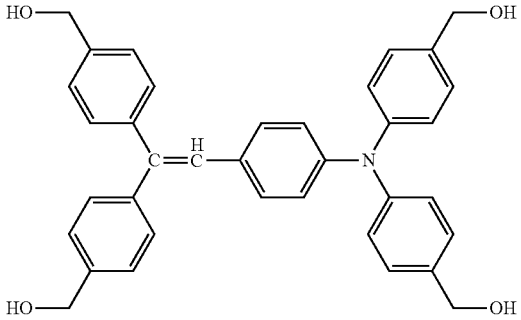
I-22
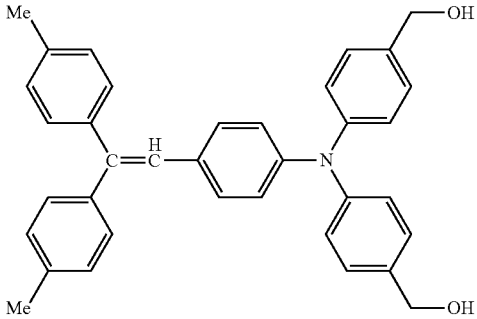
I-23
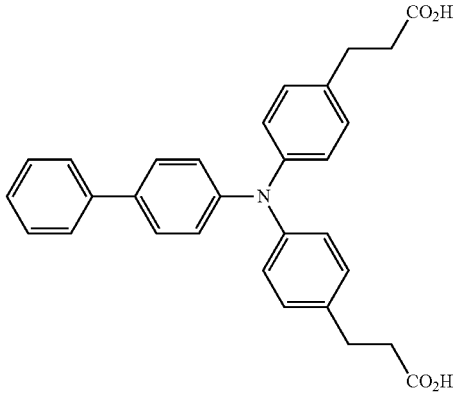
I-24
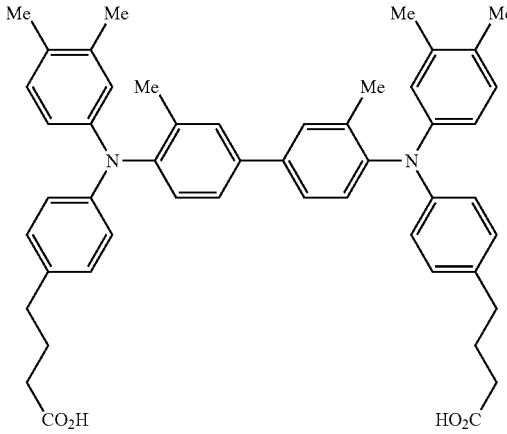

-continued
I-25
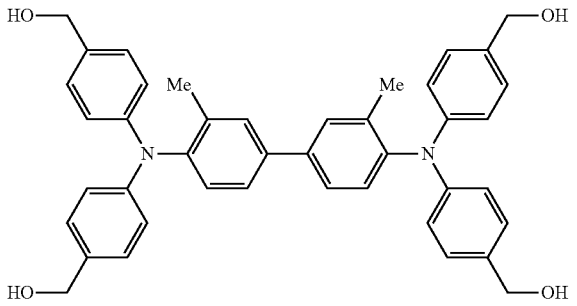
I-26
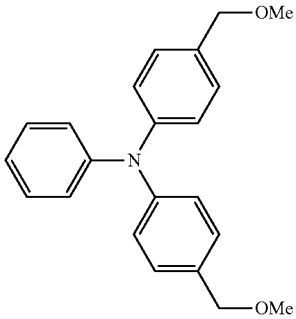
I-27
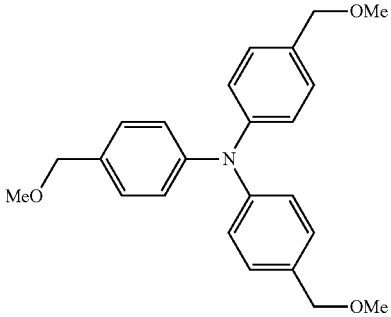
I-28
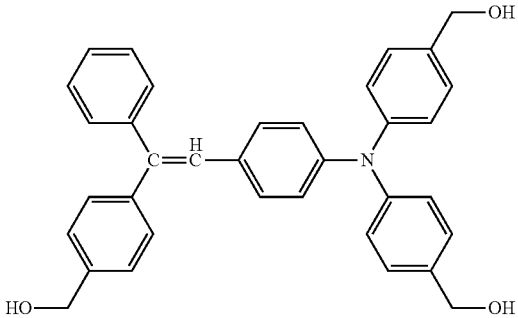
I-29
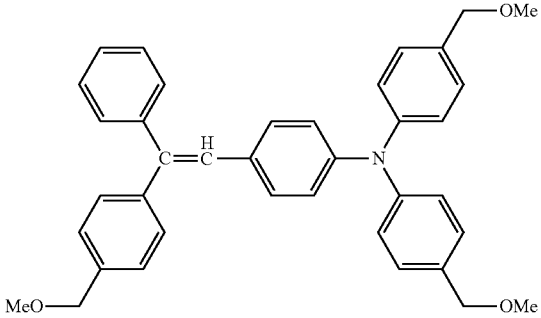
-continued
I-30
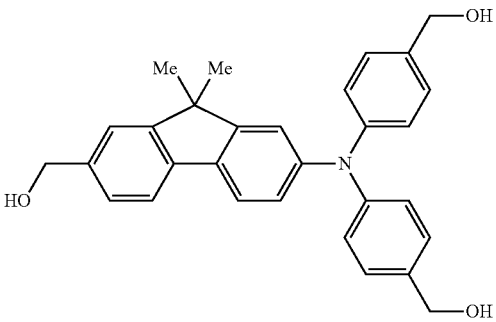
I-31
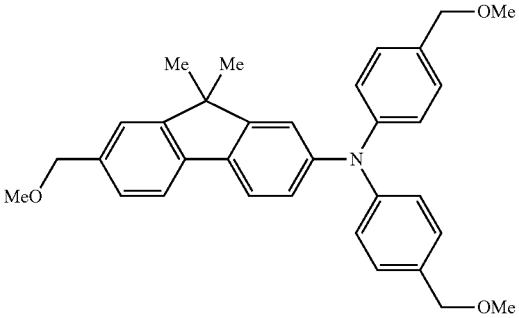
I-32
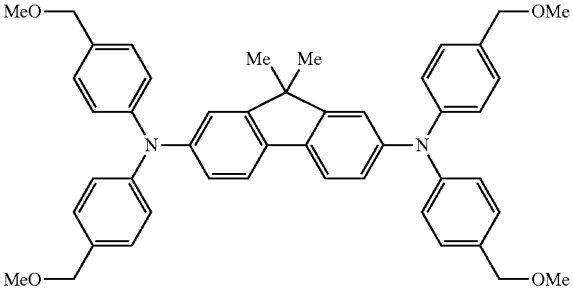
I-33
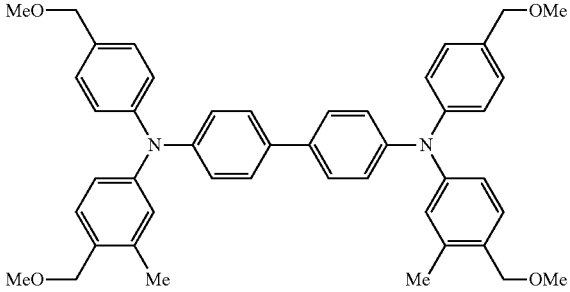

-continued

I-34

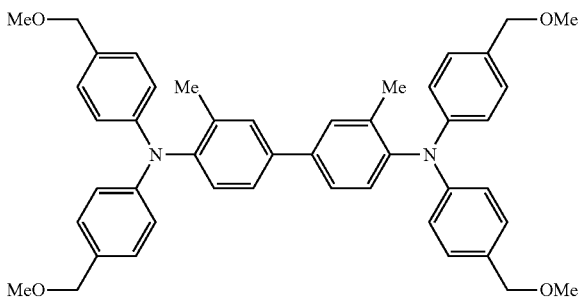

The surface protective layer of the photoreceptor in the exemplary embodiment of the present invention desirably contains a charge transporting substance having an alkoxy group and a charge transporting substance having a hydroxyl group as the charge transporting material, from the viewpoints of abrasion resistance, image quality characteristics, and electrical characteristics. Hereinafter, the charge transporting substance having an alkoxy group and the charge transporting substance having a hydroxyl group may be collectively referred to as "specific charge transporting materials".

The total content of the guanamine compound and the melamine compound in the surface protective layer 5 is from 0.1% by weight to 20% by weight (or from about 0.1% by weight to about 20% by weight) relative to the total solids content of the outermost surface layer excluding the fluororesin particles and the fluorinated alkyl group-containing copolymer, and the content of the structure derived from the charge transporting substance having an alkoxy group relative to the total solids content of the outermost surface layer excluding the fluororesin particles and the fluorinated alkyl group-containing copolymer is desirably from 10% by weight to 40% by weight (or from about 10% by weight to about 40% by weight).

When the total content of the guanamine compound (for example, a compound represented by the formula (A)) and the melamine compound (for example, a compound represented by the formula (B)) is in the range described above, a compact film is formed, and abrasion resistance is enhanced, as compared with the case where the total content is less than the range described above. Also, electrical characteristics and ghost resistance are enhanced as compared with the case where the total content is outside the range described above.

Furthermore, when the content of the structure derived from the charge transporting substance having an alkoxy group is in the range described above, deterioration of the electrical characteristics is suppressed as compared with the case where the content is less than the range described above, and also, the resistance in the case where electrical or mechanical stress is exerted to the photoreceptor from the outside of the photoreceptor, is increased.

In the surface protective layer 5, the total content of the charge transporting material or the total content of the guanamine compound and melamine compound is controlled by adjusting the solids concentration of these compounds in the coating liquid for forming the surface protective layer.

—Other Components—

In the surface protective layer 5, a phenolic resin, a melamine resin, a urea resin, an alkyd resin and the like may be used as a mixture with the crosslinked product of at least one selected from a guanamine compound (for example, a compound represented by the formula (A)) and a melamine compound (for example, a compound represented by the formula (B)), and the charge transporting material (for example, a compound represented by the formula (I)). Furthermore, in order to increase the strength, it is also effective to copolymerize a compound having more functional groups in one molecule, such as a spiroacetal-based guanamine resin (for example, "CTU-GUANAMINE" (Ajinomoto Fine-Techno Co., Inc.)) with the materials in the crosslinked product.

In the surface protective layer 5, for the purpose of effectively suppressing the oxidation due to a gas produced by discharge so as to prevent excessive adsorption of the gas produced by discharge, other thermosetting resins such as a phenolic resin, a melamine resin, and a benzoguanamine resin may be incorporated.

Furthermore, it is desirable to add a surfactant to the surface protective layer 5, and the surfactant used therein is not particularly limited as long as it is a surfactant containing at least one kind of a fluorine atom, an alkylene oxide structure and a silicone structure. However, when the surfactant has a plural number of the structures, the affinity and compatibility with the charge transporting organic compound is high, and the film-forming properties of the coating liquid for forming a surface protective layer are enhanced. Thus, wrinkles and unevenness of the surface protective layer 5 are suppressed.

Various surfactants having fluorine atoms are available. Specific examples of a surfactant having fluorine atoms and an acrylic structure include POLYFLOW KL600 (manufactured by Kyoeisha Chemical Co., Ltd.), EFTOP EF-351, EF-352, EF-801, EF-802, and EF-601 (all manufactured by JEMCO, Inc.). Examples of surfactants having an acrylic structure include those produced by polymerizing or copolymerizing a monomer such as an acrylic compound or a methacrylic compound.

Furthermore, examples of the surfactant having fluorine atoms include surfactants having a perfluorinated alkyl group, and more specific examples include perfluoroalkylsulfonic acids (for example, perfluorobutanesulfonic acid, and perfluorooctanesulfonic acid); perfluoroalkylcarboxylic acids (for example, perfluorobutanecarboxylic acid and perfluorooctanecarboxylic acid), and perfluorinated alkyl group-containing phosphoric acid esters. Perfluoroalkylsulfonic acids and perfluoroalkylcarboxylic acids may also be in the form of salts and amide modification products.

Examples of commercially available products of perfluoroalkylsulfonic acids include MEGAFAC F-114 (manufactured by DIC Corporation); EFTOP EF-101, EF-102, EF-103, EF-104, EF-105, EF-112, EF-121, EF-122A, EF-122B, EF-122C, EF-123A (all manufactured by JEMCO, Inc.); A-K, and 501 (all manufactured by Neos Co., Ltd.).

Examples of commercially available products of perfluoroalkylcarboxylic acids include MEGAFAC F-410 (DIC Corporation); EFTOP EF-201, and EF-204 (all manufactured by JEMCO, Inc.).

Examples of commercially available products of perfluorinated alkyl group-containing phosphoric acid ester include MEGAFAC F-493, F-494 (all manufactured by DIC Corporation); EFTOP EF-123A, EF-12313, EF-125M, and EF-132 (manufactured by JEMCO, Inc.).

Examples of the surfactant having an alkylene oxide structure include polyethylene glycol, polyether defoaming agents, and polyether-modified silicone oils.

As the polyethylene glycol, a polyethylene glycol having a number average molecular weight of 2000 or less is desirable, and examples of the polyethylene glycol having a number average molecular weight of 2000 or less include polyethylene glycol 2000 (number average molecular weight of 2000), polyethylene glycol 600 (number average molecular weight of 600), polyethylene glycol 400 (number average molecular weight of 400), and polyethylene glycol 200 (number average molecular weight of 200).

Furthermore, examples of the polyether defoaming agent include PE-M, PE-L (all manufactured by Wako Pure Chemical Industries, Ltd.), DEFOAMER No. 1 and DEFOAMER No. 5 (all manufactured by Kao Corp.).

Examples of the surfactant having a silicone structure include general silicone oils such as dimethylsilicone, methylphenylsilicone, diphenylsilicone, and derivatives thereof.

Furthermore, examples of a surfactant having both fluorine atoms and an alkylene oxide structure include surfactants having an alkylene oxide structure or a polyalkylene structure in a side chain; and surfactants in which the terminals of an alkylene oxide or polyalkylene oxide structure have been substituted with a substituent containing fluorine. Specific examples of the surfactant having an alkylene oxide structure include MEGAFAC F-443, F-444, F-445, F-446 (all manufactured by DIC Corporation); POLY FOX PF636, PF6320, PF6520, and PF656 (all manufactured by Kitamura Chemicals Co., Ltd.).

Furthermore, examples of a surfactant having both an alkylene oxide structure and a silicone structure include KF351 (A), KF352(A), KF353(A), KF354(A), KF355(A), KF615 (A), KF618, KF945(A), KF6004 (all manufactured by Shin-Etsu Chemical Co., Ltd.); TSF4440, TSF4445, TSF4450, TSF4446, TSF4452, TSF4453, TSF4460 (all manufactured by GE Toshiba Silicones Co., Ltd.); BYK-300, 302, 306, 307, 310, 315, 320, 322, 323, 325, 330, 331, 333, 337, 341, 344, 345, 346, 347, 348, 370, 375, 377, 378, UV3500, UV3510, and UV3570 (all manufactured by BYK Chemie GmbH).

The content of the surfactant is desirably from 0.01% by weight to 1% by weight, and more desirably from 0.02% by weight to 0.5% by weight, relative to the solids content excluding the fluororesin particles or the fluorinated alkyl group-containing copolymer of the surface protective layer 5. When the content of the surfactant having fluorine atoms is adjusted to 0.01% by weight or more, the effect of preventing coating film defects such as wrinkles and unevenness tends to be enhanced. Furthermore, when the content of the surfactant having fluorine atoms is adjusted to 1% by weight or less, separation of the surfactant having fluorine atoms and the cured resin becomes difficult, and thus the strength of the cured product thus obtained tends to be retained.

The surface protective layer 5 may further contain other coupling agents and fluorine compounds, for the purpose of adjusting the film-forming properties, flexibility, lubricating properties, and adhesiveness of the film. Various silane coupling agents and commercially available silicone-based hard coating agents are used.

Examples of the silane coupling agents that may be used include vinyltrichlorosilane, vinyltrimethoxysilane, vinyltriethoxysilane, γ-glycidoxypropylmethyldiethoxysilane, γ-glycidoxypropyltrimethoxysilane, γ-aminopropyltriethoxysilane, γ-aminopropyltrimethoxysilane, γ-aminopropylmethyldimethoxysilane, N-β-(aminoethyl)-γ-aminopropyltriethoxysilane, tetramethoxysilane, methyltrimethoxysilane, and dimethyldimethoxysilane. As the commercially available hard coating agents, KP-85, X-40-9740, X-8239 (all manufactured by Shin-Etsu Silicones Co., Ltd.); AY42-440, AY42-441, and AY49-208 (all manufactured by Dow Corning Toray Silicone Co., Ltd.) may be used.

Furthermore, in order to impart water repellency or the like, fluorine-containing compounds such as (tridecafluoro-1,1,2,2-tetrahydrooctyl)triethoxysilane, (3,3,3-trifluoropropyl)trimethoxysilane, 3-(heptafluoroisopropoxy)propyltriethoxysilane, 1H,1H,2H,2H-perfluoroalkyltriethoxysilane, 1H,1H,2H,2H-perfluorodecyltriethoxysilane, and 1H,1H,2H,2H-perfluorooctyltriethoxysilane may also be added. The silane coupling agent may be used in any amount, but the amount of the fluorine-containing compound is desirably set to 0.25 time or less the weight of the compounds that do not contain fluorine, from the viewpoint of the film-forming properties of the crosslinked film.

Furthermore, for the purpose of controlling the resistance to discharge gas, mechanical strength, scratch resistance, particle dispersibility and viscosity of the surface protective layer 5, reducing torque, controlling the amount of abrasion, extending the pot life, and the like, a resin that is soluble in alcohol may also be added.

Here, the resin that is soluble in alcohol means a resin that is dissolved in an amount of 1% by weight or more in an alcohol having 5 or fewer carbon atoms. Examples of the resin that is soluble in alcohol-based solvents include polyvinyl acetal resins such as a polyvinyl butyral resin, a polyvinylformal resin, and a partially acetalized polyvinyl acetal resin in which a part of butyral has been modified with formal, acetoacetal or the like (for example, S-LEC B and S-LEC K manufactured by Sekisui Chemical Co., Ltd.); a polyamide resin, a cellulose resin, and a polyvinylphenol resin. Particularly, from the viewpoint of electrical characteristics, a polyvinylacetal resin and polyvinylphenol resin are desirable.

The weight average molecular weight of the resin is desirably from 2,000 to 100,000, and more desirably from 5,000 to 50,000. If the molecular weight of the resin is less than 2,000, the effect of adding a resin tends to be insufficiently obtained. Also, if the molecular weight exceeds 100,000, the solubility decreases so that the amount of addition is limited, and thereby failure of film formation at the time of coating tends to occur.

Furthermore, the amount of the resin added is desirably from 1% by weight to 40% by weight, more desirably from 1% by weight to 30% by weight, and even more desirably from 5% by weight to 20% by weight, relative to the weight of the surface protective layer excluding the fluororesin particles or the fluorinated alkyl group-containing copolymer. If the amount of resin added is less than 1% by weight, the effect of adding the resin tends to be insufficiently obtained, and if the amount of resin added is greater than 40% by weight, image blur is likely to occur in a high temperature, high humidity environment (for example, 28° C., 85% RH).

It is desirable to add an antioxidant to the surface protective layer 5 for the purpose of preventing deterioration due to an oxidizing gas such as ozone that is generated in a charging apparatus. When the photoreceptor acquires a long service life by increasing the mechanical strength of the photoreceptor surface, the photoreceptor is brought into contact with the oxidizing gas for a long time period, and therefore, oxidation resistance is demanded. The antioxidant is desirably a hindered phenol-based antioxidant or a hindered amine-based antioxidant, and known antioxidants such as organic sulfur-based antioxidants, phosphite-based antioxidants, dithiocarbamic acid salt-based antioxidants, thiourea-based antioxidants, and benzimidazole-based antioxidants may also be used.

The amount of the antioxidant added is desirably 20% by weight or less, and more desirably 10% by weight or less, relative to the weight of the surface protective layer excluding the fluororesin particles and the fluorinated alkyl group-containing copolymer.

Examples of the hindered phenol-based antioxidants include 2,6-di-t-butyl-4-methylphenol, 2,5-di-t-butylhydroquinone, N,N'-hexamethylenebis(3,5-di-t-butyl-4-hydroxyhydrocinnamide), 3,5-di-t-butyl-4-hydroxy-benzylphosphonate-diethyl ester, 2,4-bis[(octylthio)methyl]-o-cresol, 2,6-di-t-butyl-4-ethylphenol, 2,2'-methylenebis(4-methyl-6-t-butylphenol), 2,2'-methylenebis(4-ethyl-6-t-butylphenol), 4,4'-butylidenebis(3-methyl-6-t-butylphenol), 2,5-di-t-amylhydroquinone, 2-t-butyl-6-(3-butyl-2-hydroxy-5-methylbenzyl)-4-methylphenyl acrylate, and 4,4'-butylidenebis(3-methyl-6-t-butylphenyl).

Furthermore, examples of commercially available products of the hindered phenol-based antioxidants include "IRGANOX 1076", "IRGANOX 1010", "IRGANOX 1098", "IRGANOX 245", "IRGANOX 1330", "IRGANOX 3114", "IRGANOX 1076", and "3,5-di-t-butyl-4-hydroxybiphenyl". Examples of hindered amine-based antioxidants include "SANOL LS2626", "SANOL LS765", "SANOL LS770", "SANOL LS744", "TINUVIN 144", "TINUVIN 622LD", "MARK LA57", "MARK LA67", "MARK LA62", "MARK LA68", and "MARK LA63", and examples of thioether-based antioxidants include "SUMILIZER TPS" and "SUMILIZER TP-D". Examples of phosphite-based antioxidants include "MARK 2112", "MARK PEP-8", "MARK PEP-24 G" "MARK PEP-36", "MARK 329K", and "MARK HP-10".

Furthermore, for the purpose of decreasing the residual potential or for the purpose of enhancing the strength, various particles may also be added to the surface protective layer 5. An example of the particles is silicon-containing particles. Silicon-containing particles are particles containing silicon as a constituent element, and specific examples include colloidal silica and silicone particles.

Colloidal silica that is used as the silicon-containing particles is selected from products in which silica having an average particle diameter of from 1 nm to 100 nm, and desirably from 10 nm to 30 nm, is dispersed in an organic solvent such as an acidic or alkaline aqueous dispersion, an alcohol, a ketone, or an ester, and generally marketed products may also be used.

The solids content of the colloidal silica in the surface protective layer 5 is not particularly limited, but in view of the film-forming properties, electrical characteristics and strength, the solids content of the colloidal silica is used in an amount in the range of from 0.1% by weight to 50% by weight, and desirably from 0.1% by weight to 30% by weight, relative to the solids content of the surface protective layer 5 excluding the fluororesin particles or the fluorinated alkyl group-containing copolymer.

The silicone particles used as the silicon-containing particles are selected from silicone resin particles, silicone rubber particles, and silicone-surface treated silica particles, and generally marketed products may be used. These silicone particles are spherical, and the average particle diameter is desirably from 1 nm to 500 nm, and more desirably from 10 nm to 100 nm. The silicone particles are small-sized particles that are chemically inert and have excellent dispersibility in resins, and since the content required to obtain satisfactory characteristics is low, the surface properties of the electrophotographic photoreceptor are improved without inhibiting the crosslinking reaction. That is, while the rigid crosslinked structure is subject to less fluctuation, the lubricating properties and water repellency of the surface of the electrophotographic photoreceptor are enhanced, and satisfactory abrasion resistance and fouling resistance are maintained for a long time period.

The content of the silicone particles in the protective layer 5 is desirably from 0.1% by weight to 30% by weight, and more desirably from 0.5% by weight to 10% by weight, relative to the solids content of the protective layer 5 excluding the fluororesin particles or the fluorinated alkyl group-containing copolymer.

Examples of other particles include semiconductive metal oxides such as $ZnO—Al_2O_3$, $SnO_2—Sb_2O_3$, $In_2O_3—SnO_2$, $ZnO_2—TiO_2$, $ZnO—TiO_2$, $MgO—Al_2O_3$, $FeO—TiO_2$, $TiO_2$, $SnO_2$, $In_2O_3$, ZnO, and MgO.

Furthermore, oil such as silicone oil may also be added for the same purpose. Examples of the silicone oil include silicone oils such as dimethyl polysiloxane, diphenyl polysiloxane, and phenylmethylsiloxane; reactive silicone oils such as amino-modified polysiloxane, epoxy-modified polysiloxane, carboxyl-modified polysiloxane, carbinol-modified polysiloxane, methacryl-modified polysiloxane, mercapto-modified polysiloxane, and phenol-modified polysiloxane; cyclic dimethylcyclosiloxanes such as hexamethylcyclotrisiloxane, octamethylcyclotetrasiloxane, decamethylcyclopentasiloxane, and dodecamethylcyclohexasiloxane; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane, and 1,3,5,7,9-pentamethyl-1,3,5,7,9-pentaphenylcyclopentasiloxane; cyclic phenylcyclosiloxanes such as hexaphenylcyclotrisiloxane; fluorine-containing cyclosiloxanes such as (3,3,3-trifluoropropyl)methylcyclotrisiloxane; hydrosilyl group-containing cyclosiloxanes such as methylhydrosiloxane mixtures, pentamethylcyclopentasiloxane, and phenylhydrocyclosiloxane; and vinyl group-containing cyclosiloxanes such as pentavinylpentamethylcyclopentasiloxane.

Furthermore, conductive particles of metals, metal oxides, carbon black and the like may also be added to the surface protective layer 5. Examples of the metals include aluminum, zinc, copper, chromium, nickel, silver, and stainless steel, and plastic particles having these metals deposited on the surface. Examples of the metal oxides include zinc oxide, titanium oxide, tin oxide, antimony oxide, indium oxide, bismuth oxide, tin-doped indium oxide, antimony or tantalum-doped tin oxide, and antimony-doped zirconium oxide. These may be used individually, or two or more kinds may be used in combination. When two or more kinds are used in combination, the particles may be simply mixed, or may be processed into a solid solution or a fused form.

The average particle diameter of the conductive particles is desirably 0.3 μm or less, and particularly desirably 0.1 μm or less, from the viewpoint of transparency.

In the surface protective layer 5, a curing catalyst may be used so as to accelerate curing of the guanamine compound (for example, a compound represented by the formula (A)) and the melamine compound (for example, a compound represented by the formula (B)) or the charge transporting material. As the curing catalyst, it is desirable to use an acid-based catalyst. Examples of the acid-based catalyst include aliphatic carboxylic acids such as acetic acid, chloroacetic acid, trichloroacetic acid, trifluoroacetic acid, oxalic acid, maleic acid, malonic acid, and lactic acid; aromatic carboxylic acids such as benzoic acid, phthalic acid, terephthalic acid, and trimellitic acid; and aliphatic and aromatic sulfonic acids such as methanesulfonic acid, dodecylsulfonic acid, benzenesulfonic acid, dodecylbenzenesulfonic acid, and naphthalenesulfonic acid. However, it is desirable to use sulfur-containing materials.

When a sulfur-containing material is used as a curing catalyst, this sulfur-containing material exhibits an excellent function as a curing catalyst for the guanamine compound (for example, a compound represented by the formula (A)) and the melamine compound (for example, a compound represented by the formula (B)), or the charge transporting material. Thus, the mechanical strength of the surface protective layer 5 obtainable by accelerating the curing reaction is further increased.

Furthermore, in the case of using a compound represented by the formula (I) (including formula (II)) described above as the charge transporting material, the sulfur-containing material also exhibits an excellent function as a dopant for these charge transporting materials, and the electrical characteristics of the functional layer thus obtained are further enhanced. As a result, when an electrophotographic photoreceptor is formed, all of the mechanical strength, film-forming properties and electrical characteristics are obtained at high levels.

It is desirable that the sulfur-containing material as a curing catalyst exhibit acidity at normal temperature (for example, 25° C.) or after heating, and from the viewpoints of adhesiveness, ghosting, and electrical characteristics, at least one of organic sulfonic acids and derivatives thereof is particularly desirable. The presence of such a catalyst in the protective layer 5 is easily confirmed by XPS or the like.

Examples of the organic sulfonic acids and/or derivatives thereof include para-toluenesulfonic acid, dinonylnaphthalenesulfonic acid (DNNSA), dinonylnaphthalenedisulfonic acid (DNNDSA), dodecylbenzenesulfonic acid, and phenosulfonic acid. Among these, from the viewpoints of catalytic capacity and film-forming properties, para-toluenesulfonic acid, and dodecylbenzenesulfonic acid are desirable. Furthermore, an organic sulfonic acid salt may also be used as long as the salt may be dissociated to a certain extent in the curable resin composition.

Furthermore, when a so-called thermal latent catalyst, which has an increased catalytic power when subjected to a temperature equal to or higher than a certain temperature, is used, since the catalytic capacity is low at a liquid storage temperature while the catalytic capacity is increased at the time of curing, a good balance is achieved between the storage stability and a decrease in the curing temperature.

Examples of the thermal latent catalyst include microcapsules in which an organic sulfone compound or the like is encapsulated with a polymer in a particulate form; a porous compound such as zeolite adsorbed with an acid; a thermal latent protic acid catalyst in which a protic acid and/or a protic acid derivative is blocked with a base; a protic acid and/or a protic acid derivative that has been esterified with a primary or secondary alcohol; a protic acid and/or a protic acid derivative that has been blocked with a vinyl ether and/or a vinyl thioether; a monoethylamine complex of boron trifluoride; and a pyridine complex of boron trifluoride.

Among them, a protic acid and/or a protic acid derivative that has been blocked with a base is desirable from the viewpoints of the catalytic capacity, storage stability, availability and cost.

Examples of the protic acid of the thermal latent protic acid catalyst include sulfuric acid, hydrochloric acid, acetic acid, formic acid, nitric acid, phosphoric acid, sulfonic acid, monocarboxylic acids, polycarboxylic acids, propionic acid, oxalic acid, benzoic acid, acrylic acid, methacrylic acid, itaconic acid, phthalic acid, maleic acid, benzenesulfonic acid, o-, m-, p-toluenesulfonic acid, styrenesulfonic acid, dinonylnaphthalenesulfonic acid, dinonylnaphthalenedisulfonic acid, decylbenzenesulfonic acid, undecylbenzenesulfonic acid, tridecylbenzenesulfonic acid, tetradecylbenzenesulfonic acid, and dodecylbenzenesulfonic acid. Examples of the protic acid derivative include neutralization products such as alkali metal salts or alkaline earth metal salts of protic acids such as sulfonic acid and phosphoric acid; and polymer compounds having a protic acid skeleton introduced into the polymer chain (polyvinylsulfonic acid and the like). Examples of the base that blocks a protic acid include amines. The amines are classified into primary, secondary and tertiary amines. There are no particular limitations, and any amine may be used.

Examples of the primary amines include methylamine, ethylamine, propylamine, isopropylamine, n-butylamine, isobutylamine, t-butylamine, hexylamine, 2-ethylhexylamine, sec-butylamine, allylamine, and methylhexylamine.

Examples of the secondary amines include dimethylamine, diethylamine, di-n-propylamine, diisopropylamine, di-n-butylamine, diisobutylamine, di-t-butylamine, dihexylamine, di(2-ethylhexyl)amine, N-isopropyl-N-isobutylamine, di(2-ethylhexyl)amine, di-sec-butylamine, diallylamine, N-methylhexylamine, 3-pipecoline, 4-pipecoline, 2,4-lupetidine, 2,6-lupetidine, 3,5-lupetidine, morpholine, and N-methylbenzylamine.

Examples of the tertiary amines include trimethylamine, triethylamine, tri-n-propylamine, triisopropylamine, tri-n-butylamine, triisobutylamine, tri-t-butylamine, trihexylamine, tri(2-ethylhexyl)amine, N-methylmorpholine, N,N-dimethylallylamine, N-methyldiallylamine, triallylamine, N,N-dimethylallylamine, N,N,N',N'-tetramethyl-1,2-diaminoethane, N,N,N',N'-tetramethyl-1,3-diaminopropane, N,N,N',N'-tetraallyl-1,4-diaminobutane, N-methylpiperidine, pyridine, 4-ethylpyridine, N-propyldiallylamine, 3-dimethylaminopropanol, 2-ethylpyrazine, 2,3-dimethylpyrazine, 2,5-dimethylpyrazine, 2,4-lutidine, 2,5-lutidine, 3,4-lutidine, 3,5-lutidine, 2,4,6-colidine, 2-methyl-4-ethylpyridine, 2-methyl-5-ethylpyridine, N,N,N',N'-tetramethylhexamethylenediamine, N-ethyl-3-hydroxypiperidine, 3-methyl-4-ethylpyridine, 3-ethyl-4-methylpyridine, 4-(5-nonyl)pyridine, imidazole, and N-methylpiperazine.

Commercially available products include "NACURE 2501" (toluenesulfonic acid dissociation, methanol/isopropanol solvent, from pH 6.0 to pH 7.2, dissociation temperature 80° C.) "NACURE 2107" (p-toluenesulfonic acid dissociation, isopropanol solvent, from pH 8.0 to pH 9.0, dissociation temperature 90° C.), "NACURE 2500" (p-toluenesulfonic acid dissociation, isopropanol solvent, from pH 6.0 to pH 7.0, dissociation temperature 65° C.), "NACURE 2530" (p-toluenesulfonic acid dissociation, methanol/isopropanol solvent, from pH 5.7 to pH 6.5, dissociation temperature 65° C.), "NACURE 2547" (p-toluenesulfonic acid dissociation, aqueous solution, from pH 8.0 to pH 9.0, dissociation temperature 107° C.), "NACURE 2558" (p-toluenesulfonic acid dissociation, ethylene glycol solvent, from pH 3.5 to pH 4.5, dissociation temperature 80° C.), "NACURE XP-357" (p-toluenesulfonic acid dissociation, methanol solvent, from pH 2.0 to pH 4.0, dissociation temperature 65° C.), "NACURE XP-386" (p-toluenesulfonic acid dissociation, aqueous solution, from pH 6.1 to pH 6.4, dissociation temperature 80° C.), "NACURE XC-2211" (p-toluenesulfonic acid dissociation, from pH 7.2 to pH 8.5, dissociation temperature 80° C.), "NACURE 5225" (dodecylbenzenesulfonic acid dissociation, isopropanol solvent, from pH 6.0 to pH 7.0, dissociation temperature 120° C.), "NACURE 5414" (dodecylbenzenesulfonic acid dissociation, xylene solvent, dissociation temperature 120° C.), "NACURE 5528" (dodecylbenzenesulfonic acid dissociation, isopropanol solvent, from pH 7.0 to pH 8.0, dissociation temperature 120° C.), "NACURE 5925" (dodecylbenzenesulfonic acid dissociation, from pH 7.0 to pH 7.5, dissociation temperature 130° C.), "NACURE 1323" (dinonylnaphthalenesulfonic acid dissociation, xylene solvent, from pH 6.8 to pH 7.5, dissociation temperature 150° C.), "NACURE 1419" (dinonylnaphthalenesulfonic acid dissociation, xylene/methyl isobutyl ketone solvent, dissociation temperature 150°

C.), "NACURE 1557" (dinonylnaphthalenesulfonic acid dissociation, butanol/2-butoxyethanol solvent, from pH 6.5 to pH 7.5, dissociation temperature 150° C.), "NACURE X49-110" (dinonylnaphthalenedisulfonic acid dissociation, isobutanol/isopropanol solvent, from pH 6.5 to pH 7.5, dissociation temperature 90° C.), "NACURE 3525" (dinonylnaphthalenedisulfonic acid dissociation, isobutanol/isopropanol solvent, from pH 7.0 to pH 8.5, dissociation temperature 120° C.), "NACURE XP-383" (dinonylnaphthalenedisulfonic acid dissociation, xylene solvent, dissociation temperature 120° C.), "NACURE 3327" (dinonylnaphthalenedisulfonic acid dissociation, isobutanol/isopropanol solvent, from pH 6.5 to pH 7.5, dissociation temperature 150° C.), "NACURE 4167" (phosphoric acid dissociation, isopropanol/isobutanol solvent, from pH 6.8 to pH 7.3, dissociation temperature 80° C.), "NACURE XP-297" (phosphoric acid dissociation, water/isopropanol solvent, from pH 6.5 to pH 7.5, dissociation temperature 90° C.), and "NACURE 4575" (phosphoric acid dissociation, from pH 7.0 to pH 8.0, dissociation temperature 110° C.), all manufactured by King Industries, Inc.

These thermal latent catalysts may be used individually, or two or more kinds may be used in combination.

Here, the amount of incorporation of the catalyst is desirably in the range of from 0.1% by weight to 50% by weight, and particularly desirably from 10% by weight to 30% by weight, relative to the amount of at least one selected from the guanamine compound (for example, a compound represented by the formula (A)) and the melamine compound (for example, a compound represented by the formula (B)) (solids concentration in the coating liquid excluding the fluororesin particles or the fluorinated alkyl group-containing copolymer). When this amount of incorporation is less than the range described above, the catalytic activity may be too low, and when the amount exceeds the range described above, light-fastness may deteriorate. Meanwhile, light-fastness refers to the phenomenon in which when the photosensitive layer is exposed to light from an external source such as room light, the irradiated region undergoes a density decrease. The cause is not clearly known, but it is speculated that, as disclosed in JP-A-5-099737, a phenomenon such as a photo memory effect is occurring.

—Formation of Surface Protective Layer—

The surface protective layer 5 having the above-described constitution is formed by using a coating liquid for surface protective layer formation which contains fluororesin particles and a fluorinated alkyl group-containing copolymer, and desirably contains at least one selected from a guanamine compound (a compound represented by the formula (A)) and a melamine compound (a compound represented by the formula (B)), and the specific charge transporting material described above. This coating liquid for surface protective layer formation may optionally include any other constituent components of the surface protective layer 5.

The preparation of the coating liquid for surface protective layer formation may be carried out in a solvent-free manner, or if necessary, may be carried out using a solvent such as an alcohol such as methanol, ethanol, propanol or butanol; a ketone such as acetone or methyl ethyl ketone; or an ether such as tetrahydrofuran, diethyl ether or dioxane. Such solvents may be used individually, or as mixtures of two or more kinds, but a desirable solvent is a solvent having a boiling point of 100° C. or lower. As the solvent, it is particularly desirable to use at least one or more solvents having a hydroxyl group (for example, alcohols).

The amount of solvent is arbitrarily set, but if the amount is too small, the guanamine compound (for example, a compound represented by the formula (A)) and the melamine compound (for example, a compound represented by the formula (B)) are likely to precipitate out. Therefore, the solvent is used in an amount of from 0.5 part by weight to 30 parts by weight, and desirably from 1 part by weight to 20 parts by weight, relative to 1 part by weight of at least one selected from the guanamine compound (for example, a compound represented by the formula (A)) and the melamine compound (for example, a compound represented by the formula (B)).

Furthermore, when a coating liquid is obtained by allowing the components to react, the components may be simply mixed and dissolved, but the mixture may be heated to a temperature ranging from room temperature (for example, 25° C.) to 100° C., desirably from 30° C. to 80° C., for a time ranging from 10 minutes to 100 hours, and desirably from 1 hour to 50 hours. Also, it is desirable to irradiate the mixture with ultrasonic waves at this time. Probably this causes a reaction to proceed partially, and thus a film having less fluctuation in the film thickness and having fewer film defects may be easily obtained.

Subsequently, the coating liquid for surface protective layer formation is applied on the charge transport layer 3 by a conventional method such as a blade coating method, a Meyer bar coating method, a spray coating method, a dip coating method, a bead coating method, an air knife coating method, or a curtain coating method, and then if necessary, the coating liquid is heated to a temperature of from 100° C. to 170° C. to cure. Thereby, the surface protective layer 5 is obtained.

The thickness of the surface protective layer 5 is desirably from 1 μm to 15 μm, and more desirably from 3 μm to 10 μm. When the thickness of the surface protective layer 5 is 1 μm or larger, a longer service life may be easily obtained, and when the thickness is 15 μm or less, satisfactory electrical characteristics may be easily obtained.

<Conductive Substrate>

Examples of the conductive substrate 4 include metal plates constructed by using metals such as aluminum, copper, zinc, stainless steel, chromium, nickel, molybdenum, vanadium, indium, gold and platinum, or alloys; metal drums and metal belts; and paper, plastic films and belts on which a conductive compound such as a conductive polymer or indium oxide, or a metal such as aluminum, palladium or gold, or an alloy is applied, deposited or laminated. Here, the term "conductive" means that the volume resistivity is less than $10^{13}$ Ωcm.

When the electrophotographic photoreceptor is used in a laser printer, in order to prevent interference fringes that occur when laser light is irradiated, the surface of the conductive substrate 4 is desirably roughened to a mid-line average roughness Ra of from 0.04 μm to 0.5 μm. When Ra is less than 0.04 μm, the surface becomes close to a mirror surface, and therefore, the interference preventive effect tends to be insufficiently obtained. When Ra is greater than 0.5 μm, the image quality tends to be rough even if a coating film is formed. Meanwhile, when a non-interfering light is used as a light source, roughening for the prevention of interference fringes is not particularly necessary, and since the occurrence of defects due to surface unevenness of the conductive substrate 4 may be prevented, it is appropriate for lengthening of the service life.

As the method for surface roughening, wet honing of suspending a polishing agent in water and spraying the suspension on the surface of conductive substrate 4; centerless grinding of pressing the conductive substrate 4 against a rotating grindstone and continuously performing grinding processing; an anodization treatment; and the like are desirable.

Furthermore, as another method of surface roughening, a method of dispersing a conductive or semiconductive powder in a resin, forming a layer on the surface of the support that constitutes the conductive substrate 4, and thereby roughening the surface by the particles dispersed in the layer, without directly roughening the surface of the conductive substrate 4, is also desirably used.

Here, the surface roughening treatment through anodization involves using aluminum as an anode, subjecting the anode to anodic oxidation in an electrolyte solution, and thereby forming an oxide film on the aluminum surface. Examples of the electrolyte solution include a sulfuric acid solution and an oxalic acid solution. However, a porous anodic oxide film formed by anodic oxidation is chemically active in the state as received, is susceptible to contamination, and is subject to a large fluctuation of resistance due to the environment. Thus, it is desirable to perform a pore blocking treatment of plugging the fine pores of the anodic oxide film by volume expansion due to a hydration reaction in pressurized steam or in boiling water (a metal salt of nickel or the like may also be added), and converting the anodic oxide film to a hydrated oxide which is more stable.

The thickness of the anodic oxide film is desirably from 0.3 μm to 15 μm. When this thickness is less than 0.3 μm, the effect of attenuating the barrier properties against injection tends to be insufficiently obtained. On the other hand, when the thickness is larger than 15 μm, an increase in the residual potential due to repeated use tends to occur.

Furthermore, the conductive substrate 4 may be subjected to a treatment with an acidic aqueous solution or a boehmite treatment.

An example of the treatment with an acidic aqueous solution is a treatment using an acidic treatment liquid containing phosphoric acid, chromic acid and hydrofluoric acid. The treatment using an acidic treatment liquid containing phosphoric acid, chromic acid and hydrofluoric acid is carried out as follows. First, an acidic treatment liquid is prepared. The mixing proportions of phosphoric acid, chromic acid and hydrofluoric acid in the acidic treatment liquid are such that the proportion of phosphoric acid is in the range of from 10% by weight to 11% by weight, the proportion of chromic acid is in the range of from 3% by weight to 5% by weight, and the proportion of hydrofluoric acid is in the range of from 0.5% by weight to 2% by weight. The overall concentration of these acids is desirably in the range of from 13.5% by weight to 18% by weight. The treatment temperature is desirably from 42° C. to 48° C., but when a high treatment temperature is maintained, a thicker film is formed more quickly as compared with the case where the temperature is lower than the range of the treatment temperature. The thickness of the coating film is desirably from 0.3 μm to 15 μm. When the thickness is less than 0.3 μm, the effect of attenuating the barrier properties against injection tends to be insufficiently obtained. On the other hand, when the thickness is larger than 15 μm, an increase in the residual potential due to repeated use tends to occur.

The boehmite treatment is carried out by immersing the conductive substrate in pure water at a temperature of from 90° C. to 100° C. for a time of from 5 minutes to 60 minutes, or by bringing the conductive substrate into contact with heated water vapor at a temperature of from 90° C. to 120° C. for a time of from 5 minutes to 60 minutes. The thickness of the coating film is desirably from 0.1 μm to 5 μm. This may be further subjected to an anodization treatment using an electrolyte solution containing adipic acid, boric acid, borate, phosphate, phthalate, maleate, benzoate, tartrate, citrate or the like, which have lower film dissolvability than other chemical species.

<Undercoat Layer>

The undercoat layer 1 is prepared by, for example, incorporating inorganic particles in a binder resin.

As the inorganic particles, particles having a powder resistance (volume resistivity) of from $10^2$ Ω·cm to $10^{11}$ Ω·cm are desirably used. This is because it is necessary for the undercoat layer 1 to have a resistance appropriate for acquiring leakage resistance and carrier blocking properties. Meanwhile, if the resistance value of the inorganic particles is lower than the lower limit of the range described above, sufficient leakage resistance cannot be obtained, and if the resistance value is higher than the upper limit of this range, there is a risk that the residual potential may be elevated.

Among them, it is desirable to use inorganic particles of tin oxide, titanium oxide, zinc oxide, zirconium oxide and the like (conductive metal oxides) as the inorganic particles having the resistance value described above, and it is particularly desirable to use zinc oxide.

The inorganic particles may be particles that have been surface treated, or mixtures of two or more kinds of particles having different surface treatments, or different particle diameters may also be used.

The volume average particle diameter of the inorganic particles is desirably in the range of from 50 nm to 2000 nm (more desirably from 60 nm to 1000 nm).

Furthermore, inorganic particles having a specific surface area of 10 $m^2/g$ or larger according to the BET method are desirably used. Particles having a specific surface area of smaller than 10 $m^2/g$ are likely to cause deteriorated chargeability, and satisfactory electrophotographic characteristics may not be easily obtained.

Furthermore, when an acceptor compound is incorporated together with the inorganic particles, an undercoat layer which is excellent in the long-term stability of the electrical characteristics and in the carrier blocking properties may be obtained.

The acceptor compound may be any compound as long as desired characteristics may be obtained, but electron transporting substances such as quinone compounds such as chloranil and bromanil; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone compounds; thiophene compounds; and diphenoquinone compounds such as 3,3',5,5'-tetra-t-butyldiphenoquinone are desirable, while compounds having an anthraquinone structure are particularly desirable. Furthermore, hydroxyanthraquinone compounds, aminoanthraquinone compounds, aminohydroxyanthraquinone compounds, and acceptor compounds having an anthraquinone structure are desirably used. Specific examples include anthraquinone, alizarin, quinazarin, anthrarufin, and purpurin.

The content of these acceptor compounds may be arbitrarily set as long as the content is in the range capable of obtaining desired characteristics, but the acceptor compound is desirably incorporated in an amount of from 0.01% by weight to 20% by weight with respect to the inorganic particles. Furthermore, from the viewpoint of preventing charge accumulation and preventing aggregation of the inorganic particles, the content is desirably from 0.05% by weight to 10% by weight. The aggregation of the inorganic particles is likely to lead to fluctuation in the formation of conduction paths, maintenance characteristics such as an increase in the residual potential after a time of repeated use are likely to deteriorate, and also image quality defects such as black spots are likely to occur.

The acceptor compound may be added only at the time of applying the undercoat layer, or may be attached in advance to the inorganic particle surfaces. Methods for attaching the acceptor compound to the inorganic particle surfaces include dry methods and wet methods.

In the case of applying a surface treatment by a dry method, while the inorganic particles are stirred with a mixer having a large shear force or the like, an acceptor compound itself or an acceptor compound dissolved in an organic solvent is added dropwise, and the mixture is sprayed together with dry air or nitrogen gas. Thereby, the inorganic particles are treated without having fluctuations. When the compound is added or sprayed, it is desirable to carry out the process at a temperature equal to or lower than the boiling point of the solvent. When spraying is carried out at a temperature equal to or higher than the boiling point of the solvent, the solvent evaporates before the mixture is stirred without having fluctuations, and the acceptor compound is locally hardened, so that a treatment without fluctuation cannot be achieved, which is not desirable. After the addition or spraying, the inorganic particles may be further baked at or above 100° C. Baking is carried out at any temperature and time ranges capable of obtaining the desired electrophotographic characteristics.

In a wet method, the organic particles are dispersed in a solvent using stirring, ultrasonication, a sand mill, an attritor, a ball mill or the like, an acceptor compound is added thereto and stirred or dispersed, and then the solvent is removed. Thereby, the treatment is achieved without having fluctuations. The solvent is removed by filtering, or is distilled off. After the removal of the solvent, the inorganic particles may be further baked at a temperature of equal to or higher than 100° C. Baking is carried out at any temperature and time ranges capable of obtaining desired electrophotographic characteristics. In a wet method, removal of the water contained in the inorganic particles is also carried out before a surface treating agent is added, and for example, a method of removing water while stirring and heating the inorganic particles in the solvent used for the surface treatment, or a method of removing water by azeotropically boiling water with the solvent may be used.

Furthermore, the inorganic particles may be surface treated before the acceptor compound is applied. The surface treating agent may be any agent capable of obtaining desired characteristics, and is selected from known materials. Examples include a silane coupling agent, a titanate-based coupling agent, an aluminum-based coupling agent, and a surfactant. Particularly, a silane coupling agent is used desirably in order to impart satisfactory electrophotographic characteristics. Furthermore, a silane coupling agent having an amino group is desirably used to impart satisfactory blocking properties to the undercoat layer 1.

As the silane coupling agent having an amino group, any agent capable of obtaining desired electrophotographic photoreceptor characteristics may be used, and specific examples include, but are not limited to, γ-aminopropyltriethoxysilane, N-β-(aminoethyl)-γ-aminopropyltrimethoxysilane, N-β-(aminoethyl)-γ-aminopropylmethyldimethoxysilane, and N,N-bis(β-hydroxyethyl)-γ-aminopropyltriethoxysilane.

Two or more silane coupling agents may be used as a mixture. Examples of the silane coupling agent which may be used in combination with the silane coupling agent having an amino group include, but are not limited to, vinyltrimethoxysilane, γ-methacryloxypropyltris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane.

The method for surface treating using these surface treating agents may be any method as long as it is a known method, but it is desirable to use a dry method or a wet method. Furthermore, application of an acceptor compound and a surface treatment using a coupling agent or the like may be carried out together.

The amount of the silane coupling agent with respect to the inorganic particles in the undercoat layer 1 may be any amount capable of obtaining desired electrophotographic characteristics, but from the viewpoint of enhancing dispersibility, the amount is desirably from 0.5% by weight to 10% by weight based on the inorganic particles.

As the binder resin that is included in the undercoat layer 1, any known resin capable of forming a satisfactory film and capable of obtaining desired characteristics may be used, but examples that may be used include known polymeric resin compounds such as an acetal resin such as polyvinyl butyral, a polyvinyl alcohol resin, casein, a polyimide resin, a cellulose resin, gelatin, a polyurethane resin, a polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a phenolic resin, a phenol-formaldehyde resin, a melamine resin, and a urethane resin; a charge transporting resin having a charge transporting group; and a conductive resin such as polyaniline. Among them, a resin that is insoluble in the coating liquid solvent of the upper layer is desirably used, and particularly, a phenolic resin, a phenol-formaldehyde resin, a melamine resin, a urethane resin, an epoxy resin and the like are desirably used. When these are used in combination of two or more kinds, the mixing proportions are set as necessary.

The ratio of the inorganic particles to which an acceptor compound has been attached on the surface (a metal oxide imparted with acceptor properties) and the binder resin, or the ratio of the inorganic particles and the binder resin in the coating liquid for undercoat layer formation is arbitrarily set in the range capable of obtaining desired electrophotographic photoreceptor characteristics.

In the undercoat layer 1, various additives may be used for the purpose of enhancing electrical characteristics, enhancing the environmental stability, and enhancing the image quality. Examples of the additives that may be used include known materials such as electron transporting pigments such as polycyclic fused compounds and azo compounds; zirconium chelate compounds, titanium chelate compounds, aluminum chelate compounds, titanium alkoxide compounds, organic titanium compounds, and silane coupling agents. Silane coupling agents are used in the surface treatment of the inorganic particles such as described above, but may also be added to the coating liquid for undercoat layer formation as an additive.

Specific examples of the silane coupling agents as an additive include vinyltrimethoxysilane, γ-methacryloxypropyltris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane.

Furthermore, examples of the zirconium chelate compounds include zirconium butoxide, zirconium ethyl acetoacetate, zirconium triethanolamine, acetylacetonatozirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetra-n-butyl titanate, butyl titanate dimer, tetra(2-ethylhexyl)titanate, titanium acetylacetonate, polytitanium acetylacetonate, titanium octylene glycolate, titanium lactate ammonium salt, titanium lactate, titanium lactate ethyl ester, titanium triethanolaminate, and polyhydroxytitanium stearate.

Examples of the aluminum chelate compounds include aluminum isopropylate, monobutoxyaluminum diisopropylate, aluminum butyrate, ethyl acetoacetate aluminum diisopropylate, and aluminum tris(ethyl acetoacetate).

These compounds may be used individually, or as a mixture or a polycondensate of plural compounds.

The solvent for preparing the coating liquid for undercoat layer formation is arbitrarily selected from known organic solvents, for example, alcohol-based, aromatic-based, halogenated hydrocarbon-based, ketone-based, ketone alcohol-based, ether-based, and ester-based organic solvents. Examples of the solvent include conventional organic solvents such as methanol, ethanol, n-propanol, isopropanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Furthermore, these solvents may be used individually or as mixtures of two or more kinds. When the solvents are mixed, the solvent used in the mixture may be any solvent capable of dissolving the binder resin when used as a solvent mixture.

As the method for dispersing the inorganic particles when a coating liquid for undercoat layer formation is prepared, known methods of using a roll mill, a ball mill, a vibrating ball mill, an attritor, a sand mill, a colloid mill, or a paint shaker are used.

As the coating method used to prepare the undercoat layer 1, conventional methods such as a blade coating method, a wire bar coating method, a spray coating method, a dip coating method, a bead coating method, an air knife coating method, and a curtain coating method are used.

The undercoat layer 1 is formed on the conductive substrate by using the coating liquid for undercoat layer formation obtained in this manner.

Furthermore, it is desirable that the undercoat layer 1 have a Vickers hardness of 35 or higher.

Furthermore, the undercoat layer 1 is set to have any thickness as long as desired characteristics may be obtained, but the thickness is desirably 15 μm or greater, and more desirably from 15 μm to 50 μm.

When the thickness of the undercoat layer 1 is less than 15 μm, it is difficult to obtain sufficient leakage resistance performance, and when the thickness is 50 μm or greater, the residual potential is likely to remain after a long-term use, and therefore, there is a defect that an abnormal image density may be caused.

Furthermore, the surface roughness (10-point average roughness) of the undercoat layer 1 is adjusted to a value corresponding to ¼n (n represents the refractive index of the upper layer) of the wavelength λ of the laser light for exposure to ½λ, so as to prevent moire patterns.

Particles of a resin or the like may be added to the undercoat layer so as to adjust the surface roughness. Examples of the resin particles that may be used include silicone resin particles and crosslinked polymethyl methacrylate resin particles.

Here, the undercoat layer 1 is desirably a layer which contains a binder resin and a conductive metal oxide, and has a light transmittance to light having a wavelength of 950 nm at a thickness of 20 μm, of 40% or less (desirably from 10% to 35%, and more desirably from 15% to 30%). In an electrophotographic photoreceptor intended to achieve an increase in the service life, it is necessary to maintain stabilized high image quality. Even in the case of using a crosslinked outermost surface layer (protective layer), similar characteristics are demanded. When a crosslinked outermost surface layer (surface protective layer) is used, in many cases, an acid catalyst is used for curing. As the amount increases relative to the solids content in the outermost surface layer (surface protective layer), higher film strength is obtained, and print durability is increased. Therefore, an increase in the service life may be promoted.

On the other hand, because residual catalyst remaining in the bulk becomes the trap sites for charges, light fatigue resistance is decreased, and the residual catalyst causes image density unevenness due to light exposure at the time of maintenance or the like. This light-fastness (light fatigue resistance) is improved to a level where there is no problem in practical use, by optimizing the amount of the material (particularly, the charge transporting material, and acid catalyst); however, the light-fastness cannot be said to be sufficient against exposure at a high luminance for a long time, such as in the case of an environment brighter than ordinary offices, for example, irradiation at a place such as a showroom, or in the case of observing foreign substances adhering to the surface of the electrophotographic photoreceptor. In order to promote a further increase in the service life, it is necessary to increase the film strength by increasing the curing catalyst amount. However, in that case, it cannot be said that light-fastness becomes sufficient. Thus, by using an undercoat layer 1 having a predetermined light transmittance (that is, low light transmittance), the undercoat layer 1 absorbs the light incident to the electrophotographic photoreceptor, and thereby, images that have excellent light-fastness to light of strong intensity and are stable for a long time may be obtained. That is, since reflected light from the conductive substrate surface is reduced, light-fastness (light fatigue resistance) to light exposure at a high luminance and for a long time is acquired, and also, for example, even if print durability is enhanced by increasing the amount of curing catalyst and increasing the strength of the outermost surface layer (surface protective layer), an increase in the service life is realized.

Meanwhile, the light transmittance of the undercoat layer 1 is measured in the following manner. A coating liquid for undercoat layer formation is applied on a glass plate to obtain a thickness after drying of 20 μm, and is dried. Subsequently, the light transmittance of the film at a wavelength of 950 nm is measured using a spectrophotometer. The light transmittance obtained by a photometer is measured by using a spectrophotometer "Spectrophotometer (U-2000)", manufactured by Hitachi, Ltd.

The light transmittance of this undercoat layer 1 is controlled by adjusting the dispersion time at the time of dispersing the coating liquid using the roll mill, ball mill, vibrating ball mill, attritor, sand mill, colloid mill, paint shaker and the like described above. The dispersion time is not particularly limited, but any time from 5 minutes to 1000 hours is desirable, and any time from 30 minutes to 10 hours is more desirable. When the dispersion time is extended, the light transmittance tends to decrease.

Furthermore, the surface of the undercoat layer 1 may be polished in order to adjust the surface roughness. As the method for polishing, buff polishing, a sand blasting treatment, wet honing, a grinding treatment and the like are used.

The undercoat layer 1 is obtained by drying the coating liquid for undercoat layer formation described above that has been applied on the conductive substrate 4. Usually, drying is carried out at a temperature at which the solvent evaporates and film formation is achieved.

<Charge Generating Layer>

The charge generating layer 2 is a layer containing a charge generating material and a binder resin.

Examples of the charge generating material include azo pigments such as bisazo and trisazo; condensed ring aromatic pigments such as dibromoanthanthrone; perylene pigments, pyrrolopyrrole pigments, phthalocyanine pigments, zinc oxide, and trigonal selenium. Among these, for exposure to a laser light in the near-infrared region, metallic or metal-free phthalocyanine pigments are desirable, and particularly, hydroxygallium phthalocyanine disclosed in JP-A-5-263007, JP-A-5-279591 and the like; chlorogallium phthalocyanine disclosed in JP-A-5-98181 and the like; dichlorotin phthalocyanine disclosed in JP-A-5-140472, JP-A-5-140473 and the like; titanyl phthalocyanine disclosed in JP-A-4-189873, JP-A-5-43823 and the like are more desirable. Furthermore, for exposure to a laser light in the near-ultraviolet region, condensed ring aromatic pigments such as dibromoanthanthrone; thioindigo pigments, porphyrazine compounds, zinc oxide, trigonal selenium and the like are more desirable. As the charge generating material, inorganic pigments are desirable in the case of using a light source of an exposure light wavelength of from 380 nm to 500 nm, and metallic and metal-free phthalocyanine pigments are desirable in the case of using a light source of an exposure light wavelength of from 700 nm to 800 nm.

As the charge generating material, it is desirable to use a hydroxygallium phthalocyanine pigment having the maximum peak wavelength in the range of from 810 nm to 839 nm in the spectral absorption spectrum in the wavelength region of from 600 nm to 900 nm. This hydroxygallium phthalocyanine pigment is different from the conventional V-type hydroxygallium phthalocyanine pigments, and this pigment is desirable because superior dispersibility is obtained. As such, when the maximum peak wavelength of the spectral absorption spectrum is shifted to the shorter wavelength side than the conventional V-type hydroxygallium phthalocyanine pigments, a fine hydroxygallium phthalocyanine pigment with a controlled crystal arrangement of the pigment particles is obtained, and when the pigment is used as a material of the electrophotographic photoreceptor, excellent dispersibility, sufficient sensitivity, chargeability, and dark decay characteristics are obtained.

It is desirable that the hydroxygallium phthalocyanine pigment having the maximum peak wavelength in the range of from 810 nm to 839 nm have an average particle diameter in a specific range and a BET specific surface area in a specific range. Specifically, a desirable hydroxygallium phthalocyanine pigment has an average particle diameter of 0.20 μm or less, and more desirably from 0.01 μm to 0.15 μm, and has a BET specific surface area of 45 $m^2/g$ or greater, more desirably 50 $m^2/g$ or greater, and particularly desirably from 55 $m^2/g$ to 120 $m^2/g$. The average particle diameter is the volume average particle diameter (d50 average particle diameter) and is a value measured with a laser diffraction scattering type particle diameter analyzer (LA-700, manufactured by Horiba, Ltd.). Also, the BET specific surface area is a value measured by a nitrogen substitution method using a BET type specific surface area analyzer (manufactured by Shimadzu Corp.; FLOWSOAP II 2300).

When the average particle diameter is larger than 0.20 μm, or when the specific surface area is less than 45 $m^2/g$, the pigment particles are coarse, or aggregates of the pigment particles have been formed, so that when the pigment is used as a material for the electrophotographic photoreceptor, characteristics such as dispersibility, sensitivity, chargeability, and dark decay characteristics tend to become defective. Thereby, defects in the image quality are likely to occur.

Furthermore, the maximum particle diameter (maximum value of the primary particle diameter) of the hydroxygallium phthalocyanine pigment is desirably 1.2 μm or less, more desirably 1.0 μm or less, and even more desirably 0.3 μm or less. When such maximum particle diameter is greater than the range described above, fine black spots tend to occur.

Also, from the viewpoint of more reliably suppressing the density unevenness attributable to the exposure of the photoreceptor to a fluorescent lamp or the like, the hydroxygallium phthalocyanine pigment desirably has an average particle diameter of 0.2 μm or less, a maximum particle diameter of 1.2 μm or less, and a specific surface area value of 45 $m^2/g$ or greater.

The hydroxygallium phthalocyanine is also desirably a pigment having diffraction peaks at Brigg's angles ($2\theta \pm 0.2°$ of 7.5°, 9.9°, 12.5°, 16.3°, 18.6°, 25.1° and 28.3° in the X-ray diffraction spectrum obtained by using CuKα-characteristic X-rays.

In addition, the hydroxygallium phthalocyanine pigment desirably has a thermal weight loss of from 2.0% to 4.0%, and more desirably from 2.5% to 3.8% when the pigment is heated from 25° C. to 400° C. Meanwhile, the thermal weight loss is measured with a thermobalance or the like. When the thermal weight loss is greater than 4.0%, the impurities contained in the hydroxygallium phthalocyanine pigment affect the electrophotographic photoreceptor, and deterioration tends to occur in the sensitivity characteristics, stability of the potential upon repeated use, and the image quality. Furthermore, when the thermal weight loss is less than 2.0%, a decrease in the sensitivity tends to occur. It may be considered that this is attributable to the fact that the hydroxygallium phthalocyanine pigment exhibits sensitizing action as a result of the interaction with the solvent molecules included in a trace amount in the crystals.

When the hydroxygallium phthalocyanine pigment is used as the charge generating material for the electrophotographic photoreceptor, it is particularly effective from the viewpoint that the optimum sensitivity or excellent photoelectric characteristics of the photoreceptor may be obtained, and that since the pigment has excellent dispersibility in the binder resin contained in the photosensitive layer, the image quality characteristics are excellent.

Here, it is known that the initial occurrence of fogging or black spots is suppressed by defining the average particle diameter and the BET specific surface area of the hydroxygallium phthalocyanine pigment. However, there has been a problem that fogging or black spots occur as a result of long-term use. In this regard, when a predetermined outermost surface layer that will be described below (a protective layer formed from a crosslinked film using at least one selected from a guanamine compound and a melamine compound and a specific charge transporting material) is combined, the occurrence of fogging or black spots due to long-term use, which has been a problem in the conventional combination of the outermost surface layer and the charge generating layer, is suppressed. It can be speculated that this is because the film abrasion or the deterioration of charging ability occurring as a result of long-term use is suppressed by using the protective layer. Furthermore, even with regard to the thickness reduction of the charge transport layer that is effective in an improvement of electrical characteristics (a decrease in the residual potential), the suppression of fogging or black spots, which have occurred in conventional photoreceptors, is also realized.

The binder resin that is used in the charge generating layer 2 is selected from a wide variety of insulating resins, and may also be selected from organic photoconductive polymers such as poly-N-vinylcarbazole, polyvinylanthracene, polyvinylpyrene, and polysilane. Desirable binder resins include a polyvinyl butyral resin, a polyallylate resin (a polycondensate of a bisphenol and a divalent aromatic carboxylic acid, or the like), a polycarbonate resin, a polyester resin, a phenoxy resin, a vinyl chloride-vinyl acetate copolymer, a polyamide resin, an acrylic resin, a polyacrylamide resin, a polyvinylpyridine resin, a cellulose resin, a urethane resin, an epoxy resin, casein, a polyvinyl alcohol resin, and a polyvinylpyrrolidone resin. These binder resins may be used individually or as mixtures of two or more kinds. The mixing ratio of the charge generating material and the binder resin is desirably in the range of from 10:1 to 1:10 as a weight ratio. Here, the term "insulating" means that the volume resistivity is $10^{13}$ Ωcm or greater.

The charge generating layer 2 is formed by using a coating liquid in which the charge generating material and the binder resin are dispersed in a predetermined solvent.

Examples of the solvent used in the dispersion include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene, and these are used individually or as mixtures of two or more kinds.

Furthermore, as the method of dispersing the charge generating material and the binder resin in a solvent, conventional methods such as a ball mill dispersion method, an attritor dispersion method, and a sand mill dispersion method are used. When these dispersion methods are used, changes in the crystal form of the charge generating material due to dispersion are prevented. At the time of this dispersion, it is effective to maintain the average particle diameter of the charge generating material at 0.5 μm or less, desirably 0.3 μm or less, and more desirably 0.15 μm or less.

Furthermore, when the charge generating layer 2 is formed, conventional methods such as a blade coating method, a Meyer bar coating method, a spray coating method, a dip coating method, a bead coating method, an air knife coating method, and a curtain coating method are used.

The thickness of the charge generating layer 2 obtainable in this manner is desirably from 0.1 μm to 5.0 μm, and more desirably from 0.2 μm to 2.0 μm.

<Charge Transport Layer>

The charge transport layer 3 is formed by a charge transporting material and a binder resin being contained, or a polymeric charge transporting material being contained.

Examples of the charge transporting material include electron transporting compounds, such as quinone-based compounds such as p-benzoquinone, chloranil, bromanil and anthraquinone; tetracyanoquinodimethane-based compounds; fluorenone compounds such as 2,4,7-trinitrofluorenone; xanthone-based compounds; benzophenone-based compounds; cyanovinyl-based compounds; and ethylene-based compounds; and hole transporting compounds such as triarylamine-based compounds, benzidine-based compounds, arylalkane-based compounds, aryl-substituted ethylene-based compounds, stilbene-based compounds, anthracene-based compounds, and hydrazone-based compounds. These charge transporting materials are used individually, or as mixtures of two or more kinds, but the charge transporting materials are not limited to these.

As the charge transporting material, a triarylamine derivative represented by the following formula (a-1), and a benzidine derivative represented by the following formula (a-2) are desirable from the viewpoint of charge mobility.

(a-1)

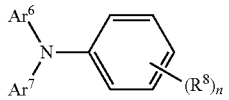

In the formula (a-1), $R^8$ represents a hydrogen atom or a methyl group; n represents 1 or 2; $Ar^6$ and $Ar^7$ each independently represent a substituted or unsubstituted aryl group, $—C_6H_4—C(R^9)=C(R^{10})(R^{11})$, or $—C_6H_4—CH=CH—CH=C(R^{12})(R^{13})$; and $R^9$ to $R^{13}$ each independently represent a hydrogen atom, a substituted or unsubstituted alkyl group, or a substituted or unsubstituted aryl group. Examples of the substituent include a halogen atom, an alkyl group having from 1 to 5 carbon atoms, an alkoxy group having from 1 to 5 carbon atoms, and a substituted amino group substituted with an alkyl group having from 1 to 3 carbon atoms.

(a-2)

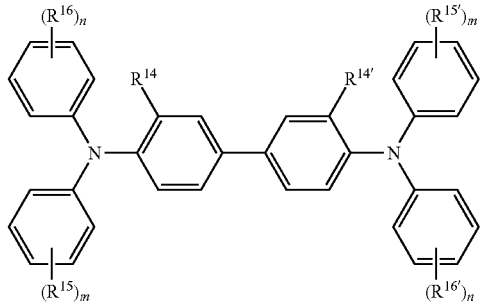

In the formula (a-2), $R^{14}$ and $R^{14'}$, which may be identical or different, each independently represent a hydrogen atom, a halogen atom, an alkyl group having from 1 to 5 carbon atoms, or an alkoxy group having from 1 to 5 carbon atoms. $R^{15}$, $R^{15'}$, $R^{16}$ and $R^{16'}$, which may be identical or different, each independently represent a hydrogen atom, a halogen atom, an alkyl group having from 1 to 5 carbon atoms, an alkoxy group having from 1 to 5 carbon atoms, an amino group substituted with an alkyl group having from 1 to 2 carbon atoms, substituted or unsubstituted aryl group, $—C(R^{17})=C(R^{18})(R^{19})$, or $—CH=CH—CH=C(R^{20})(R^{21})$ and $R^{17}$ to $R^{21}$ each independently represent a hydrogen atom, a substituted or unsubstituted alkyl group, or a substituted or unsubstituted aryl group. m and n each independently represent an integer from 0 to 2.

Here, among triarylamine derivatives represented by the formula (a-1) and benzidine derivatives represented by the formula (a-2), particularly, a triarylamine derivative having "—$C_6H_4$—CH=CH—CH=C($R^{12}$)($R^{13}$)" and a benzidine derivative having "—CH=CH—CH=C($R^{20}$)($R^{21}$)" are excellent from the viewpoints of the charge mobility, adhesiveness to the protective layer, the afterimages occurring as the remaining record of previous images (hereinafter, may be referred to as "ghost"), and are desirable.

Examples of the binder resin used in the charge transport layer 3 include a polycarbonate resin, a polyester resin, a polyallylate resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone alkyd resin, a phenol-formaldehyde resin, a styrene-alkyd resin, poly-N-vinylcarbazole, and polysilane. Furthermore, polymeric charge transporting materials such as the polyester-based polymeric charge transporting materials disclosed in JP-A-8-176293 and JP-A-8-208820 may also be used. These binder resins are used individually, or as mixtures of two or more kinds. The mixing ratio of the charge transporting material and the binder resin is desirably from 10:1 to 1:5.

Particularly, there are no particular limitations on the binder resin, but at least one of a polycarbonate resin having a viscosity average molecular weight of from 50,000 to 80,000, and a polyallylate resin having a viscosity average molecular weight of from 50,000 to 80,000 is desirable from the viewpoint that satisfactory film formation may be easily achieved.

Furthermore, a polymeric charge transporting material may also be used as the charge transporting material. As the polymeric charge transporting material, known materials having charge transportability, such as poly-N-vinylcarbazole and polysilane, are used. The polyester-based polymeric charge transporting materials disclosed in JP-A-8-176293 and JP-A-8-208820 have higher charge transportability as compared with other types, and are particularly desirable. The polymeric charge transporting materials may form films only by themselves, but film formation may also be carried out using mixtures of the polymeric charge transporting materials and binder resins.

The charge transport layer 3 is formed by using a coating liquid for charge transport layer formation containing the constituent materials described above. As the solvent used in the coating liquid for charge transport layer formation, conventional organic solvents, including aromatic hydrocarbons such as benzene, toluene, xylene and chlorobenzene; ketones such as acetone and 2-butanone; halogenated aliphatic hydrocarbons such as methylene chloride, chloroform and ethylene chloride; and cyclic or linear ethers such as tetrahydrofuran and ethyl ether, are used individually or as mixtures of two or more kinds. Also, as the method for dispersing the various constituent materials, known methods are used.

As the coating method used when a coating liquid for charge transport layer formation is applied on the charge generating layer 2, conventional methods such as a blade coating method, a Meyer bar coating method, a spray coating method, a dip coating method, a bead coating method, an air knife coating method, and a curtain coating method are used.

The thickness of the charge transport layer 3 is desirably from 5 μm to 50 μm, and more desirably from 10 μm to 30 μm.

Meanwhile, an example of the functionally separated type photosensitive layer carried by the electrophotographic photoreceptor 7A shown in FIG. 1 has been described above, but for example, the content of the charge generating material in the single layer type photosensitive layer 6 (charge generating/charge transport layer) carried by the electrophotographic photoreceptor 7C shown in FIG. 3 is about from 10% by weight to 85% by weight, and desirably from 20% by weight to 50% by weight. Furthermore, the content of the charge transporting material is desirably set to from 5% by weight to 50% by weight. The method for forming the single layer type photosensitive layer 6 (charge generating/charge transport layer) is the same as the method for forming the charge generating layer 2 or the charge transport layer 3. The thickness of the single layer type photosensitive layer (charge generating/charge transport layer) 6 is desirably about from 5 μm to 50 μm, and more desirably from 10 μm to 40 μm.

Meanwhile, in the various layers constituting the photosensitive layer in the electrophotographic photoreceptors 7A, 7B and 7C shown in FIG. 1 to FIG. 3, additives such as an antioxidant, a photostabilizer and a thermal stabilizer may also be added to the various layers constituting the photosensitive layer, for the purpose of preventing the deterioration of the photoreceptor caused by ozone or an oxidizing gas generated in the image forming apparatus, or by light or heat. Examples of the antioxidant include a hindered phenol, a hindered amine, para-phenylenediamine, an arylalkane, hydroquinone, spirochromane, spiroindanone, and derivatives thereof, organic sulfur compounds, and organic phosphorus compounds.

Examples of the photostabilizer include derivatives of benzophenone, benzotriazole, dithiocarbamate, tetramethylpiperidine and the like. Also, for the purposes of an enhancement of sensitivity, a reduction of residual potential, a reduction of fatigue at the time of repeated use, and the like, at least one electron-accepting substance is incorporated. Examples of the electron-accepting substance used include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, and phthalic acid. Among these, fluorenone-based and quinone-based electron-accepting substances, and benzene derivatives having electron-withdrawing substituents such as Cl—, CN— and $NO_2$— are particularly desirable.

Furthermore, when the surface protective layers 5 in the electrophotographic photoreceptors 7A, 7B and 7C shown in FIG. 1 to FIG. 3 are treated with an aqueous dispersion liquid containing a fluororesin as in the case of the blade member, it is desirable because a further torque reduction can be promoted, and also, an enhancement of transfer efficiency can be promoted.

Image Forming Apparatus/Process Cartridge

Figure 4:
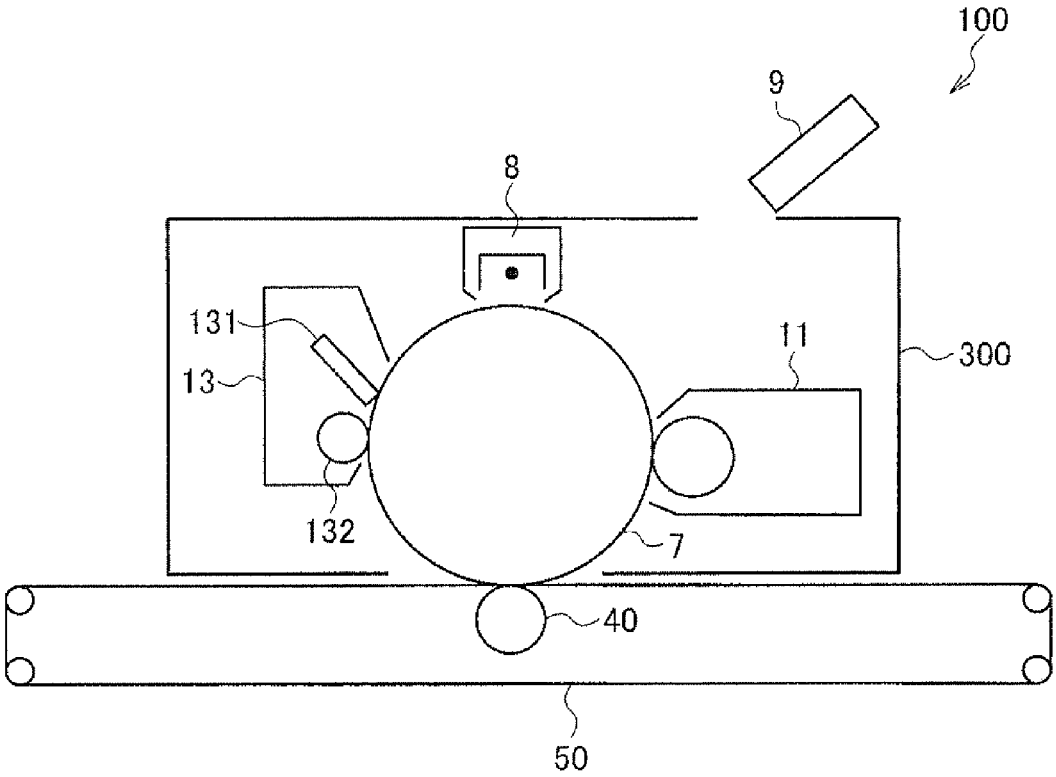
FIG. 4 is a schematic configuration diagram showing an example of the image forming apparatus according to the exemplary embodiment of the present invention.

FIG. 4 is a schematic configuration diagram showing an image forming apparatus related to the exemplary embodiment. The image forming apparatus 100 includes, as shown in FIG. 4, a process cartridge 300 including an electrophotographic photoreceptor 7, an exposure apparatus 9, a transfer apparatus 40, and an intermediate transfer member 50. Meanwhile, in the image forming apparatus 100, the exposure apparatus 9 is disposed at a position of exposing the electrophotographic photoreceptor 7 through the opening of the process cartridge 300, and the transfer apparatus 40 is disposed at a position opposite to the electrophotographic photoreceptor 7, with the intermediate transfer member 50 interposed therebetween. The intermediate transfer member 50 is disposed such that a part thereof is in contact with the electrophotographic photoreceptor 7.

The process cartridge 300 in FIG. 4 integrally supports an electrophotographic photoreceptor 7, a charging apparatus 8, a developing apparatus 11 and a cleaning apparatus 13 inside a housing. The cleaning apparatus 13 has a cleaning blade 131 (blade member), and the cleaning blade 131 is disposed to be in contact with the surface of the electrophotographic photoreceptor 7.

[Charging Unit]

As the charging apparatus 8, for example, chargers that are well known, such as a roller charger of a non-contact system, and a scorotron charger or a corotron charger utilizing corona discharge, are used. Furthermore, contact type chargers using a charging roller, a charging brush, a charging film, a charging rubber blade, a charging tube and the like, which are conductive or semiconductive, are also used. In the exemplary embodiment of the present invention, it is desirable to use a non-contact type charging unit that performs charging without being brought into contact with the photoreceptor, from the viewpoint of abrasion resistance or the high speed charging ability.

Meanwhile, although not shown in the diagram, a photoreceptor heating member which is intended to increase the temperature of the electrophotographic photoreceptor 7 and thereby decrease the relative temperature, may also be provided in the periphery of the electrophotographic photoreceptor 7, for the purpose of increasing the stability of images.

[Electrostatic Latent Image Forming Unit]

As the exposure apparatus 9 that becomes an electrostatic latent image forming unit, for example, an optical instrument that exposes the surface of the photoreceptor 7 imagewise to light such as a semiconductor laser light, an LED light or a liquid crystal shutter light, may be used. In regard to the wavelength of the light source, a wavelength that is in the spectral sensitivity region of the photoreceptor is used. As the wavelength of the semiconductor laser, near-infrared radiation having an emission wavelength near 780 nm is conventional. However, the wavelength is not limited to this wavelength, and a laser light having an emission wavelength in the range of 600 nm, or a laser light having an emission wavelength in the vicinity of from 400 nm to 450 nm as blue laser light may also be used. Furthermore, for the formation of color images, surface emission type laser light sources of a type capable of multi-beam output are also effective.

[Developing Unit]

As the developing apparatus 11, for example, development may be carried out by using a general developing apparatus which performs development by bringing a magnetic or non-magnetic single-component developer or two-component developer, into contact or without contact. There are no particular limitations on the developing apparatus as long as the apparatus has the above-described function, and the developing apparatus is selected according to the purpose. For example, a known developing machine having a function of attaching the single-component developer or the two-component developer to the photoreceptor 7 using a brush, a roller or the like, may be used. Among others, it is desirable to use a developing roller which retains a developer at the surface.

<Toner>

Hereinafter, the toner that is used in the developing apparatus 11 will be described.

The toner of the exemplary embodiment contains at least toner particles and zinc stearate. It is desirable that zinc stearate be included as an external additive that is externally added to the surfaces of the toner particles.

Furthermore, the toner particles contain at least a binder resin, and may also optionally contain other components such as a release agent and a colorant.

Hereinafter, the various components that are included in the toner will be described.

—Binder Resin—

According to the exemplary embodiment, the binder resin desirably contains a crystalline resin, from the viewpoint of obtaining low temperature fixability.

In general, when a crystalline resin is used as the binder resin that is used in the toner, low temperature fixability may be obtained. However, when left to stand under a high temperature and high humidity environment, there is a tendency that the toner chargeability changes, the transfer efficiency decreases, and filming is likely to occur. However, when the toner for electrostatic image development related to the exemplary embodiment is used, filming is suppressed without impairing low temperature fixability.

Here, the crystalline resin that is included in the toner particles according to the exemplary embodiment will be described. A crystalline resin is defined by the following thermal characteristics and molecular weight. That is, a crystalline resin has, not a stepwise change in the amount of heat absorption, but a clear endothermic peak in differential scanning calorimetry (DSC). Specifically, a resin whose half-width of the endothermic peak when measured at a rate of temperature increase of 10° C./min is 8° C. or less, and whose weight average molecular weight Mw obtained by gel permeation chromatography (GPC) is from 4,000 to 50,000, is defined as a crystalline resin.

In regard to the analysis method, it is implied that the half-width of the endothermic peak relative to the baseline on the high temperature side is 8° C. or less, when measurement is made using a differential scanning calorimeter (manufactured by Shimadzu Corp.: DSC-60A) at a rate of temperature increase of 10° C./min using a sample amount of 8 mg and an alumina powder as a compensation reference material.

A "HLC-8120GPC, SC-8020 (manufactured by Tosoh Corp.) apparatus" is used for the GPC, and two "TSKGEL SUPER HM-H (manufactured by Tosoh Corp., 6.0 mm ID×15 cm)" are used as the columns. Tetrahydrofuran (THF) is used as the eluent. The experiment is carried out under the experimental conditions of a sample concentration of 0.5%, a flow rate of 0.6 ml/min, a sample injection amount of 10 μl, and a measurement temperature of 40° C., using an IR detector. Furthermore, the weight average molecular weight is the weight average molecular weight Mw obtainable when a calibration curve is produced from 10 samples of "Polystyrene standard samples TSK standard": "A-500", "F-1", "F-10", "F-80", "F-380", "A-2500", "F-4", "F-40", "F-128", and "F-700" manufactured by Tosoh Corp.

The weight average molecular weight Mw of the crystalline resin is from 4,000 to 50,000, desirably from 6,000 to 30,000, and more desirably from 7,000 to 15,000.

When the weight average molecular weight Mw of the crystalline resin is 4,000 or more, it is desirable because the occurrence of fixing unevenness that occurs because the toner infiltrates into the surface of the recording medium such as paper at the time of fixing, is suppressed, and the resistance to bending of fixed images is satisfactory. When the weight average molecular weight Mw is 50,000 or less, it is desirable because the control of viscosity decrease at the time of melting is satisfactory, and problems such as offset do not occur.

The crystalline resin is not particularly limited as long as it is a resin having crystallinity, and specific examples include a crystalline polyester resin and a crystalline vinylic resin. However, from the viewpoints of the adhesiveness to paper at the time of fixing or chargeability, and from the viewpoint of adjusting the melting point to a desirable range, a crystalline polyester resin is desirable. Furthermore, an aliphatic crystalline polyester resin having an appropriate melting point is more desirable.

Furthermore, when a crystalline resin is used alone, the strength of the resin itself is lower than that of amorphous resins, and there may be a problem in terms of the reliability of the powder. Particularly, there may be a problem that blocking occurs in the developing machine as a result of storage at high temperature, or filming is likely to occur on the photoreceptor. Thus, as a method expected to bring an improvement of strength, it is desirable to use a mixture of a crystalline resin and an amorphous resin.

Hereinafter, the binder resin that is used in the exemplary embodiment will be described separately in terms of the crystalline resin and the amorphous resin.

(Crystalline Resin)

The crystalline resin is desirably used at a content in the range of 5% to 30% among the components that constitute the toner, and more desirably in the range of 8% to 20%. When the proportion (weight ratio) of the crystalline resin is 30% or greater, satisfactory fixing characteristics may be obtained, but there may be problems that the phase separation structure in the fixed image is biased, the strength, particularly scratch strength, of fixed images is decreased, and images are susceptible to damage. On the other hand, when the proportion is less than 5%, the sharp melting property originating from crystalline resins may not be obtained, and amorphous resins are simply plasticized, and it is difficult to maintain toner blocking resistance and image preservability while securing satisfactory low temperature fixability.

Meanwhile, the term "crystalline resin" refers to a resin which has, not a stepwise change in the amount of heat absorption, but a clear endothermic peak in the differential scanning calorimetry (DSC). Specifically, this means that the half-width of the endothermic peak is 6° C. or less when measurement is made at a rate of temperature increase of 10° C./min. On the other hand, a resin having a half-width of greater than 6° C., and a resin which does not exhibit a clear endothermic peak mean amorphous resins, but as the amorphous resin according to the exemplary embodiment, it is desirable to use a resin which does not exhibit a clear endothermic peak.

The crystalline resin is not particularly limited as long as it is a resin having crystallinity, and specific examples include a crystalline polyester resin and a crystalline vinylic resin. However, from the viewpoints of the adhesiveness to paper at the time of fixing or chargeability, and from the viewpoint of adjusting the melting point to a desirable range, a crystalline polyester resin is desirable. Furthermore, an aliphatic crystalline polyester resin having an appropriate melting point is more desirable.

A crystalline polyester resin and all other polyester resins are each synthesized from a polyvalent carboxylic acid component and a polyol component. According to the exemplary embodiment, a commercially available product may be used as the polyester resin, or a synthetic product may also be used.

Examples of the polyvalent carboxylic acid component include aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; and dibasic aromatic dicarboxylic acids such as phthalic acid, isophthalic acid, terephthalic acid, naphthalene-2,6-dicarboxylic acid, malonic acid, and mesaconic acid. Furthermore, anhydrides of these acids and lower alkyl esters of these acids may also be used, but these compounds are not limited.

Examples of trivalent or higher-valent carboxylic acid components include 1,2,4-benzenetricarboxylic acid, 1,2,5-benzenetricarboxylic acid, 1,2,4-naphthalenetricarboxylic acid, anhydrides thereof, and lower alkyl esters thereof. These may be used individually, or two or more kinds may be used in combination.

Furthermore, the polyvalent carboxylic acid component desirably includes, in addition to the aliphatic dicarboxylic acids and aromatic dicarboxylic acids, a dicarboxylic acid component having a sulfonic acid group. The dicarboxylic acid having a sulfonic acid group is effective from the viewpoint that dispersion of the coloring material such as a pigment is satisfactorily achieved. Furthermore, when particles are produced by emulsifying or suspending the entire resin in water, if sulfonic acid groups are present, the resin is emulsified or suspended even without using a surfactant, as will be described below.

Examples of such a dicarboxylic acid having a sulfonic acid group include 2-sulfoterephthalic acid sodium salt, 5-sulfoisophthalic acid sodium salt, and sulfosuccinic acid sodium salt, but the examples are not limited to these. Furthermore, lower alkyl esters and acid anhydrides thereof may also be used. These divalent or higher-valent carboxylic acid components having sulfonic acid groups are incorporated at a proportion of 0 mol % to 20 mol %, and desirably from 0.5 mol % to 10 mol %, relative to the total content of the carboxylic acid components constituting the polyester. When the content of the divalent or higher-valent carboxylic acid component having a sulfonic acid group is small, the stability over time of the emulsified particles may deteriorate. On the other hand, if the content exceeds 10 mol %, not only the crystallinity of the polyester resin decreases, but also there is an adverse effect on the process in which the particles fuse after being aggregated, so that there may be inconvenience in that it becomes difficult to adjust the toner particle diameter.

Furthermore, it is more desirable that in addition to the aliphatic dicarboxylic acid and the aromatic dicarboxylic acid, a dicarboxylic acid component having a double bond be included. Since a dicarboxylic acid having a double bond is capable of radical crosslinking and bonding, the dicarboxylic acid is suitably used to prevent hot offset at the time of fixing. Examples of such a dicarboxylic acid include maleic acid, fumaric acid, 3-hexenedioic acid, and 3-octenedioic acid, but examples are not limited to these. Furthermore, lower esters and acid anhydrides thereof may also be used. Among these, from the viewpoint of cost, fumaric acid, maleic acid and the like may be desirably used.

As the polyol component, an aliphatic diol is desirable, and a linear aliphatic diol having from 7 to 20 carbon atoms in the main chain part is more desirable. When the aliphatic diol is branched, the crystallinity of the polyester resin is decreased, and the melting point is lowered. Therefore, the toner blocking resistance, image preservability and low temperature fixability may deteriorate. Furthermore, if there are fewer than 7 carbon atoms, in the case of performing a polycondensation reaction with an aromatic dicarboxylic acid, the melting point increases, and low temperature fixing may become difficult. On the other hand, if there are more than 20 carbon atoms, the material is likely to be not easily available for practical use. The number of carbon atoms is more desirably 14 or less.

Specific examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosandecanediol, but the examples are not limited to these. Among these, 1,8-octanediol, 1,9-nonanediol, and 1,10-decanediol are desirable in view of easy availability.

Examples of trivalent or higher-valent alcohols include glycerine, trimethylolethane, trimethylolpropane, and pentaerythritol. These may be used individually, or two or more kinds may be used together.

Among the polyol components, it is desirable that the content of the aliphatic diol component is 80 mol % or more, and more desirably 90 mol % or more. When the content of the aliphatic diol component is less than 80 mol %, the crystallinity of the polyester resin is decreased, and the melting point is lowered. Therefore, the toner blocking resistance, image preservability and low temperature fixability may deteriorate.

Meanwhile, if necessary, a monovalent acid such as acetic acid or benzoic acid, or a monohydric alcohol such as cyclohexanol or benzyl alcohol may also be used for the purpose of obtaining an acid value or a hydroxyl value.

There are no particular limitations on the method for producing a crystalline polyester resin, and the crystalline polyester resin is produced by a general polyester polymerization method of reacting an acid component and an alcohol component. Examples thereof include a direct polycondensation and a transesterification method, and the resin is produced by selecting the method appropriately with the type of monomer.

The production of a crystalline polyester resin is carried out at a polymerization temperature between 180° C. and 230° C., and if necessary, the reaction is carried out while the pressure inside the reaction system is reduced, and the water or alcohol generated at the time of condensation is removed. When the monomers are not soluble or compatible at the reaction temperature, a high boiling point solvent may be added as a dissolution aid to dissolve the monomers. In a polycondensation reaction, the reaction is carried out while a dissolution aid solvent is distilled off. If monomers that are poorly compatible with the copolymerization reaction are present, a monomer having poor compatibility and an acid or alcohol that is to be polycondensed with the monomer may be condensed in advance, and then the resultant may be polycondensed with the main component.

Examples of the catalyst used at the time of production of the crystalline polyester resin include alkali metal compounds of sodium, lithium and the like; alkaline earth metal compounds of magnesium, calcium and the like; metal compounds of zinc, manganese, antimony, titanium, tin, zirconium, germanium and the like; phosphorous acid compounds, phosphoric acid compounds and amine compounds. Specifically, the following compounds may be used.

Examples of the catalyst include compounds such as sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenylantimony, tributylantimony, tin formate, tin oxalate, tetraphenyltin, dibutyltin dichloride, dibutyltin oxide, diphenyltin oxide, zirconium tetrabutoxide, zirconium naphthenate, zirconium carbonate, zirconium acetate, zirconium stearate, zirconium octanoate, germanium oxide, triphenyl phosphite, tris(2,4-t-butylphenyl)phosphite, ethyl triphenylphosphonium bromide, triethylamine, and triphenylamine.

The melting point of the crystalline resin is desirably from 50° C. to 100° C., and more desirably 60° C. to 80° C. If the melting point is lower than 50° C., there may be problems for the storage stability of the toner, and the storage stability of the toner image after fixing. On the other hand, if the melting point is higher than 100° C., sufficient low temperature fixing may not be achieved as compared with conventional toners. Furthermore, some crystalline resins exhibit plural melting peaks, but in the exemplary embodiment, only the maximum peak is considered as the melting point.

On the other hand, examples of the crystalline vinylic resin include vinylic resins using (meth)acrylic acid esters of long-chain alkyls and alkenyls, such as amyl (meth)acrylate, hexyl (meth)acrylate, heptyl (meth)acrylate, octyl (meth)acrylate, nonyl (meth)acrylate, decyl (meth)acrylate, undecyl (meth) acrylate, tridecyl (meth)acrylate, myristyl (meth)acrylate, cetyl (meth)acrylate, stearyl (meth)acrylate, oleyl (meth) acrylate, and behenyl (meth)acrylate. In the present specification, the term "(meth)acryl" means that both "acryl" and "methacryl" are included.

(Amorphous Resin)

As the amorphous resin, known resin materials are used, but amorphous polyester resins are particularly desirable. The amorphous polyester resin is a polymer obtainable mainly by a polycondensation reaction between a polyvalent carboxylic acid and a polyol.

In the case of using an amorphous polyester resin, it is advantageous from the viewpoint that a resin particle dispersion liquid is easily prepared by adjusting the acid value of the resin or by emulsifying and dispersing using an ionic surfactant.

Examples of the polyvalent carboxylic acid include aromatic carboxylic acids such as terephthalic acid, isophthalic acid, phthalic anhydride, trimellitic anhydride, pyromellitic acid, and naphthalenedicarboxylic acid; aliphatic carboxylic acids such as maleic anhydride, fumaric acid, succinic acid, alkenylsuccinic anhydride, and adipic acid; and alicyclic carboxylic acids such as cyclohexanedicarboxylic acid. These polyvalent carboxylic acids are used individually or as mixtures of two or more kinds. Among these polyvalent carboxylic acids, it is desirable to use an aromatic carboxylic acid, and it is desirable to use a trivalent or higher-valent carboxylic acid (trimellitic acid or acid anhydride thereof) in combination with the dicarboxylic acid in order to adopt a crosslinked structure or a branched structure to secure satisfactory fixability.

Examples of the polyol include aliphatic diols such as ethylene glycol, diethylene glycol, triethylene glycol, propylene glycol, butanediol, hexanediol, neopentyl glycol, and glycerin; alicyclic diols such as cyclohexanediol, cyclohexanedimethanol, and hydrogenated bisphenol A; and aromatic diols such as an ethylene oxide adduct of bisphenol A, and a propylene oxide adduct of bisphenol A. These polyols are used individually or as mixtures of two or more kinds. Among these polyols, aromatic diols and alicyclic diol are desirable, and among these, aromatic diols are more desirable. Furthermore, in order to secure satisfactory fixability, a trivalent or higher-valent polyol (glycerin, trimethylolpropane, or pentaerythritol) may be used in combination with the diol so as to adopt a crosslinked structure or a branched structure.

Meanwhile, the acid value of the polyester resin may be adjusted by further adding a monocarboxylic acid and/or a monoalcohol to the polyester resin obtained by polycondensation of a polyvalent carboxylic acid and a polyol, and esterifying the hydroxyl groups and/or carboxyl groups at the polymer ends. Examples of the monocarboxylic acid include acetic acid, acetic anhydride, benzoic acid, trichloroacetic acid, trifluoroacetic acid, and propionic anhydride. Examples of the monoalcohol include methanol, ethanol, propanol, octanol, 2-ethylhexanol, trifluoroethanol, trichloroethanol, hexafluoroisopropanol, and phenol.

The polyester resin is produced by subjecting the polyol and the polyvalent carboxylic acid to a condensation reaction according to a conventional method. For example, the polyester resin is produced by introducing and mixing the polyol and the polyvalent carboxylic acid, and if necessary, a catalyst in a reactor equipped with a thermometer, a stirrer, and a downflow type condenser, heating the mixture to 150° C. to 250° C. in the presence of an inert gas (nitrogen gas or the like), continuously removing low molecular weight compounds that are produced as side products out of the reaction system, terminating the reaction at a time point of reaching a predetermined acid value, cooling the reaction product, and obtaining the intended reaction product.

Examples of the catalyst used in the synthesis of this polyester resin include esterification catalysts such as organometallic compounds such as dibutyltin dilaurate and dibutyltin oxide, and metal alkoxides such as tetrabutyl titanate. The amount of these catalysts added is desirably set to 0.01% by weight to 1.00% by weight, based on the total amount of the raw materials.

The amorphous resin used in the toner according to the exemplary embodiment is such that the weight average molecular weight (Mw) obtained by measuring the molecular weight of a tetrahydrofuran (THF)-soluble fraction according to a gel permeation chromatography (GPC) method is desirably from 5,000 to 1,000,000, and more desirably from 7,000 to 500,000; the number average molecular weight (Mn) is desirably from 2,000 to 10,000; and the molecular weight distribution Mw/Mn is desirably from 1.5 to 100, and more desirably from 2 to 60.

When the weight average molecular weight and the number average molecular weight are smaller than the range described above, it is effective for low temperature fixability; however, on the other hand, since the hot offset resistance is markedly deteriorated, and the glass transition point of the toner is decreased, the storage stability such as blocking of the toner may be adversely affected. On the other hand, when the molecular weight is larger than the range described above, hot offset resistance is sufficiently imparted. However, since low temperature fixability is decreased, and also bleedout of the crystalline polyester phase that is present in the toner is inhibited, the document preservability may be adversely affected. Therefore, it is easy to achieve a good balance between low temperature fixability, hot offset resistance, and document preservability by satisfying the conditions described above.

The molecular weight of the resin is determined by analyzing a THF-soluble product in THF solvent using a GPC manufactured by Tosoh Corp., HLC-8120, and a column manufactured by Tosoh Corp., TSKgel Super HM-M (15 cm), and the molecular weight is calculated using a molecular weight calibration curve produced using monodisperse polystyrene standard samples. The acid value of the polyester resin (number of mg of KOH required to neutralize 1 g of the resin) is desirably from 1 to 30 mg KOH/g, from the viewpoints that the molecular weight distribution such as described above may be easily obtained, that the granulation property of the toner particles due to the emulsion dispersion method may be secured, and that the environmental stability of the toner thus obtained (stability of chargeability when the temperature and humidity are changed) may be satisfactorily maintained.

The acid value of the polyester resin is adjusted by controlling the carboxyl groups at the polyester terminals, in accordance with the mixing ratio and the reaction ratio of the raw material polyvalent carboxylic acid and polyol. Furthermore, when trimellitic anhydride is used as the polyvalent carboxylic acid component, a polyester having carboxyl groups in the main chain may be obtained.

A styrene-acrylic resin may also be used as a known amorphous resin. Examples of the monomer used in this case include polymers of monomers, such as styrenes such as styrene, para-chlorostyrene, and α-methylstyrene; esters having vinyl groups such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; vinylnitriles such as acrylonitrile and methacrylonitrile; vinyl ethers such as vinyl methyl ether and vinyl isobutyl ether; vinyl ketones such as vinyl methyl ketone, vinyl ethyl ketone, and vinyl isopropenyl ketone; polyolefins such as ethylene, propylene and butadiene, and copolymers or mixtures obtainable by mixing two or more kinds of these monomers. Furthermore, non-vinyl condensed resins such as an epoxy resin, a polyester resin, a polyurethane resin, a polyamide resin, a cellulose resin, and a polyether resin; or graft polymers obtainable by polymerizing mixtures of these and the vinylic resins described above, or vinyl monomers in the co-presence of these resins, are also used.

The glass transition temperature of the amorphous resin is desirably from 35° C. to 100° C., and from the viewpoint of the balance between storage stability and toner fixability, the glass transition temperature is more desirably from 50° C. to 80° C. When the glass transition temperature is lower than 35° C., the toner tends to cause blocking (a phenomenon in which the toner particles aggregate and form clumps) during storage or in the developing machine. On the other hand, when the glass transition temperature is higher than 100° C., the fixing temperature of the toner increases and it is not desirable.

The softening point of the amorphous resin exists desirably in the range of from 80° C. to 130° C., and more desirably from 90° C. to 120° C. When the softening point is 80° C. or lower, the toner and the image stability of the toner may deteriorate after fixing and during storage. Furthermore, when the softening point is 130° C. or higher, low temperature fixability may deteriorate.

The measurement of the softening point of the amorphous resin is measured using a flow tester (manufactured by Shimadzu Corp.: CFT-500C), and an intermediate temperature between the melting initiation temperature and the melting termination temperature under the conditions of preheating: 80° C./300 sec, plunger pressure: 0.980665 MPa, die size: 1 mmφ×1 mm, and rate of temperature increase: 3.0° C./min, is defined as the softening temperature.

In regard to the production of a resin particle dispersion liquid of the crystalline polyester, for example, the resin particle dispersion liquid is prepared by emulsifying and dispersing resin particles by adjusting the acid value of the resin, or using an ionic surfactant.

The particle diameter of the resin particle dispersion liquid is measured with, for example, a laser diffraction type particle diameter distribution analyzer (LA-700, manufactured by Horiba, Ltd.).

—Zinc Stearate—

The toner used in the exemplary embodiment contains zinc stearate.

The average particle diameter of zinc stearate is desirably from 0.1 μm to 10 μM, and more desirably from 0.2 μm to 8 μm, from the viewpoint of efficiently performing coating on the photoreceptor.

The content of zinc stearate in the toner (toner particles and external additive) is desirably from 0.01% by weight to 2% by weight (or from about 0.01% by weight to about 2% by weight), more desirably from 0.05% by weight to 1% by weight (or from about 0.05% by weight to about 1% by weight), still further desirably from 0.2% by weight to 1% by weight (or from about 0.2% by weight to about 1% by weight), from the viewpoint that when the surface of the electrophotographic photoreceptor obtained after repeating the formation of an image having image sections and non-image sections and having an image density of 7% to thereby rotate the electrophotographic photoreceptor 50,000 times, is analyzed by X-ray photoelectron spectroscopy (XPS), the zinc coating ratio is from 50% to 100%.

—External Additive—

Furthermore, a known external additive may also be externally added to the toner of the exemplary embodiment, in combination with zinc stearate. As the external additive, for example, inorganic particles of silica, alumina, titania, calcium carbonate, magnesium carbonate, and tricalcium phosphate are used. The method of adding the external additive is not particularly limited, but the external additive may be added to the toner particle surfaces by applying shear force in a dry state.

Specifically, the inorganic particles used as the external additive are particles having a primary particle diameter in the range of desirably from 5 nm to 2 μm, and more desirably from 5 nm to 500 nm. It is desirable to use two or more kinds of these particles in combination as necessary. Particularly, an external additive having a median particle diameter of 100 nm or larger has a weak adhering force to the toner surface, does not undergo a structural change even during long-term use, and is useful for maintaining the structure of small-sized, lightweight particles.

Furthermore, the specific surface area according to the BET method is desirably in the range of from 20 $m^2/g$ to 500 $m^2/g$. The proportion mixed with the toner is desirably in the range of from 0.01% by weight to 5% by weight, and more desirably in the range of from 0.01% by weight to 2.0% by weight.

Examples of such inorganic particles include silica powder, alumina, titanium oxide, barium titanate, magnesium titanate, calcium titanate, strontium titanate, zinc oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, and silicon nitride, and silica powder is particularly desirable.

Meanwhile, the silica powder as used herein is a powder having a Si—O—Si bond, and includes all products produced by dry methods and wet methods. Furthermore, in addition to anhydrous silicon dioxide, any of aluminum silicate, sodium silicate, potassium silicate, magnesium silicate, and zinc silicate may be used, but it is desirable that $SiO_2$ be included in an amount of 85% by weight or more.

Specific examples of these silica powders include various commercially available silica products, but a product having hydrophobic groups at the surface is desirable, and examples include AEROSIL R-972, R-974, R-805 and R-812 (all manufactured by Nippon Aerosil Co., Ltd.), and TURRAX 500 (Talco, Ltd.). Silica powders treated with other silane coupling agents, titanium coupling agents, silicone oils, and silicone oils having an amine in side chains, may be used.

—Colorant—

The colorant used in the toner of the exemplary embodiment is not particularly limited as long as it is a known colorant. Examples thereof include carbon black such as furnace black, channel black, acetylene black, and thermal black; inorganic pigments such as red iron oxide, Prussian blue, and titanium oxide; azo pigments such as Fast yellow, disazo yellow, pyrazolone red, chelate red, brilliant carmine, and para-brown; phthalocyanine pigments such as copper phthalocyanine and metal-free phthalocyanine; and fused polycyclic pigments such as flavanthrone yellow, dibromoanthrone orange, perylene red, quinacridone red, and dioxazine violet.

Furthermore, various pigments such as chrome yellow, hansa yellow, benzidine yellow, slen yellow, quinoline yellow, permanent orange GTR, pyrazolone orange, vulcan orange, watch young red, permanent red, Dupont oil red, lithol red, rhodamine B lake, lake red C, Rose Bengal, aniline blue, Prussian blue, calco oil blue, methylene blue chloride, phthalocyanine blue, phthalocyanine green, malachite green oxalate, C.I. Pigment Red 48:1, C.I. Pigment Red 122, C.I. Pigment 57:1, C.I. Pigment Yellow 12, C.I. Pigment Yellow 97, C.I. Pigment Yellow 17, C.I. Pigment Blue 15:1, and C.I. Pigment Blue 15:3 are available as examples, and these are used individually or as mixtures of two or more kinds.

The content of the colorant in the toner of the exemplary embodiment is desirably from 1 part by weight to 30 parts by weight relative to 100 parts by weight of the binder resin, and if necessary, it is also effective to use surface-treated colorants, or to use pigment dispersants. A yellow toner, a magenta toner, a cyan toner, a black toner and the like are obtained by appropriately selecting the type of the colorants.

—Release Agent—

The toner of the exemplary embodiment may contain a release agent. The release agent that is used in the toner of the exemplary embodiment is not particularly limited as long as it is a known release agent, but examples thereof include natural waxes such as carnauba wax, rice wax, and candellila wax; synthetic or mineral petroleum-based waxes such as low molecular weight polypropylene, low molecular weight polyethylene, Sasolwax, microcrystalline wax, Fischer-Tropsch wax, paraffin wax, and montan wax; and ester-based waxes such as fatty acid esters, and montanic acid esters, but the examples are not limited to these. These release agents may be used individually, or two or more kinds may be used in combination.

The melting point of the release agent is desirably 50° C. or higher, and more desirably 60° C. or higher, from the viewpoint of preservability. Furthermore, from the viewpoint of offset resistance, the melting point is desirably 110° C. or lower, and more desirably 100° C. or lower.

The content of the release agent is desirably in the range of from 1 part by weight to 30 parts by weight, and more desirably in the range of from 2 parts by weight to 20 parts by weight, relative to 100 parts by weight of the binder resin. When the content of the release agent is less than 1 part by weight, the effect of adding a release agent is not obtained, and hot offset may occur at high temperatures. On the other hand, when the content is greater than 30 parts by weight, the chargeability may be adversely affected, and the mechanical strength of the toner is reduced. Therefore, the toner is likely to be destroyed by stress in the developing machine, and carrier contamination or the like may occur. Furthermore, when the toner is used as a color toner, domains are likely to remain on the fixed image, and there is a problem that the OHP transparency is deteriorated.

—Other Components—

The toner particles may contain other components such as a charge-controlling agent and a magnetic material.

As the charge-controlling agent, known agents are used, but azo-based metal complex compounds, metal complex compounds of salicylic acid, and resin type charge-controlling agents containing polar groups are used. In the case of producing a toner by a wet production method, it is desirable to use a material that is difficult to dissolve in water, from the viewpoint of controlling the ionic strength and reducing waste water contamination. Furthermore, any of a magnetic toner containing a magnetic material, and a non-magnetic toner which does not contain a magnetic material may be used as toner.

—Method for Producing Toner—

The method for producing toner particles that are included in the toner is not particularly limited, but examples thereof include a kneading pulverization method of mixing a binder resin, a colorant, a release agent, and if necessary, a charge-controlling agent and the like, and subjecting the mixture to kneading, pulverization and classification; a method of changing the shape of the particles obtained by the kneading pulverization method by applying mechanical impact force or thermal energy; an emulsion polymerization aggregation method of emulsion polymerizing the polymerizable monomer of a binder resin, mixing the dispersion liquid thus formed and a dispersion liquid of a colorant, a release agent, and if necessary, a charge-controlling agent and the like, and aggregating and heat fusing the mixture to obtain toner particles; a suspension polymerization method of suspending a solution of a polymerizable monomer for obtaining a binder resin, a colorant, a release agent, and if necessary, a charge-controlling agent and the like in an aqueous solvent, and performing polymerization; and a dissolution suspension method of suspending a solution of a binder resin, a colorant, a release agent, and if necessary, a charge-controlling agent and the like in an aqueous solvent, and granulating the suspension.

Furthermore, known methods such as a production method of using the toner obtained by the methods described above as a core, further attaching aggregate particles thereto, and heating and fusing the particles to allow them to have a core-shell structure, are used. Meanwhile, as the method for producing a toner, a suspension polymerization method, an emulsion polymerization aggregation method, and a dissolution suspension method, which carry out the production in an aqueous solvent, are desirable from the viewpoints of controlling the shape and controlling the particle diameter distribution, and an emulsion polymerization aggregation method is particularly desirable.

Among the methods described above, a suitable example of the method for producing toner particles will be described.

A suitable method for producing the toner particles may be, for example, a wet production method including an aggregation process of forming aggregate particles in a dispersion liquid in which at least resin particles are dispersed, and if necessary, colorant particles and release agent particles are dispersed; and a coalescence process of heating the aggregate particles to coalesce the aggregate particles. When toner particles are obtained by this method, it is suitable from the viewpoint that a toner having a small particle diameter and having a sharp particle diameter distribution is produced, and also a color toner capable of forming high quality color images is obtained.

In the aggregation process, a dispersion liquid prepared by using a resin particle dispersion liquid containing at least the binder resin, and if necessary, adding and mixing other components such as a colorant dispersion liquid and a release agent dispersion liquid, is mixed, an aggregating agent is added thereto, and by heating the mixture while stirring, the resin particles are aggregated. Thus, aggregate particles are formed.

The volume average particle diameter of the aggregate particles is desirably in the range of from 2 μm to 9 μm. Resin particles (additional particles) are further added to the aggregate particles formed as such, and thereby a surface layer may be formed on the surfaces of the aggregate particles (attachment process). The resin particles (additional particles) that are added additionally in this attachment process, may be the same as the particles of the resin particles dispersion liquid in terms of the aggregation process described above or may be obtained by a method different from the conventional method.

Furthermore, as the resin that is used in the aggregation process or the attachment process described above, it is desirable to incorporate a resin having a relatively large molecular weight in order to easily liberate the external additives. Specifically, a resin having a Z average molecular weight Mz of 100,000 to 5,000,000 is desirable.

Subsequently, in the coalescence process, for example, aggregate particles are coalesced by heat treating the resin at a temperature equal to or higher than the glass transition temperature of the resin, generally at 70° C. to 120° C., and thus a toner particle-containing liquid (toner particle dispersion liquid) is obtained. Subsequently, the toner particle-containing liquid thus obtained is treated by centrifugation or suction filtration, and toner particles are separated and are washed one to three times with ion-exchanged water. At that time, the washing effect can be enhanced by adjusting the pH. Thereafter, the toner particles are separated by filtration, washed one to three times with ion-exchanged water, and dried, and thereby toner particles are obtained.

—Other Particles—

Furthermore, active particles may also be added to the toner. As the active particles, solid lubricants such as graphite, molybdenum disulfide, talc, fatty acids, and fatty acid metal salts; low molecular weight polyolefins such as polypropylene, polyethylene, and polybutene; silicones having a softening point by heating; aliphatic amides such as oleic acid amide, erucic acid amide, ricinolic acid amide, and stearic acid amide; plant waxes such as carnauba wax, rice wax, candellila wax, wood wax, and jojoba oil; animal waxes such as beeswax; mineral and petroleum waxes such as montan wax, ozokerite, ceresin, paraffin wax, microcrystalline wax, and Fischer-Tropsch wax; and modification products thereof are used. These are used individually, or two or more kinds may be used in combination. However, the average particle diameter is desirably in the range of from 0.1 μm to 10 μm, and the particles having the above-described chemical structure may be pulverized to have the particle diameter. The amount thereof added to the toner is desirably from 0.05% by weight to 2.0% by weight, and more desirably in the range of from 0.1% by weight to 1.5% by weight.

Furthermore, inorganic particles, organic particles, composite particles produced by attaching inorganic particles to the organic particles, and the like may also be added to the toner, for the purpose of removing attached materials and degradation products on the surface of the electrophotographic photoreceptor.

As the inorganic particles, various inorganic oxides, nitrides and borides, such as silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride, and boron nitride, are suitably used.

Furthermore, the inorganic particles may be treated with a titanium coupling agent such as tetrabutyl titanate, tetraoctyl titanate, isopropyl triisostearoyl titanate, isopropyltridecylbenzenesulfonyl titanate, or bis(dioctylpyrophosphate) oxyacetate titanate; or a silane coupling agent such as γ-(2-aminoethyl)aminopropyltrimethoxysilane, γ-(2-aminoethyl) aminopropylmethyldimethoxysilane, γ-methacryloxypropyltrimethoxysilane, N-β-(N-vinylbenzylaminoethyl)-γ-aminopropyltrimethoxysilan e hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane, or p-methylphenyltrimethoxysilane. Furthermore, particles that have been subjected to a hydrophobization treatment with a higher fatty acid metal salt such as silicone oil, aluminum stearate, zinc stearate or calcium stearate are also desirably used.

Examples of the organic particles include styrene resin particles, styrene-acrylic resin particles, polyester resin particles, and urethane resin particles.

Particles having a particle diameter of, as the number average particle diameter, desirably from 5 nm to 1,000 nm, more desirably from 5 nm to 800 nm, and even more desirably from 5 nm to 700 nm, are used. When the average particle diameter is less than the lower limit, the particles tend to lack polishing capacity. On the other hand, when the average particle diameter is greater than the upper limit, the particles tend to easily damage the surface of the electrophotographic photoreceptor. Furthermore, the sum of the amount of the particles described and the active particles added is desirably 0.6% by weight or more.

As the other inorganic oxide that is added to the toner, it is desirable to use a small-diameter inorganic oxide having a primary particle diameter of 40 nm or less for the purpose of powder fluidity and charge control, and it is desirable to add an inorganic oxide having a larger diameter than that, for the purpose of adhesive force reduction, or charge control. For these inorganic oxide particles, known particles are used, but in order to perform precision charge control, it is desirable to use silica and titanium oxide in combination.

Furthermore, when the small-sized inorganic particles are surface treated, their dispersibility is increased, and the effect of increasing powder fluidity is increased. Furthermore, it is also desirable to add carbonate salts such as calcium carbonate and magnesium carbonate, or inorganic minerals such as hydrotalcite, in order to remove discharge purification products.

(Electrostatic Image Developer)

The electrostatic image developer of the exemplary embodiment of the present invention (hereinafter, may be referred to as "developer") includes the toner of the exemplary embodiment, and other components may also be incorporated according to the purpose.

Specifically, when the toner of the exemplary embodiment is used alone, a single-component electrostatic image developer is prepared, and when the toner is used in combination with a carrier, a two-component electrostatic image developer is prepared. In the case of preparing a two-component electrostatic image developer, the toner concentration is desirably set to the range of from 1% by weight to 10% by weight.

Here, there are no particular limitations on the carrier, and known carriers may be used. For example, known carriers such as a carrier in which the core material is coated with a resin layer (resin-coated carrier) as disclosed in JP-A-62-39879, JP-A-56-11461 and the like, are used.

The core material of the resin-coated carrier may be a structural material such as powdered iron, ferrite or magnetite, and the average diameter thereof is about from 30 μm to 200 μm.

Examples of the coating resin that forms the coating layer include homopolymers of styrenes such as styrene, parachlorostyrene and α-methylstyrene; α-methylene fatty acid monocarboxylic acids such as methyl acrylate, ethyl acrylate, n-propyl acrylate, lauryl acrylate, 2-ethylhexyl acrylate, methyl methacrylate, n-propyl methacrylate, lauryl methacrylate, and 2-ethylhexyl methacrylate; nitrogen-containing acrylics such as dimethylaminoethyl methacrylate; vinylnitriles such as acrylonitrile and methacrylonitrile; vinylpyridines such as 2-vinylpyridine and 4-vinylpyridine; vinyl ethers such as vinyl methyl ether, and vinyl isobutyl ether; vinyl ketones such as vinyl methyl ketone, vinyl ethyl ketone and vinyl isopropenyl ketone; olefins such as ethylene and propylene; and vinyl-based fluorine-containing monomers such as vinylidene fluoride, tetrafluoroethylene, and hexafluoroethylene; or copolymers of two or more monomers; silicones such as methylsilicone, and methylphenylsilicone; polyesters containing bisphenol, glycol and the like; epoxy resins, polyurethane resins, polyamide resins, cellulose resins, polyether resins, and polycarbonate resins. These resins may be used individually, or two or more kinds may be used in combination.

The amount of coating resin used is desirably in the range of from 0.1 part by weight to 10 parts by weight, and more desirably in the range of from 0.5 part by weight to 3.0 parts by weight, relative to 100 parts by weight of the core material. In the production of the carrier, for example, a heating type kneader, a heating type Henschel mixer, a UM mixer and the like are used, and depending on the amount of the coating resin, a heating type fluidized rolling bed, a heating type kiln, and the like are used. The mixing ratio of the toner and the carrier in the electrostatic image developer is not particularly limited, and the mixing ratio is selected according to the purpose.

[Transfer Unit]

Examples of the transfer apparatus 40 include well known transfer chargers such as contact type transfer chargers using a belt, a roller, a film, a rubber blade or the like; and a scorotron transfer charger or corotron transfer charger utilizing corona discharge.

As the intermediate transfer member 50, a belt-shaped member (intermediate transfer belt) made of polyimide, polyamideimide, polycarbonate, polyallylate, polyester, rubber or the like, to which semiconductivity has been imparted, is used. Furthermore, for the shape of the intermediate transfer body 50, a drum-shaped member is used in addition to the belt-shaped member.

[Cleaning Unit]

The cleaning apparatus 13 includes a cleaning blade 131 and a cleaning brush 132 that are in contact with the surface of the electrophotographic photoreceptor, and removes any residual developer remaining on the surface of the photoreceptor after transfer.

As the cleaning blade 131, for example, a blade equipped with a supporting member (support unit) and a rubber member is used. The rubber member is a member that is pressed against the photoreceptor surface (not shown in the diagram), and may have a two-layer structure composed of an edge layer and a base layer.

The contact pressure of the cleaning blade 131 to the photoreceptor is desirably from 10 N/m to 80 N/m, more desirably from 15 N/m to 60 N/m, and even more desirably from 20 N/m to 50 N/m. When the contact pressure is adjusted to the range described above, the ability to remove toner is enhanced, and also, the photoreceptor surface is prevented from being put under the exertion of local forces. As a result, local abrasion of the photoreceptor surface is suppressed, and satisfactory images may be easily obtained repeatedly over a long time period.

The cleaning brush 132 has hair (brush fiber) radially extending from the center line that extends in parallel to the rotating axis of the photoreceptor drum 7. As the material of the brush fiber, any known material can be used, but among others, nylon, acrylic or polypropylene is desirable, and among these, nylon is particularly desirable due to its excellent long-term stability. The fiber thickness at the brush surface is desirably in the range of from 2 denier to 17 denier, and more desirably in the range of from 3 denier to 10 denier. The fiber length at the brush surface (not including the fiber-raising adhesive layer thickness) is desirably in the range of from 2.5 mm to 7 mm, and more desirably in the range of from 3 mm to 6.5 mm. Furthermore, the fiber density of the brush surface is desirably in the range of from $15\times10^3$ fibers/inch$^2$ to $200\times10^3$ fibers/inch$^2$ (from 23.4 fibers/mm$^2$ to 310 fibers/mm$^2$), and more desirably in the range of from $20\times10^3$ fibers/inch$^2$ to $80\times10^3$ fibers/inch$^2$ (from 31.0 fibers/mm$^2$ to 124 fibers/mm$^2$).

The image forming apparatus 100 may include, in addition to the various apparatuses described above, for example, a photo-erasing device that performs photo-erasing on the photoreceptor 7.

Figure 5:
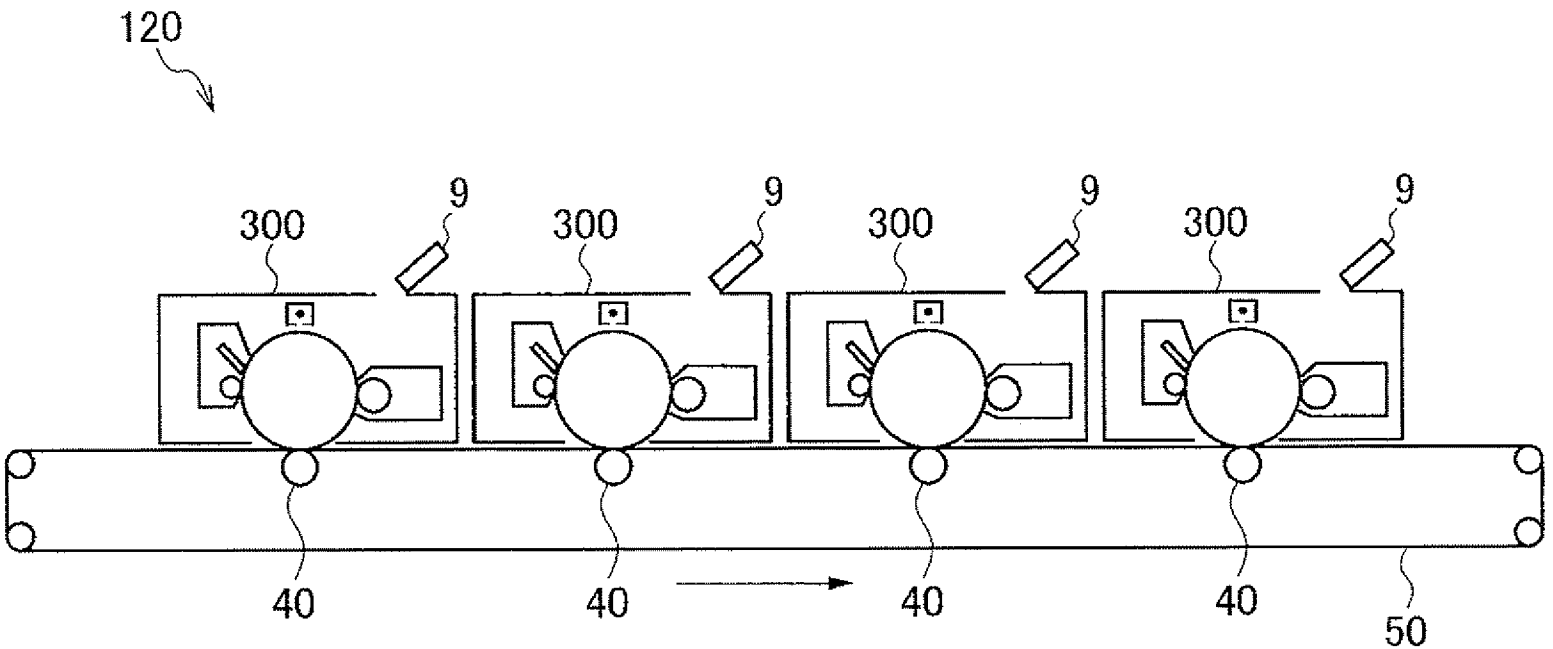
FIG. 5 is a schematic configuration diagram showing another example of the image forming apparatus according to the exemplary embodiment of the present invention.

FIG. 5 is a schematic cross-sectional diagram showing an image forming apparatus according to another exemplary embodiment. The image forming apparatus 120 is a full-color image forming apparatus of tandem system, equipped with four process cartridges 300, as shown in FIG. 5. In the image forming apparatus 120, four process cartridges 300 are respectively disposed in parallel on the intermediate transfer member 50, and the image forming apparatus has a configuration in which one electrophotographic photoreceptor is used for one color. Meanwhile, the image forming apparatus 120 has the same configuration as the image forming apparatus 100, except for being a tandem system.

When the electrophotographic photoreceptor of the exemplary embodiment of the present invention is used as a tandem type image forming apparatus, since the electrical characteristics of the four photoreceptors are stabilized, an image quality with excellent color balance may be obtained for a longer time period.

Furthermore, in the image forming apparatus (process cartridge) according to the exemplary embodiment of the present invention, the developing apparatus (developing unit) includes a developer retaining member having a magnetic member, and it is desirable to develop electrostatic latent images with a two-component developer containing a magnetic carrier and a toner. In this configuration, color images of superior image quality may be obtained as compared with the case of using a single-component developer, particularly a non-magnetic single-component developer, and an enhancement of image quality and an enhancement of service life can be realized to a higher level.

EXAMPLES

Hereinafter, the present invention will be more specifically described based on Examples and Comparative Examples, but the present invention is not intended to be limited to the following Examples. In the following, the unit "parts" is on a weight basis unless particularly stated otherwise.

—Production of Photoreceptor—

100 parts by weight of zinc oxide (average particle diameter 70 nm; manufactured by Tayca Corp.; specific surface area value 15 m$^2$/g) is mixed under stirring with 500 parts by weight of toluene, 1.25 parts by weight of a silane coupling agent (KBM603: manufactured by Shin-Etsu Chemical Co., Ltd.) is added thereto, and the mixture is stirred for 2 hours. Thereafter, toluene is distilled off by reduced pressure distillation, and the product is fired for 3 hours at 120° C. Thus, a silane coupling agent-surface treated zinc oxide pigment is obtained.

100 parts by weight of the surface-treated zinc oxide is mixed under stirring with 500 parts by weight of tetrahydrofuran, and a solution prepared by dissolving 1 part by weight of alizarin in 50 parts by weight of tetrahydrofuran is added thereto. The mixture is stirred for 5 hours at 50° C. Thereafter, the alizarin-applied zinc oxide is separated by filtration by filtering the mixture under reduced pressure, and the alizarin-applied zinc oxide is dried under reduced pressure at 60° C. Thus, an alizarin-applied zinc oxide pigment is obtained.

38 parts by weight of a solution prepared by dissolving 60 parts by weight of this alizarin-applied zinc oxide pigment, 13.5 parts by weight of a blocked isocyanate curing agent, SUMIDUR 3175 (manufactured by Sumitomo Bayer Urethane Co., Ltd.), and 15 parts by weight of a butyral resin, S-LEC EM-1 (manufactured by Sekisui Chemical Co., Ltd.) in 85 parts by weight of methyl ethyl ketone, and 25 parts by weight of methyl ethyl ketone are mixed, and the mixture is dispersed for 2 hours in a sand mill using 1-mmϕ glass beads. Thus, a dispersion liquid is obtained.

0.005 part by weight of dioctyltin dilaurate as a catalyst, and 40 parts by weight of silicone resin particles, TOSPEARL 145 (manufactured by GE Toshiba Silicone Co., Ltd.) are added to the dispersion liquid thus obtained, and the mixture is dried and cured for 40 minutes at 170° C. Thus, a coating liquid for undercoat layer formation is obtained.

This coating liquid is dip coated on an aluminum base material having a diameter of 60 mm, a length of 357 mm, and a thickness of 1 mm by a dip coating method, and thus an undercoat layer having a thickness of 20 μm is obtained.

<Charge Generating Layer>

Subsequently, 1 part by weight of chlorogallium phthalocyanine crystals having strong diffraction peaks at Brigg's angles (2θ±0.2°) of 7.4°, 16.6°, 25.5°, and 28.3° in the X-ray diffraction spectrum, as a charge generating material, is added together with 1 part by weight of a polyvinyl butyral resin (trade name: S-LEC BM-S, manufactured by Sekisui Chemical Co., Ltd.) to 100 parts by weight of butyl acetate. The mixture is treated for one hour in a paint shaker with glass beads to disperse the mixture. Thereafter, the coating liquid thus obtained is dip coated on the surface of the undercoat layer, and is heated and dried for 10 minutes at 100° C. Thus, a charge generating layer having a thickness of about 0.2 μm is formed.

<Charge Transport Layer>

Furthermore, a coating liquid obtained by dissolving 2.1 parts by weight of compound 1 represented by the following formula, and 2.9 parts by weight of a polymer compound represented by the following structural formula (1) (viscosity average molecular weight: 39,000) in 10 parts by weight of tetrahydrofuran and 5 parts by weight of toluene, is dip coated on the surface of the charge generating layer, and is heated and dried for 35 minutes at 135° C. Thus, a charge transporting layer having a thickness of 24 μm is formed.

Compound 1

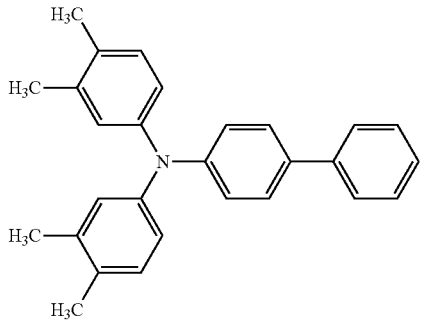

Structural formula 1

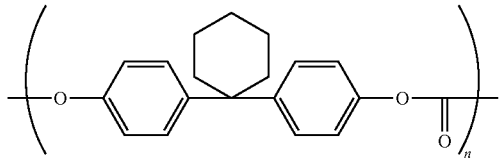

<Surface Protective Layer>

10 parts of LUBRON L-2 (manufactured by Daikin Industries, Ltd.) as tetrafluoroethylene resin particles, and 0.5 part of a fluorinated alkyl group-containing copolymer containing a repeating unit represented by the following structural formula (2) (weight average molecular weight 50,000; 1:m=1:1, s=1, n=60) are mixed with 40 parts of cyclopentanone by sufficiently stirring, and thus a tetrafluoroethylene resin particle suspension is prepared.

Subsequently, 70 parts of a compound represented by the above formula (I-8), 25 parts of a compound represented by the formula (I-26), and 5 parts of a benzoguanamine resin (NIKALAC BL-60, manufactured by Sanwa Chemical Co., Ltd.) are respectively added to 220 parts of cyclopentanone, and the mixture is sufficiently dissolved and mixed. Subsequently, the tetrafluoroethylene resin particle suspension is added thereto, and the resulting mixture is mixed under stirring.

Subsequently, a dispersion treatment is repeated 25 times at an increased pressure of 700 kgf/cm$^2$, using a high pressure homogenizer equipped with a penetrating chamber having fine flow channels (manufactured by Yoshida Kikai Co., Ltd.; YSNM-1500AR), and then 0.1 part of NACURE 5225 (manufactured by King Industries, Inc.) is added thereto. Thus, a coating liquid for surface protective layer formation is prepared. This coating liquid for surface protective layer formation is applied on the charge transport layer by a dip coating method, and is dried at 155° C. for 35 minutes. Thus, a photoreceptor thus obtained by forming a surface protective layer having a thickness of about 8 μm is designated as photoreceptor 1.

Structural formula (2)

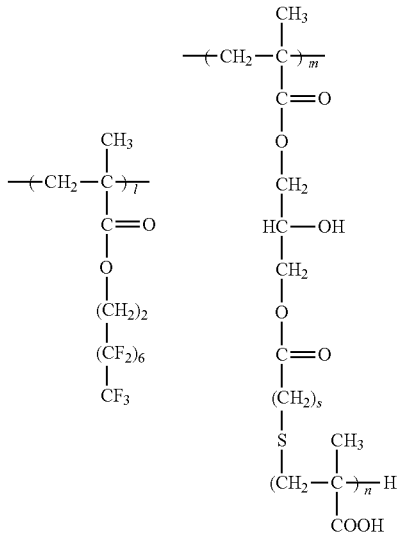

[Photoreceptor 2]

In regard to the formation of the surface protective layer of the photoreceptor 1, the amounts added are changed to 5 parts for LUBRON L-2 (manufactured by Daikin Industries, Ltd.), 0.25 part for the fluorinated alkyl group-containing copolymer, and 20 parts for cyclopentanone, and the components are sufficiently stirred and mixed. Thus, a tetrafluoroethylene resin particle suspension is prepared. A photoreceptor obtained in the same manner as in the case of the photoreceptor 1 in the subsequent procedure is designated as photoreceptor 2.

[Photoreceptor 3]

In regard to the formation of the surface protective layer of the photoreceptor 1, the amounts added are changed to 3 parts for LUBRON L-2 (manufactured by Daikin Industries, Ltd.), 0.15 part for the fluorinated alkyl group-containing copolymer, and 12 parts for cyclopentanone, and the components are sufficiently stirred and mixed. Thus, a tetrafluoroethylene resin particle suspension is prepared. A photoreceptor obtained in the same manner as in the case of the photoreceptor 1 in the subsequent procedure is designated as photoreceptor 3.

[Photoreceptor 4]

In regard to the formation of the surface protective layer of the photoreceptor 1, the amounts added are changed to 20 parts for LUBRON L-2 (manufactured by Daikin Industries, Ltd.), 1.0 part for the fluorinated alkyl group-containing copolymer, and 80 parts for cyclopentanone, and the components are sufficiently stirred and mixed. Thus, tetrafluoroethylene resin particle suspension is prepared. A photoreceptor obtained in the same manner as in the case of the photoreceptor 1 in the subsequent procedure is designated as photoreceptor 4.

[Photoreceptor 5]

A photoreceptor is obtained in the same manner as in the photoreceptor 1, except that in regard to the formation of the surface protective layer of the photoreceptor 1, the benzoguanamine resin is replaced with a methylated melamine resin (B-2: NIKALAC MW-30HM, manufactured by Sanwa Chemical Co., Ltd.). The photoreceptor thus obtained is designated as photoreceptor 5.

[Photoreceptor 6]

A photoreceptor is obtained in the same manner as in the photoreceptor 1, except that in regard to the formation of the surface protective layer of the photoreceptor 1, the amounts added are changed to 95 parts for the compound represented by the formula (I-8), and 0 part for the compound represented by the formula (I-26). The photoreceptor thus obtained is designated as photoreceptor 6.

[Photoreceptor 7]

A photoreceptor is obtained in the same manner as in the photoreceptor 1, except that in regard to the formation of the surface protective layer of the photoreceptor 1, the amounts added are changed to 85 parts for the compound represented by the formula (I-8), and 10 parts for the compound represented by the formula (I-26). The photoreceptor thus obtained is designated as photoreceptor 7.

[Photoreceptor 8]

A photoreceptor is obtained in the same manner as in the photoreceptor 1, except that in regard to the formation of the surface protective layer of the photoreceptor 1, the amounts added are changed to 60 parts for the compound represented by the formula (I-8), 20 parts for the compound represented by the formula (I-26), and 20 parts for the benzoguanamine resin. The photoreceptor thus obtained is designated as photoreceptor 8.

[Photoreceptor 9]

A photoreceptor is obtained in the same manner as in the photoreceptor 1, except that in regard to the formation of the surface protective layer of the photoreceptor 1, the amounts added are changed to 70 parts for the compound represented by the formula (I-8), 29.9 parts for the compound represented by the formula (I-26), and 0.1 part for the benzoguanamine resin. The photoreceptor thus obtained is designated as photoreceptor 9.

[Photoreceptor 10]

A photoreceptor is obtained in the same manner as in the photoreceptor 1, except that in regard to the formation of the surface protective layer of the photoreceptor 1, the amounts added are changed to 47.5 parts for the compound represented by the formula (I-8), and 47.5 parts for the compound represented by the formula (I-26). The photoreceptor thus obtained is designated as photoreceptor 10.

[Photoreceptor 11]

A photoreceptor is obtained in the same manner as in the photoreceptor 8, except that in regard to the formation of the surface protective layer of the photoreceptor 8, the compound represented by the formula (I-26) is replaced with compound 2 represented by the following formula. The photoreceptor thus obtained is designated as photoreceptor 11.

Compound 2

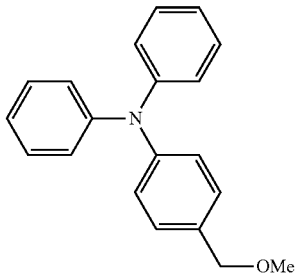

[Photoreceptor 12]

A photoreceptor is obtained in the same manner as in the photoreceptor 1, except that in regard to the formation of the surface protective layer of the photoreceptor 1, the compound represented by the formula (I-8) is replaced with a compound represented by the formula (I-16). The photoreceptor thus obtained is designated as photoreceptor 12.

[Photoreceptor 13]

A photoreceptor is obtained in the same manner as in the photoreceptor 12, except that in regard to the formation of the surface protective layer of the photoreceptor 12, the benzoguanamine resin is replaced with a methylated melamine resin. The photoreceptor thus obtained is designated as photoreceptor 13.

[Photoreceptor 14]

A photoreceptor is produced in the same manner as in the case of the photoreceptor 1, until the process of forming the charge transport layer.

10 parts of LUBRON L-2 (manufactured by Daikin Industries, Ltd.) as tetrafluoroethylene resin particles, and 0.5 part of a fluorinated alkyl group-containing copolymer containing a repeating unit represented by the above structural formula 2 (weight average molecular weight 50,000, l:m=1:1, s=1, n=60) are sufficiently stirred and mixed in 40 parts of cyclopentanone, and thus a tetrafluoroethylene resin particle suspension is prepared.

Subsequently, the constituent materials shown below are dissolved in 5 parts by weight of isopropyl alcohol, 3 parts by weight of tetrahydrofuran, and 0.3 part by weight of distilled water, and 0.5 part by weight of an ion-exchange resin (AMBERLYST 15E, manufactured by Rohm & Haas Co., Ltd.) is added thereto. The mixture is hydrolyzed for 24 hours while the mixture is stirred at room temperature.

—Constituent Material—

Compound 5 having the following structure: 2 parts by weight

Methyltrimethoxysilane: 2 parts by weight

Tetramethoxysilane: 0.5 part by weight

Colloidal silica: 0.3 part by weight

Compound 5

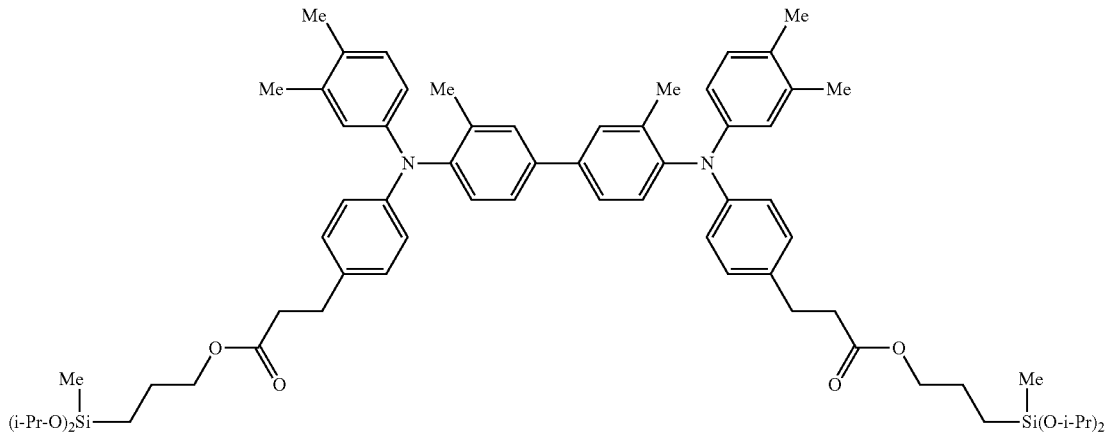

To a liquid obtained by separating by filtration the ion-exchange resin from the hydrolyzed product, 0.1 part by weight of aluminum tris(acetylacetonate) ($Al(aqaq)_3$), and 0.4 part by weight of 3,5-di-t-butyl-4-hydroxytoluene (BHT) are added, and the mixture is sufficiently dissolved and mixed. Subsequently, the tetrafluoroethylene resin particle suspension is added thereto, and the resulting mixture is stirred and mixed. Subsequently, a dispersion treatment is repeated 20 times at an increased pressure of 700 kgf/cm$^2$, using a high pressure homogenizer equipped with a penetrating chamber having fine flow channels (manufactured by Yoshida Kikai Co., Ltd.; YSNM-1500AR), and then 1 parts of dimethylpolysiloxane (GRANOL 450, manufactured by Kyoeisha Chemical Co., Ltd.), and 0.1 part of NACURE 5225 (manufactured by King Industries, Inc.) are added thereto. Thus, a coating liquid for protective layer formation is prepared. This coating liquid is applied on the charge transport layer by a ring-type dip coating method, and the coating liquid is dried in air for 30 minutes at room temperature and then cured by heat treating for 1 hour at 170° C. Thus, a surface protective layer having a thickness of 8 μm is formed.

The photoreceptor thus obtained is designated as photoreceptor 14.

[Photoreceptor 15]

A photoreceptor is produced in the same manner as in the case of the photoreceptor 1, until the process of forming the charge transport layer.

Subsequently, 70 parts of the compound represented by the formula (I-8), 25 parts of the compound represented by the formula (I-26), and 5 parts of a benzoguanamine resin (NIKALAC BL-60, manufactured by Sanwa Chemical Co., Ltd.) are respectively added to 240 parts of cyclopentanone, and the mixture is sufficiently dissolved and mixed. Subsequently, 0.1 part of dimethylpolysiloxane (GRANOL 450, manufactured by Kyoeisha Chemical Co., Ltd.), and 0.1 part of NACURE 5225 (manufactured by King Industries, Inc.) are added thereto, and thus a coating liquid for protective layer formation is prepared. This coating liquid for surface protective layer formation is coated on the charge transport layer by a dip coating method, and is dried for 35 minutes at 155° C. Thus, a photoreceptor obtained by forming a surface protective layer having a thickness of about 8 μm is designated as photoreceptor 15.

[Photoreceptor 16]

A photoreceptor is produced in the same manner as in the case of the photoreceptor 1, until the process of forming the charge transport layer.

A photoreceptor is obtained in the same manner as in the photoreceptor 1, except that in regard to the formation of the surface protective layer of the photoreceptor 1, the amounts added are changed to 60 parts for the compound represented by the formula (I-8), 15 parts for the compound represented by the formula (I-26), and 25 parts for the benzoguanamine resin. The photoreceptor thus obtained is designated as photoreceptor 16.

[Photoreceptor 17]

A photoreceptor is obtained in the same manner as in the case of the photoreceptor 1, except that the surface protective layer used in the photoreceptor 1 is not formed. The photoreceptor thus obtained is designated as photoreceptor 17.

The principal components contained in the surface protective layer of the photoreceptors are indicated in Table 1.

TABLE 1

| | Principal components contained in surface protective layer | | | | | |
|---|---|---|---|---|---|---|
| | Fluororesin particles | Fluorinated alkyl group-containing copolymer | Charge transporting material | | Guanamine compound | Melamine compound |
| Photoreceptor 1 | 10 parts | 0.5 part | I-8 (70 parts) | I-26 (25 parts) | 5 parts | — |
| Photoreceptor 2 | 5 parts | 0.25 part | I-8 (70 parts) | I-26 (25 parts) | 5 parts | — |
| Photoreceptor 3 | 3 parts | 0.15 part | I-8 (70 parts) | I-26 (25 parts) | 5 parts | — |
| Photoreceptor 4 | 20 parts | 1.0 part | I-8 (70 parts) | I-26 (25 parts) | 5 parts | — |
| Photoreceptor 5 | 10 parts | 0.5 part | I-8 (70 parts) | I-26 (25 parts) | — | 5 parts |
| Photoreceptor 6 | 10 parts | 0.5 part | I-8 (95 parts) | — | 5 parts | — |

TABLE 1-continued

| | Principal components contained in surface protective layer | | | | | |
|---|---|---|---|---|---|---|
| | Fluororesin particles | Fluorinated alkyl group-containing copolymer | Charge transporting material | | Guanamine compound | Melamine compound |
| Photoreceptor 7 | 10 parts | 0.5 part | I-8 (85 parts) | I-26 (10 parts) | 5 parts | — |
| Photoreceptor 8 | 10 parts | 0.5 part | I-8 (60 parts) | I-26 (20 parts) | 20 parts | — |
| Photoreceptor 9 | 10 parts | 0.5 part | I-8 (70 parts) | I-26 (29.9 parts) | 0.1 part | — |
| Photoreceptor 10 | 10 parts | 0.5 part | I-8 (47.5 parts) | I-26 (47.5 parts) | 5 parts | — |
| Photoreceptor 11 | 10 parts | 0.5 part | I-8 (60 parts) | Compound 2 (20 parts) | 20 parts | — |
| Photoreceptor 12 | 10 parts | 0.5 part | I-16 (70 parts) | I-26 (25 parts) | 5 parts | — |
| Photoreceptor 13 | 10 parts | 0.5 part | I-16 (70 parts) | I-26 (25 parts) | — | 5 parts |
| Photoreceptor 14 | 10 parts | 0.5 part | Compound 5 (2 parts) | | — | — |
| Photoreceptor 15 | — | — | I-8 (70 parts) | I-26 (25 parts) | 5 parts | — |
| Photoreceptor 16 | 10 parts | 0.5 part | I-8 (60 parts) | I-26 (15 parts) | 25 parts | — |
| Photoreceptor 17 | — | — | — | — | — | — |

Preparation Example for Toner Mother Particles 1

Preparation of Pigment Dispersion Liquid

C.I. Pigment Blue B15:3: 20 parts by weight

Ethyl acetate: 75 parts by weight

DISPARLON DA-703-50 with solvent removed: 4 parts by weight (Polyester acid amide amine salt, manufactured by Kusumoto Chemicals, Ltd.)

SOLSPERSE 5000 (pigment derivative, manufactured by AstraZeneca K.K.): 1 part by weight The above components are dissolved/dispersed using a sand mill, and thus a pigment dispersion liquid is prepared.

Preparation of Release Agent Dispersion Liquid 30 parts of paraffin wax (melting point 89° C.) as a release agent, and 270 parts of ethyl acetate are wet pulverized in a state of being cooled to 10° C., using a DCP Mill SF-12 (manufactured by Nippon Eirich Co., Ltd.). Thus, a release agent dispersion liquid is prepared.

Synthesis of Crystalline Resin 153 parts of adipic acid, 118 parts of 1,6-hexanediol, and 0.08 part of dibutyltin oxide are introduced into a nitrogen-purged flask, and are allowed to react for 4 hours at 170° C., and for another 4 hours at 210° C. under reduced pressure. Thus, a crystalline resin having a weight average molecular weight (Mw) of 12,000 and a melting point of 68° C. is obtained.

Synthesis of Amorphous Resin (1)

97 parts of dimethyl terephthalate, 78 parts of dimethyl isophthalate, 27 parts of dodecenylsuccinic anhydride, 174 parts of a bisphenol A-ethylene oxide adduct, 189 parts of a bisphenol A-propylene oxide adduct, and 0.08 part of dibutyltin oxide are introduced into a nitrogen-purged flask, and are allowed to react for 4 hours at 150° C., and for another 6 hours at 200° C. under reduced pressure. Subsequently, 8 parts of trimellitic anhydride is added thereto, and the mixture is further allowed to react for 30 minutes under reduced pressure. Thus, an amorphous resin (1) having a weight average molecular weight (Mw) of 55,000 and a glass transition point (Tg) of 56° C. is obtained.

Synthesis of Amorphous Resin (2)

97 parts of dimethyl terephthalate, 78 parts of dimethyl isophthalate, 27 parts of dodecenylsuccinic anhydride, 164 parts of a bisphenol A-ethylene oxide adduct, 179 parts of a bisphenol A-propylene oxide adduct, and 0.08 part of dibutyltin oxide are introduced into a nitrogen-purged flask, and are allowed to react for 4 hours at 150° C., and for another 6 hours at 200° C. under reduced pressure. Thus, an amorphous resin (2) having a weight average molecular weight (Mw) of 13,000 and a glass transition point (Tg) of 60° C. is obtained.

10 parts of the crystalline resin, 66 parts of the amorphous resin (1), 60 parts of the amorphous resin (2), 34 parts of the pigment dispersion liquid, 75 parts of the release agent dispersion liquid, and 56 parts of ethyl acetate are mixed, and the resulting mixture is thoroughly stirred until the mixture becomes uniform (this liquid is designated as liquid A).

124 parts of a calcium carbonate dispersion liquid in which 45 parts of calcium carbonate is dispersed in 55 parts of water, 99 parts of a 2% aqueous solution of CELLOGEN BS-H (manufactured by Daiichi Kogyo Seiyaku Co., Ltd.), and 160 parts of water are stirred together for 5 minutes using a homogenizer (ULTRA-TURRAX: manufactured by IKA GmbH) (this liquid is designated as liquid B). Furthermore, while 345 parts of the liquid B is stirred at 10,000 rpm using a homogenizer (ULTRA-TURRAX: manufactured by IKA GmbH), 250 parts of the liquid A is added thereto, and the liquid mixture is stirred for 1 minute to suspend. Thus, the suspension is stirred using a propeller type stirrer at room temperature and at normal pressure, and thus the solvent is removed. Subsequently, hydrochloric acid is added thereto to dissolve calcium carbonate, and then the addition and mixing of ion-exchanged water, and water washing by filtration are repeated until the electrical conductivity of the liquid reaches 2 μS/cm. Subsequently, the liquid is dried in a vacuum dryer. Fine particles and coarse particles are excluded using an ELBOW-JET classifier, and thus cyan toner mother particles having a volume average particle diameter of 6.4 μm are obtained.

Preparation Example for Carrier 1

Mn—Mg ferrite particles (volume average particle diameter=40 μm): 1,000 parts by weight Styrene (St)/methyl methacrylate (MMA) resin: 23 parts by weight (Copolymerization ratio 25:75)

Carbon black: 2 parts by weight

Toluene: 400 parts by weight

The above composition is introduced into a reduced pressure, heating type kneader and mixed, and the mixture is dried under reduced pressure while heating to 70° C. The product thus obtained is sieved through a SUS sieve having a particle mesh size of 200, and thus a carrier 1 is obtained.

External Additive 1

Commercially available rutile type titanium oxide (n-decyltrimethoxysilane-treated) having a volume average particle diameter of 20 nm is prepared.

External Additive 2

Silica fine particles (dimethylsilicone oil-treated) produced by a gas phase method and having a volume average particle diameter of 12 nm are prepared.

Preparation Example of Zinc-Containing Particles

Preparation Example of Zinc Stearate 1

1,145 parts of stearic acid is added to 5,000 parts of ethanol, and the mixture is mixed at 75° C. 200 parts of zinc hydroxide is added thereto in small amounts, and the mixture is mixed for one hour from the point of completion of introduction. After the mixing, the mixture is cooled to 20° C., and the product is separated by filtration to remove ethanol and reaction residues. The solid product taken therefrom is dried for 3 hours at 150° C. using a heating type vacuum dryer. The product is removed from the dryer and is cooled naturally. Thus, solid zinc stearate is obtained.

The solid zinc stearate is pulverized with a jet mill, and then is classified with an ELBOW-JET classifier (manufactured by Matsubo Corp.). Thus, powdered zinc stearate 1 having a number average particle diameter of 2.6 μm and an average degree of circularity of 0.43 is obtained.

Preparation of Toner 1 and Developer 1

Toner mother particles 1: 100 parts by weight
External additive 1: 1.0 parts by weight
External additive 2: 2.0 parts by weight
Zinc stearate 1: 0.2 part by weight The various components described above are mixed for 3 minutes at 3,000 rpm with a Henschel mixer, and coarse particles are removed by using a 200-mmϕ stainless steel testing sieve having a mesh size of 45 μm (manufactured by Tokyo Screen Co., Ltd.). Thus, a toner 1 is obtained.

Subsequently, the carrier 1 is introduced into a V-blender at a ratio of 100 parts relative to 6.0 parts of the toner 1, and the mixture is mixed and stirred for 20 minutes at 40 rpm. Subsequently, the mixture is sieved through a 200-mmϕ stainless steel testing sieve having a mesh size of 212 μm (manufactured by Tokyo Screen Co., Ltd.). Thus, a developer 1 is obtained.

Preparation of Toner 2 and Developer 2

A toner is obtained in the same manner as in the preparation of the toner 1, except that the amount of zinc stearate 1 used in the preparation of the toner 1 is changed to 0.4 part by weight. The toner thus obtained is designated as toner 2.

Subsequently, the carrier 1 is introduced into a V-blender at a ratio of 100 parts relative to 6.0 parts of the toner 2, and the mixture is mixed and stirred for 20 minutes at 40 rpm. Subsequently, the mixture is sieved through a 200-mmϕ stainless steel testing sieve having a mesh size of 212 μm (manufactured by Tokyo Screen Co., Ltd.). Thus, a developer 2 is obtained.

Preparation of Toner 3 and Developer 3

A toner is obtained in the same manner as in the preparation of the toner 1, except that the amount of zinc stearate 1 used in the preparation of the toner 1 is changed to 0.1 part by weight. The toner thus obtained is designated as toner 3.

Subsequently, the carrier 1 is introduced into a V-blender at a ratio of 100 parts relative to 6.0 parts of the toner 3, and the mixture is mixed and stirred for 20 minutes at 40 rpm. Subsequently, the mixture is sieved through a 200-mmϕ stainless steel testing sieve having a mesh size of 212 μm (manufactured by Tokyo Screen Co., Ltd.). Thus, a developer 3 is obtained.

Preparation of Toner 4 and Developer 4

A toner is obtained in the same manner as in the preparation of the toner 1, except that the zinc stearate 1 used in the preparation of the toner 1 is not used. The toner thus obtained is designated as toner 4.

Subsequently, the carrier 1 is introduced into a V-blender at a ratio of 100 parts relative to 6.0 parts of the toner 4, and the mixture is mixed and stirred for 20 minutes at 40 rpm. Subsequently, the mixture is sieved through a 200-mmϕ stainless steel testing sieve having a mesh size of 212 μm (manufactured by Tokyo Screen Co., Ltd.). Thus, a developer 4 is obtained.

Table 2 shows the contents of the toner mother particles and zinc stearate constituting the toner.

TABLE 2

| | Toner mother particles | Zinc stearate |
|---|---|---|
| Toner 1 | 100 parts | 0.2 part |
| Toner 2 | 100 parts | 0.4 part |
| Toner 3 | 100 parts | 0.1 part |
| Toner 4 | 100 parts | 0 part |

Image Forming Test

Examples 1 to 17 and Comparative Examples 1 to 4

Using the photoreceptors 1 to 17, the photoreceptors and the developers are combined as shown in Table 3, and thus an image forming test is carried out. As the experimental apparatus, a lubricant supply device is removed from the drum cartridge of DOCUCENTRE-II C7500 manufactured by Fuji Xerox Co., Ltd., and this drum cartridge is used. The test is carried out in the black and white mode (75 sheets/min). The test is carried out in a high temperature high humidity (28° C., 80% RH) environment, and the output of an image in which an image section having an image density of 100%, an image section having an image density of 30%, and a 0%-non-image section are present, and the overall image density has been adjusted to 7% as shown in FIG. 7A, is carried out (approximately 25,000 sheets of A4 paper) until the photoreceptor has undergone 50,000 rotations (error within 1%).

After the output of images, an evaluation of electrical characteristics, an evaluation of resolution, and the measurement of the respective amounts of abrasion (nm) and Zn coating ratios in the image section (100% image section) and the non-image section (0% image section) on the surface protective layer per 1,000 rotations of the photoreceptor, are carried out.

Comparative Example 5

An image forming test is carried out using the photoreceptor 1 as the photoreceptor, and the developer 4 as the developer. An evaluation is carried out in the same manner as in the image forming test, except that the drum cartridge of a DOCUCENTRE-II C7500 manufactured by Fuji Xerox Co., Ltd., is used as the experimental apparatus without excluding the lubricant. Thus, an evaluation of electrical characteristics, an evaluation of resolution, and the respective amounts of abrasion (nm) and Zn coating ratios of the image section (100% image section) and the non-image section (0% image section) of the surface protective layer per 1,000 rotations of the photoreceptor are measured.

1. Evaluation of Electrical Characteristics

First, as an evaluation of the initial electrical characteristics of the photoreceptor, the developing unit is removed, an electrostatic voltmeter is set up, and the grid voltage of a scorotron (non-contact type charging unit) is adjusted so as to obtain a photoreceptor surface potential of −700 V. Subsequently, the amount of exposure light is set such that the potential of the exposed section would be −350 V. Image formation is carried out for 100,000 sheets using this amount of exposure light, and then the potential of the exposed section is measured again, while the difference between this potential and the initial potential is indicated as ΔVL(V).

A: $\Delta VL<10$

B: $10\leq\Delta VL<15$

C: $15\leq\Delta VL$

2. Evaluation of Resolution (Image Deletion)

The test is carried out in the same manner as the initial evaluation of the electrical characteristics of the photoreceptor, and the grid voltage and the amount of exposed light are adjusted. Subsequently, 3-pt characters are printed, and the characters are magnified and observed to evaluate whether there is any print deletion.

Figure 6A:
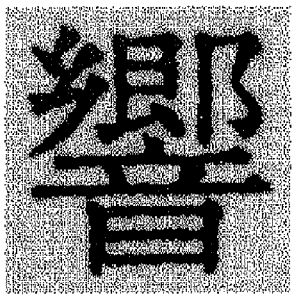
FIGS. 6A, 6B and 6C are diagrams showing the evaluation criteria for the evaluation of resolution.

A: Satisfactory as shown in FIG. 6A

Figure 6B:
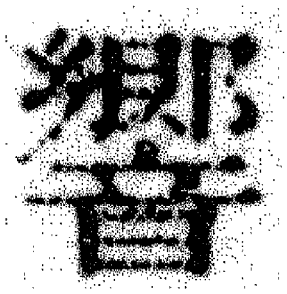

B: Partial disarray or blurring occurs as shown in FIG. 6B (discrimination of characters is possible)

Figure 6C:
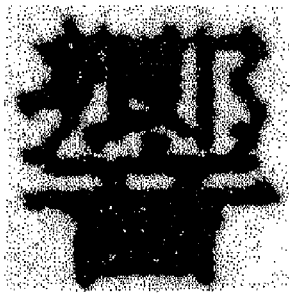

C: The characteristics are broken as shown in FIG. 6C, and thus discrimination of characteristics is impossible.

3. Amount of Abrasion

The measurement of the amount of abrasion is carried out such that at the time of the image forming test, the initial thickness of the surface protective layer is measured in advance, and the difference between the initial thickness and the thickness measured after 1000 rotations of the photoreceptor, is measured. Thus, the amount of abrasion (nm) of the surface protective layer is calculated. Meanwhile, the thickness is measured using an in-house interference type film thickness analyzer; however, once the amount of abrasion is calculated, a commercially available thickness analyzer (for example, a PERMASCOPE manufactured by Fischer Group, or the like) may be used.

A: Less than 2.5 nm for both the image section and the non-image section

B: The larger value between the image section and the non-image section is equal to or greater than 2.5 nm and less than 5 nm.

C: 5 nm or greater for either or both of the image section and the non-image section 4. Measurement of Zinc Coating Ratio The zinc coating ratio by an XPS analysis is determined based on the value of the ratio of zinc relative to all elements, which is measured by a JPS 9010 (manufactured by JEOL, Ltd.). Since the XPS analysis is an analysis of the outermost surface of the photoreceptor, the value of the ratio of zinc relative to all elements becomes saturated, with respect to an increase in the amount of coating of zinc stearate. The saturation value of the ratio of zinc relative to all elements is designated as the coating ratio of 100%, and the zinc coating ratio of the photoreceptor surface is determined.

5. Evaluation Criteria for Comprehensive Judgment

A comprehensive judgment is made according to the following criteria, based on the results of the evaluation of electrical characteristics, the evaluation of resolution, the evaluation of the amount of abrasion, and the evaluation of the zinc coating ratio.

A: Satisfactory (A for all items)

B: Slight inferior but no problem (up to one B)

C: Not usable (one or more Cs)

The results are shown in Table 3.

TABLE 3

| | | | | | Abrasion ratio (nm) | | | Zn coating ratio [%] | | | |
|---|---|---|---|---|---|---|---|---|---|---|---|
| | Photoreceptor | Developer | Electrical characteristics | Resolution | Image section | Non-image section | Rating | Image section | Non-image section | Rating | Comprehensive rating |
| Ex. 1 | Photoreceptor 1 | Developer 1 | 7 (A) | A | 1.0 | 1.1 | A | 81 | 79 | A | A |
| Ex. 2 | Photoreceptor 2 | Developer 1 | 4 (A) | A | 1.3 | 1.8 | A | 71 | 64 | A | A |
| Ex. 3 | Photoreceptor 1 | Developer 2 | 6 (A) | A | 0.9 | 0.9 | A | 98 | 97 | A | A |
| Ex. 4 | Photoreceptor 1 | Developer 3 | 6 (A) | A | 1.1 | 1.3 | A | 62 | 55 | A | A |
| Ex. 5 | Photoreceptor 3 | Developer 3 | 4 (A) | A | 1.8 | 2.5 | B | 67 | 55 | A | B |
| Ex. 6 | Photoreceptor 4 | Developer 1 | 8 (A) | B | 0.8 | 0.8 | A | 91 | 91 | A | B |
| Ex. 7 | Photoreceptor 5 | Developer 1 | 9 (A) | A | 0.9 | 1 | A | 69 | 64 | A | A |
| Ex. 8 | Photoreceptor 6 | Developer 1 | 11 (B) | A | 1.4 | 1.5 | A | 84 | 81 | A | B |
| Ex. 9 | Photoreceptor 7 | Developer 1 | 9 (A) | A | 1.4 | 1.5 | A | 82 | 79 | A | A |
| Ex. 10 | Photoreceptor 8 | Developer 1 | 14 (B) | A | 2.0 | 2.3 | A | 59 | 53 | A | B |
| Ex. 11 | Photoreceptor 9 | Developer 1 | 5 (A) | A | 2.6 | 2.8 | B | 61 | 59 | A | B |
| Ex. 12 | Photoreceptor 10 | Developer 1 | 13 (B) | A | 1.1 | 1.1 | A | 74 | 73 | A | B |
| Ex. 13 | Photoreceptor 11 | Developer 1 | 8 (A) | A | 1.5 | 1.6 | A | 78 | 77 | A | A |
| Ex. 14 | Photoreceptor 12 | Developer 1 | 7 (A) | A | 1.3 | 1.5 | A | 80 | 74 | A | A |

TABLE 3-continued

| | Photoreceptor | Developer | Electrical characteristics | Resolution | Abrasion ratio (nm) Image section | Abrasion ratio (nm) Non-image section | Abrasion ratio (nm) Rating | Zn coating ratio [%] Image section | Zn coating ratio [%] Non-image section | Zn coating ratio [%] Rating | Comprehensive rating |
|---|---|---|---|---|---|---|---|---|---|---|---|
| Ex. 15 | Photoreceptor 13 | Developer 1 | 8 (A) | A | 1.2 | 1.3 | A | 64 | 61 | A | A |
| Ex. 16 | Photoreceptor 14 | Developer 1 | 10 (B) | A | 0.8 | 0.8 | A | 58 | 52 | A | B |
| Ex. 17 | Photoreceptor 16 | Developer 1 | 14 (B) | A | 1.2 | 1.2 | A | 62 | 60 | A | B |
| Comp. Ex. 1 | Photoreceptor 15 | Developer 1 | 5 (A) | C | 3.1 | 3.5 | B | 33 | 20 | C | C |
| Comp. Ex. 2 | Photoreceptor 15 | Developer 2 | 4 (A) | C | 2.7 | 3 | B | 45 | 39 | C | C |
| Comp. Ex. 3 | Photoreceptor 1 | Developer 4 | 6 (A) | C | 1.5 | 1.6 | A | 0 | 0 | C | C |
| Comp. Ex. 4 | Photoreceptor 17 | Developer 1 | 4 (A) | A | 15 | 16 | C | 52 | 47 | C | C |
| Comp. Ex. 5 | Photoreceptor 1 | Developer 4 | 6 (A) | A | 2.6 | 1.4 | B | 47 | 64 | C | C |

As shown in Table 1, it can be seen that the Examples have high Zn coating ratios, and maintain excellent resolution while maintaining satisfactory abrasion ratios as compared with Comparative Examples, and thus, satisfactory images are repeatedly obtained over a long time period.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an electrophotographic photoreceptor having a conductive substrate, a photosensitive layer disposed on the conductive substrate, and a surface protective layer that is disposed on the photosensitive layer and contains fluororesin particles and a fluorinated alkyl group-containing copolymer;

a charging unit that charges a surface of the electrophotographic photoreceptor;

an electrostatic latent image forming unit that forms an electrostatic latent image on the surface of the charged electrophotographic photoreceptor;

a developing unit that comprises a developer containing toner particles and zinc stearate, and develops the electrostatic latent image formed on the surface of the electrophotographic photoreceptor with the developer to form a toner image, a content of zinc stearate relative to the toner particles in the developer being from about 0.01% by weight to about 2% by weight;

a transfer unit that transfers the toner image formed on the surface of the electrophotographic photoreceptor to a recording medium; and a cleaning unit that removes the developer remaining on the surface of the electrophotographic photoreceptor, wherein when the electrophotographic photoreceptor is rotated 50,000 times by repeating the formation of an image having image sections and non-image sections and having an image density of 7%, and then the surface of the electrophotographic photoreceptor is analyzed by X-ray photoelectron spectroscopy (XPS), a ratio of a zinc coating to a surface of the electrophotographic photoreceptor is in a range of from about 50% to about 100%; and wherein:

the surface protective layer of the electrophotographic photoreceptor contains at least one of a guanamine compound and a melamine compound, a structure originating from a charge transporting material having an alkoxy group, and a structure originating from a charge transporting material having a hydroxyl group;

a total content of the guanamine compound and the melamine compound relative to a total solids content of the surface protective layer excluding the fluororesin particles and the fluorinated alkyl group-containing copolymer is from about 0.1% by weight to about 5% by weight; and a content of the structure originating from a charge transporting material having an alkoxy group relative to the total solids content of the surface protective layer excluding the fluororesin particles and the fluorinated alkyl group-containing copolymer is from about 10% by weight to about 40% by weight.

2. The image forming apparatus according to claim 1, wherein the ratio of the zinc coating to the surface of the electrophoretic photoreceptor is in the range of from about 50% to about 90%.

3. The image forming apparatus according to claim 1, wherein the ratio of the zinc coating to the surface of the electrophoretic photoreceptor is in the range of from about 55% to about 70%.

4. The image forming apparatus according to claim 1, wherein the content of zinc stearate relative to the toner particles in the developer is from about 0.05% by weight to about 1% by weight.

5. The image forming apparatus according to claim 1, wherein the content of zinc stearate relative to the toner particles in the developer is from about 0.2% by weight to about 1% by weight.

6. The image forming apparatus according to claim 1, wherein the content of the fluororesin particles is from about 1% by weight to about 40% by weight relative to a total solids content of the surface protective layer.

7. The image forming apparatus according to claim 1, wherein the content of the fluororesin particles is from about 3% by weight to about 20% by weight relative to a total solids content of the surface protective layer.

8. The image forming apparatus according to claim 1, wherein in the surface of the electrophotographic photoreceptor, the difference between the zinc coating ratio in a region corresponding to the image section and the zinc coating ratio in a region corresponding to the non-image section is about 10% or less.

9. The image forming apparatus according to claim 1, wherein the fluororesin particles contain at least one selected from a polymer of tetrafluoroethylene, and a copolymer of tetrafluoroethylene and perfluoroalkoxyethylene.

10. The image forming apparatus according to claim 1, wherein the fluorinated alkyl group-containing copolymer is a fluorinated alkyl group-containing copolymer containing a repeating unit represented by the following structural formula (A) and a repeating unit represented by the following structural formula (B):

Structural Formula (A)

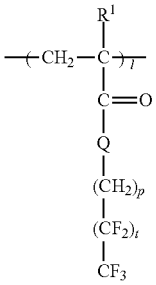

-continued

Structural Formula (B)

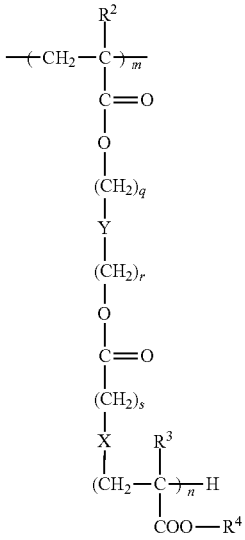

wherein in the structural formula (A) and the structural formula (B), l, m and n each represent an integer of 1 or greater; p, q, r and s each represent 0 or an integer of 1 or greater; t represents an integer of from 1 to 7; $R^1$, $R^2$, $R^3$ and $R^4$ each represent a hydrogen atom or an alkyl group; X represents an alkylene chain, a halogen-substituted alkylene chain, —S—, —O—, —NH—, or a single bond; Y represents an alkylene chain, a halogen-substituted alkylene chain, —($C_zH_{2z-1}$(OH))—, or a single bond; z represents an integer of 1 or greater; and Q represents —O— or —NH—.

* * * * *